US009978574B2

(12) United States Patent
Brown et al.

(10) Patent No.: US 9,978,574 B2
(45) Date of Patent: May 22, 2018

(54) SAMPLE COLLECTION IN COMPACT MASS SPECTROMETRY SYSTEMS

(71) Applicant: 908 Devices Inc., Boston, MA (US)

(72) Inventors: Christopher D. Brown, Los Gatos, CA (US); Glenn A. Harris, Boston, MA (US); Kevin J. Knopp, Brookline, MA (US); Michael Jobin, Boston, MA (US); Michael Goodwin, Brookline, MA (US); Anthony G. Liepert, Lincoln, MA (US); Cyril P. Blank, Cambridge, MA (US)

(73) Assignee: 908 Devices Inc., Boston, MA (US)

( * ) Notice: Subject to any disclaimer, the term of this patent is extended or adjusted under 35 U.S.C. 154(b) by 0 days. days.

(21) Appl. No.: 15/355,163

(22) Filed: Nov. 18, 2016

(65) Prior Publication Data

US 2017/0084439 A1 Mar. 23, 2017

Related U.S. Application Data

(63) Continuation of application No. 14/596,511, filed on Jan. 14, 2015, now Pat. No. 9,502,226.
(Continued)

(51) Int. Cl.
*H01J 49/04* (2006.01)
*H01J 49/26* (2006.01)
(Continued)

(52) U.S. Cl.
CPC ..... *H01J 49/049* (2013.01); *H01J 49/0031* (2013.01); *H01J 49/10* (2013.01);
(Continued)

(58) Field of Classification Search
USPC ..... 250/284, 425, 429, 281–283, 287, 288, 250/290–293
See application file for complete search history.

(56) References Cited

U.S. PATENT DOCUMENTS 2,939,952 A 6/1960 Paul et al.
5,142,143 A 8/1992 Fite et al.
(Continued)

FOREIGN PATENT DOCUMENTS

DE 102005044307 3/2007
EP 1 566 828 8/2005
(Continued)

OTHER PUBLICATIONS

Alberici et al., "Ambient mass spectrometry: bringing MS into the 'real world,'" Anal. Bioanal. Chem. 398: 265-294 (2010).
(Continued)

*Primary Examiner* — Bernard Souw
(74) *Attorney, Agent, or Firm* — Fish & Richardson P.C.

(57) ABSTRACT

Mass spectrometry systems include a core featuring an ion source, an ion trap, and an ion detector connected along a gas path, a pressure regulation subsystem connected to the gas path and configured to regulate a gas pressure in the gas path, a sample pre-concentrator connected to the gas path, where the sample pre-concentrator includes an adsorbent material, and a controller connected to the sample pre-concentrator, where during operation of the system, the controller is configured to heat sample particles adsorbed on the adsorbent material to desorb the particles from the adsorbent material and introduce the desorbed particles into the gas path, and a pressure difference between a gas pressure in the sample pre-concentrator and a gas pressure in at least one of the ion source, the ion trap, and the ion detector when the desorbed particles are introduced into the gas path is 50 mTorr or less.

27 Claims, 20 Drawing Sheets

Related U.S. Application Data

(60) Provisional application No. 61/927,470, filed on Jan. 14, 2014.

(51) Int. Cl.
*H01J 49/00* (2006.01)
*H01J 49/10* (2006.01)
*H01J 49/24* (2006.01)
*H01J 49/42* (2006.01)

(52) U.S. Cl.
CPC ..... *H01J 49/24* (2013.01); *H01J 49/26* (2013.01); *H01J 49/4245* (2013.01)

(56) References Cited

U.S. PATENT DOCUMENTS 5,206,506 A 4/1993 Kirchner
5,248,883 A 9/1993 Brewer et al.
5,399,857 A 3/1995 Doroshenko et al.
5,542,828 A 8/1996 Grenci et al.
5,613,294 A 3/1997 Ferran
5,854,431 A 12/1998 Linker et al.
5,959,297 A * 9/1999 Weinberg ..... B01J 19/0046 250/288
6,157,031 A 12/2000 Prestage
6,188,067 B1 2/2001 Chutjian et al.
6,336,816 B1 1/2002 Yatskov et al.
6,345,545 B1 2/2002 Linker et al.
6,469,298 B1 10/2002 Ramsey et al.
6,483,109 B1 11/2002 Reinhold et al.
6,521,898 B2 2/2003 Chutjian et al.
6,656,738 B1 12/2003 Vogel et al.
6,753,523 B1 6/2004 Whitehouse et al.
6,762,406 B2 7/2004 Cooks et al.
6,797,950 B2 9/2004 Schwartz et al.
6,822,225 B2 11/2004 Xu et al.
6,933,498 B1 8/2005 Whitten et al.
6,958,473 B2 10/2005 Belov et al.
7,095,013 B2 8/2006 Bateman et al.
7,247,822 B2 7/2007 Johnston
7,442,920 B2 10/2008 Scheidemann et al.
7,772,546 B2 8/2010 Jackson
7,906,759 B2 3/2011 Manri et al.
7,973,277 B2 7/2011 Rafferty
8,022,360 B2 9/2011 Taylor
8,101,908 B2 1/2012 Senko
9,502,226 B2 * 11/2016 Brown ..... H01J 49/049
2002/0176804 A1 11/2002 Strand et al.
2003/0020013 A1 1/2003 Sakairi
2003/0141447 A1 7/2003 Verentchikov et al.
2003/0155347 A1 8/2003 Oh et al.
2004/0217279 A1 11/2004 Hobbs et al.
2004/0222374 A1 11/2004 Scheidemann et al.
2005/0258353 A1 11/2005 Berkout et al.
2006/0076482 A1 4/2006 Hobbs et al.
2006/0076483 A1 4/2006 Scheidemann et al.
2006/0097147 A1 5/2006 Anderson et al.
2007/0039241 A1 2/2007 Battke et al.
2007/0045533 A1 3/2007 Krutchinsky et al.
2007/0122312 A1 5/2007 Chojnacki et al.
2007/0200060 A1 * 8/2007 Russ, IV ..... H01J 49/0009 250/288
2007/0205361 A1 * 9/2007 Russ, IV ..... H01J 49/0009 250/288
2008/0073510 A1 3/2008 Finlay
2008/0128613 A1 6/2008 Buttrill
2008/0210860 A1 9/2008 Kovtoun
2008/0236747 A1 10/2008 Matsudo et al.
2009/0039283 A1 2/2009 Franzen et al.
2009/0194684 A1 8/2009 Guna et al.
2009/0294662 A1 12/2009 Belov et al.
2010/0051605 A1 3/2010 Bode
2010/0072358 A1 3/2010 Jackson
2010/0078551 A1 4/2010 Loboda
2010/0148062 A1 6/2010 Wollnik et al.
2010/0273203 A1 * 10/2010 Miller ..... G01N 33/86 435/29
2011/0005607 A1 1/2011 Desbiolles et al.
2011/0036980 A1 2/2011 Lisa et al.
2011/0121171 A1 5/2011 Clemmer et al.
2011/0127416 A1 6/2011 Campuzano et al.
2011/0127419 A1 6/2011 Thomson et al.
2011/0253891 A1 10/2011 Hashimoto et al.
2011/0290648 A1 12/2011 Majlof et al.
2013/0001415 A1 1/2013 Chen et al.
2013/0015342 A1 1/2013 Steiner et al.
2013/0043382 A1 2/2013 Berkout et al.
2013/0056633 A1 3/2013 Hashimoto et al.
2013/0146759 A1 6/2013 Ouyang et al.
2014/0117224 A1 5/2014 Tate et al.
2015/0200083 A1 * 7/2015 Brown ..... H01J 49/049 250/282
2017/0084439 A1 * 3/2017 Brown ..... H01J 49/049

FOREIGN PATENT DOCUMENTS

EP 1 688 985 8/2006
GB 2 250 633 6/1992
WO WO 94/29006 12/1994
WO WO 2011/031559 3/2011
WO WO 2012/025470 2/2012

OTHER PUBLICATIONS

Albrieux et al., "Ion trajectory simulations in a high-pressure cylindrical ion trap," European J. Mass Spectrom. 16: 557-565 (2010).
Amini et al., "Microfabricated Chip Traps for Ions," Atom Chips (2011).
Austin et al., "Simulations of Ion Trapping in a Micrometer-Sized Cylindrical Ion Trap," J. Am. Soc. Mass Spectrom. 17: 430-441 (2006).
Badman et al., "A Miniature Cylindrical Quadrupole Ion Trap: Simulation and Experiment," Anal.Chem. 70: 4896-4901 (1998).
Badman et al., "Miniature mass analyzers," J. Mass Spectrom. 35: 659-671 (2000).
Blain et al., "Micro Mass Spectrometer on a Chip," Sandia Report SAND2005-6838 (2005).
Brewer et al., "Planar ion microtraps," Phys. Rev. A 46(11): R6781-R6784 (1992).
Chen et al., "A Micro Ionizer for Portable Mass Spectrometers using Double-gated Isolated Vertically Aligned Carbon Nanofiber Arrays," IEEE Trans. Electron Devices 58(7): 2149-2158 (2011).
Cheung, Kerry, "Chip-Scale Quadrupole Mass Filters for a Micro-Gas Analyzer," PhD. Thesis, Massachusetts Institute of Technology, 2009.
Cruz et al., "Design, microfabrication, and analysis of micrometer-sized cylindrical ion trap arrays," Rev. Sci. Instrum. 78: 015107 (2007).
Falconer et al., "High Pressure Ion Detection for Miniaturized Mass Spectrometers," Presentation at 58$^{th}$ ASMS Conference 2010, Salt Lake City, UT, May 23, 2010.
Ferran et al., "High-pressure effects in miniature arrays of quadrupole analyzers for residual gas analysis from 10-9 to 10-2 Torr," J. Vac. Sci. Technol. A 14(3): 1258-1265 (1996).
Gao et al., "Design and Characterization of a Multisource Hand-Held Tandem Mass Spectrometer," Anal. Chem. 80 (19): 7198-7205 (2008).
Gao et al., "Handheld Rectilinear Ion Trap Mass Spectrometer," Anal. Chem. 78: 5994-6002 (2006).
Gao, Liang, "Miniaturization of the Ion Trap Mass Spectrometer," PhD. Thesis, Purdue University, 2009.
Goeringer et al., "Theory of High-Resolution Mass Spectrometry Achieved via Resonance Ejection in the Quadrupole Ion Trap," Anal. Chem. 64: 1434-1439 (1992).
Hadjar et al., "High-efficiency cross-beam magnetic electron-impact source for improved miniature Mattauch-Herzog mass spectrometer performance," Rev. Sci. Instrum. 83: 064101 (2012).

(56) References Cited

OTHER PUBLICATIONS

Harris et al., "Ambient Sampling/ionization Mass Spectrometry: Applications and Current Trends," Anal. Chern. 83: 4508-4538 (2011).
Harris et al., "Transportable real-time single-particle ion trap mass spectrometer," Rev. Sci. Instrum. 76: 064102 (2005).
Hood, Derrell L., "Development of a Novel Loeb-Eiber Mass Filter," M.S. Thesis, Ohio State University, 2009.
Huang et al., "Direct analysis of melamine in complex matrices using a handheld mass spectrometer," Analyst 135: 705-711 (2010).
International Search Report and Written Opinion for International Application No. PCT/US2015/011393 dated Apr. 2, 2015 (16 pages).
International Search Report and Written Opinion in PCT Patent Application No. PCT/US2012/072328, dated Oct. 2, 2013.
Keil et al., "Ambient Mass Spectrometry with a Handheld Mass Spectrometer at High Pressure," Anal. Chern. 79: 7734-7739 (2007).
Kornienko et al., "Electron impact ionization in a microion trap mass spectrometer," Rev. Sci. Instrum. 70(10): 3907-3909 (1999).
Kornienko et al., "Micro Ion Trap Mass Spectrometry," Rapid Commun. Mass Spectrom. 13: 50-53 (1999).
Li et al., "Ion Trap Array Mass Analyzer: Structure and Performance," Anal. Chern. 81: 4840-4846 (2009).
March, Raymond E., "An Introduction to Quadrupole Ion Trap Mass Spectrometry," J. Mass Spectrom. 32: 351-369 (1997).
March, Raymond E., "Quadrupole Ion Trap Mass Spectrometer," Encyclopedia of Analytical Chemistry, pp. 11848-11872 (2000).
Misharin et al., "Development and characterization of a field deployable ion trap mass spectrometer with atmospheric pressure interface," Anal. Chem. 84(22): 10105-10112 (2012).
Moxon et al., "Analysis of Volatile Organic Compounds in Air with a Micro Ion Trap Mass Analyzer," Anal. Chem. 75: 3739-3743 (2003).
Moxon et al., "Double resonance ejection in a micro ion trap mass spectrometer," Rapid Commun. Mass Spectrom. 16: 755-760 (2002).
Moxon et al., "Sample pressure effects in a micro ion trap mass spectrometer," Rapid Commun. Mass Spectrom. 18: 721-723 (2004.
Orient et al., "Miniature, high-resolution, quadrupole mass-spectrometer array," Rev. Sci. Instrum. 68: 1393-1397 (1997).
Ouyang et al., "Rectilinear Ion Trap: Concepts, Calculations, and Analytical Performance of a New Mass Analyzer," Anal. Chem. 76: 4595-4605 (2004).
Pau et al., "Microfabricated Quadrupole Ion Trap for Mass Spectrometer Applications," Phys. Rev. Lett. 96: 120801 (2006).
Pau et al., "Planar Geometry for Trapping and Separating Ions and Charged Particles," Anal. Chem. 79: 6857-6861 (2007).
Peng et al., "New Approaches to Miniaturizing Ion Trap Mass Analyzers," Trends Anal. Chem. 30(10): 1560-1567 (2011 ).
Shiea, Jentaie, "Ionization methods for miniature mass spectrometers," Presentation at P1TTCON 2012, Orlando, FL, Mar. 14, 2012.
Sokol et al., "Miniature mass spectrometer equipped with electrospray and desorption electrospray ionization for direct analysis of organics from solids and solutions," Int. J. Mass Spectrom. 306: 187-195 (2011).
Song, Qingyu, "Development of Mass Spectrometers using Rectilinear Ion Trap Analyzers," PhD. Thesis, Purdue University, 2008.
Syms, R.R.A., "Advances in microfabricated mass spectrometers," Anal. Bioanal. Chem. 393: 427-429 (2009).
Telrandhe, Mangesh, "Fabrication and testing of a cylindrical ion trap microarray for tunable mass spectrometers," M. S. Thesis, University of South Florida, 2004.
Van Amerom et al., "Microfabrication of Cylindrical Ion Trap Mass Spectrometer Arrays for Handheld Chemical Analyzers," Chem. Eng. Comm. 195: 98-114 (2008).
Wells et al., "A Quadrupole Ion Trap with Cylindrical Geometry Operated in the Mass-Selective Instability Mode," Anal. Chem. 70(3): 438-444 (1998).
Whitten et al., "High-pressure ion trap mass spectrometry," Rapid Commu. Mass Spectrom. 18: 1749-1752 (2004).
Winchester et al., "Emission Characteristics of a Pulsed, Radio-Frequency Glow Discharge Atomic Emission Device", *Analytical Chemistry*, vol. 64, No. 18, pp. 2067-2074 (Sep. 15, 1992).
Wolfe et al., "RF amplifier optimization for improved resolution in microscale cylindrical ion traps," Presentation at 59th ASMS Conference 2011, Denver, CO, Jun. 5, 2011.
Xu et al., "Ion Trap Mass Analysis at High Pressure: A Theoretical View," J. Am. Soc. Mass Spectrom. 20: 2144-2153 (2009).
Xu et al., "Nondestructive Ion Trap Mass Analysis at High Pressure," Anal. Chem. 83(3): 685-689 (2011).
Zhang et al., "Paul Trap Mass Analyzer Consisting of Opposing Microfabricated Electrode Pairs," Anal. Chem. 81: 5241-5248 (2009).
International Preliminary Report on Patentability and Written Opinion of the International Searching Authority for International Application No. PCT/US2015/011393 dated Jul. 19, 2016 (9 pages).

* cited by examiner

SAMPLE COLLECTION IN COMPACT MASS SPECTROMETRY SYSTEMS

CROSS-REFERENCE TO RELATED APPLICATIONS

This application is a continuation of and claims priority to U.S. patent application Ser. No. 14/596,511, filed on Jan. 14, 2015, which claims priority to U.S. Provisional Patent Application No. 61/927,470, filed on Jan. 14, 2014. The entire contents of the prior applications are incorporated herein by reference.

TECHNICAL FIELD

This disclosure relates to mass spectrometry systems and methods for measuring mass spectral information.

BACKGROUND

Mass spectrometers are widely used for the detection of chemical substances. In a typical mass spectrometer, molecules or particles are excited or ionized, and these excited species often break down to form ions of smaller mass or react with other species to form other characteristic ions. The ion formation pattern can be interpreted by a system operator to infer the identity of the compound.

SUMMARY

This disclosure features methods and systems for collecting and pre-concentrating samples, and for introducing samples into mass spectrometry systems. The methods and systems can be used with a variety of mass spectrometry systems, and are particularly advantageous when used in compact systems that operate at relatively high pressure during the measurement of mass spectrometry information. At relatively high pressures, samples can be pre-concentrated and then rapidly introduced into the mass spectrometry systems, which increases the sensitivity of the systems and reduces overall power consumption and size, relative to conventional mass spectrometers.

In the methods and systems disclosed herein, samples are pre-concentrated on one or more different adsorbent materials, and then desorbed via a rapid heating process. In some embodiments, the adsorbent material itself forms the heating element, leading to more rapid transfer of heat to the adsorbed analytes, and reducing power consumption during the desorption process. Desorbed analyte molecules can be directly introduced into the mass spectrometry system without passing through a flow rate-limiting membrane or aperture, significantly enlarging the amount of an analyte that can be analyzed by the system. As a result, measurement signals are typically stronger, and resolution and sensitivity are improved, while overall power consumption and system size remain relatively small, in comparison to conventional mass spectrometry systems.

In a first aspect, the disclosure features mass spectrometry systems that include a core featuring an ion source, an ion trap, and an ion detector connected along a gas path, a pressure regulation subsystem connected to the gas path and configured to regulate a gas pressure in the gas path, a sample pre-concentrator connected to the gas path, where the sample pre-concentrator includes an adsorbent material, and a controller connected to the sample pre-concentrator, where during operation of the system, the controller is configured to heat sample particles adsorbed on the adsorbent material to desorb the particles from the adsorbent material and introduce the desorbed particles into the gas path, and a pressure difference between a gas pressure in the sample pre-concentrator and a gas pressure in at least one of the ion source, the ion trap, and the ion detector when the desorbed particles are introduced into the gas path is 50 mTorr or less.

Embodiments of the systems can include any one or more of the following features.

The systems can include a heating element coupled to the controller, where during operation of the system, the controller is configured to heat the sample particles by activating the heating element.

During operation of the system, the pressure regulation subsystem can be configured to maintain a gas pressure in the gas path of between 100 mTorr and 10 Torr.

During operation of the system, the controller can be configured to open an inlet to the sample pre-concentrator to admit sample particles to the pre-concentrator, and to collect the admitted sample particles on the adsorbent material. The controller can be configured to collect the sample particles on the adsorbent material for an interval of between 5 seconds and 30 minutes.

During operation of the system, the desorbed sample particles can be introduced into the gas path without passing the sample particles through a flow rate-limiting element. During operation of the system, 10 picograms or more of sample particles can be desorbed and introduced into the gas flow path in an interval of between 1 second and 30 seconds. The controller can be configured to analyze the sample particles introduced into the gas path within a period of 10 s or less to obtain mass spectral information about the sample particles.

The pre-concentrator can be a first pre-concentrator, the system further including a second pre-concentrator featuring an adsorbent material and connected to the controller. The controller can be configured to alternately operate the system in each of two configurations, where: in a first configuration, the first pre-concentrator is connected to the gas path and the second pre-concentrator is not connected to the gas path; and in a second configuration, the second pre-concentrator is connected to the gas path and the first pre-concentrator is not connected to the gas path. In the first configuration, sample particles adsorbed on the adsorbent material of the first pre-concentrator can be desorbed and introduced into the gas path, and sample particles can be admitted to the second pre-concentrator and adsorbed onto the adsorbent material of the second pre-concentrator. In the second configuration, sample particles adsorbed on the adsorbent material of the second pre-concentrator can be desorbed and introduced into the gas path, and sample particles can be admitted to the first pre-concentrator and adsorbed onto the adsorbent material of the first pre-concentrator. The controller can be configured to operate the system in the first configuration for a first time interval, and in the second configuration for a second time interval different from the first time interval.

The first and second pre-concentrators can be coupled to at least one actuator and configured to move relative to the core. The controller can be configured to operate the system by activating the at least one actuator to move the first and second pre-concentrators relative to the core to alternately operate the system in the two configurations.

In the first and second configurations, the first and second pre-concentrators can be connected to the gas path, respectively, through a common fluid conduit. In the first and second configurations, the first and second pre-concentrators can be connected to the gas path through different fluid conduits.

In the first configuration, the pressure regulation subsystem can be configured to maintain a gas pressure in the first pre-concentrator, and the second pre-concentrator can be connected to a pump configured to maintain a gas pressure in the second pre-concentrator. In the first configuration, the pressure regulation subsystem can maintain a first gas pressure in the first pre-concentrator, and the pressure regulation subsystem can maintain a second gas pressure in the second pre-concentrator that is different from the first gas pressure.

The pre-concentrator can include a module featuring the adsorbent material and a heating element, the systems can include a housing featuring a first recess configured to receive the core, and a second recess configured to receive the module, so that the core and module are each independently insertable and removable from the housing, and the module can be configured so that when it is positioned within the second recess and the core is positioned within the first recess, an interior region of the module is connected to the gas path.

The pre-concentrator can include electrodes attached to the adsorbent material, and during operation of the system, the controller can be configured to heat the sample particles by directing an electrical current to flow between the electrodes and through the adsorbent material. The adsorbent material can include activated carbon. The adsorbent material can include a mixture of activated carbon and polymer particles. The adsorbent material can include at least one of polymer particles and silicon particles coated on beads formed of one or more metals. The adsorbent material can include particles of one or more metals.

The pre-concentrator can include a housing packed with the adsorbent material. The pre-concentrator can include a housing, and interior surfaces of the housing can be coated with the adsorbent material.

The pre-concentrator can include: a first layer of adsorbent material, and two electrodes attached to the first layer; a second layer of adsorbent material, and two electrodes attached to the second layer; and a housing enclosing the first and second layers of adsorbent material, where during operation of the system, the controller can be selectively configured to heat sample particles adsorbed to the first layer of adsorbent material or the second layer of adsorbent material by directing an electrical current to flow through the first or second layer of adsorbent material, respectively. A composition of the first layer of adsorbent material can be different from a composition of the second layer of adsorbent material.

The pre-concentrator can include a plurality of metallic wires and the adsorbent material can be deposited on the plurality of metallic wires.

The controller can be configured to heat the sample particles to desorb the sample particles from the adsorbent material within a desorption period of 30 s or less (e.g., 10 s or less). The controller can be configured to heat the sample particles to a temperature of 400° C. or more. The controller can be configured to heat the sample particles to pyrolyze the sample particles and desorb pyrolyzed fragments of the particles from the adsorbent material. The controller can be configured to heat the sample particles in successive temperature increments of between 50° C. and 10° C. to desorb the sample particles.

The systems can include a sample port configured to receive a swab featuring sample molecules adsorbed to the swab. The sample port can include a recess configured to receive the swab, a heating element configured to contact the swab when the swap is positioned in the recess, and a member configured to seal an opening to the sample port, where during operation of the system, when a swab is positioned in the recess and the member is deployed to seal the opening to the sample port, the controller is configured to activate the heating element to heat the sample molecules adsorbed to the swab to desorb the sample molecules from the swab and introduce the desorbed sample molecules into the core. The systems can include a second pre-concentrator positioned between the sample port and the core, where the second pre-concentrator is configured to receive desorbed sample molecules from the swab and to concentrate the sample molecules before they are introduced into the core.

Embodiments of the systems can also include any of the other features disclosed herein, including combinations of features disclosed in connection with different embodiments, in any combination as appropriate.

In another aspect, the disclosure features methods for determining mass spectral information that include collecting a plurality of sample particles by adsorbing the sample particles on an adsorbent material in a sample pre-concentrator connected to a gas path of a mass spectrometry system, heating the adsorbed sample particles to desorb the sample particles from the adsorbent material, introducing the desorbed sample particles into the gas path and maintaining a pressure difference between the sample pre-concentrator and at least one of an ion source, an ion trap, and an ion detector connected to the gas path of 50 mTorr or less, ionizing at least some of the introduced sample particles to generate ions, and measuring electrical signals associated with the generated ions to determine information about the sample particles.

Embodiments of the methods can include any one or more of the following features.

The methods can include heating the sample particles by activating a heating element. The methods can include maintaining a gas pressure in the gas path of between 100 mTorr and 10 Torr. The methods can include admitting sample particles to the pre-concentrator, and collecting the admitted sample particles on the adsorbent material. The methods can include collecting the sample particles on the adsorbent material for an interval of between 5 seconds and 30 minutes.

The methods can include introducing the desorbed sample particles into the gas path without passing the sample particles through a flow rate-limiting element. The methods can include desorbing and introducing 10 picograms or more of sample particles into the gas flow path in an interval of between 1 second and 30 seconds. The methods can include ionizing at least some of the introduced sample particles and measuring the electrical signals within a period of 10 s or less to determine the information about the sample particles.

The pre-concentrator can be a first pre-concentrator of the mass spectrometry system and the mass spectrometry system can include a second pre-concentrator, and the methods can include alternately operating in each of two configurations, where: in a first configuration, the first pre-concentrator is connected to the gas path and a second pre-concentrator is not connected to the gas path; and in a second configuration, the second pre-concentrator is connected to the gas path and the first pre-concentrator is not connected to the gas path. In the first configuration, sample particles adsorbed on the adsorbent material of the first pre-concentrator can be desorbed and introduced into the gas path, and sample particles can be admitted to the second pre-concentrator and adsorbed onto an adsorbent material of the second pre-concentrator. In the second configuration, sample particles adsorbed on the adsorbent material of the second pre-concentrator can be desorbed and introduced into the gas path, and sample particles can be admitted to the first pre-concentrator and adsorbed onto the adsorbent material of the first pre-concentrator.

The methods can include operating in the first configuration for a first time interval, and in the second configuration for a second time interval different from the first time interval. The methods can include moving the first and second pre-concentrators relative to the gas path to select one of the two configurations.

The methods can include heating the adsorbed sample particles by directing an electrical current to flow through the adsorbent material. The methods can include heating the adsorbed sample particles to desorb the sample particles from the adsorbent material for a desorption period of 30 s or less (e.g., 10 s or less).

The methods can include heating the sample particles to a temperature of 400° C. or more. The methods can include heating the sample particles to pyrolyze the sample particles on the adsorbent material, and to desorb pyrolyzed fragments of the particles from the adsorbent material. The methods can include heating the sample particles in successive temperature increments of between 50° C. and 10° C. to desorb the sample particles.

Embodiments of the methods can also include any of the other features disclosed herein, including combinations of features disclosed in connection with different embodiments, in any combination as appropriate.

In a further aspect, the disclosure features methods for determining mass spectral information that include: opening an inlet to a gas path of a mass spectrometry system, and positioning a swab comprising adsorbed sample particles on a heating element within the inlet; deploying a member to seal the inlet; heating the sample particles adsorbed to the swab to desorb the sample particles from the swab; introducing the desorbed sample particles into the gas path; ionizing at least some of the desorbed sample particles to generate ions; and measuring electrical signals associated with the generated ions to determine information about the sample particles.

Embodiments of the methods can include any one or more of the following features.

The methods can include heating the adsorbed sample particles for a desorption period of 30 s or less (e.g., 10 s or less) to desorb the sample particles from the swab. An elapsed time between an onset of heating of the sample particles and measuring the electrical signals can be 60 seconds or less (e.g., 30 seconds or less, 15 seconds or less).

Embodiments of the methods can also include any of the other features disclosed herein, including combinations of features disclosed in connection with different embodiments, in any combination as appropriate.

In another aspect, the disclosure features mass spectrometry system systems that include a core featuring an ion source, an ion trap, and an ion detector connected along a gas path, a pressure regulation subsystem connected to the gas path and configured to regulate a gas pressure in the gas path, a sample pre-concentrator connected to the gas path, where the sample pre-concentrator features an adsorbent material, and a controller connected to the sample pre-concentrator, where during operation of the system, the controller is configured to: open an inlet from a region external to the system to the sample pre-concentrator to admit sample particles into the pre-concentrator and collect the admitted sample particles on the adsorbent material; close the inlet; and heat the sample particles collected on the adsorbent material to desorb the particles from the adsorbent material and introduce the desorbed particles into the gas path, and where the controller is configured to collect the admitted sample particles at a first gas pressure within the sample pre-concentrator, and to heat the collected sample particles at a second gas pressure lower than the first gas pressure.

Embodiments of the systems can include any one or more of the following features.

The first gas pressure can be 760 Torr or more (e.g., 1000 Torr or more). The second gas pressure can be between 100 mTorr and 10 Torr. The second gas pressure can be 1 Torr or more. A pressure difference between the second gas pressure and a gas pressure in at least one of the ion source, the ion trap, and the ion detector when the desorbed particles are introduced into the gas path can be 50 mTorr or less.

The systems can include a heating element coupled to the controller, where during operation of the system, the controller can be configured to heat the sample particles by activating the heating element. The controller can be configured to collect the sample particles on the adsorbent material for an interval of between 5 seconds and 30 minutes.

During operation of the system, the desorbed sample particles can be introduced into the gas path without passing the sample particles through a flow rate-limiting element. During operation of the system, 10 picograms or more of sample particles can be desorbed and introduced into the gas flow path in an interval of between 1 second and 30 seconds. The controller can be configured to analyze the sample particles introduced into the gas path within a period of 10 s or less to obtain mass spectral information about the sample particles.

The pre-concentrator can be a first pre-concentrator, and the system can include a second pre-concentrator featuring an adsorbent material and connected to the controller. The controller can be configured to alternately operate the system in each of two configurations, where: in a first configuration, the first pre-concentrator is connected to the gas path and the second pre-concentrator is not connected to the gas path; and in a second configuration, the second pre-concentrator is connected to the gas path and the first pre-concentrator is not connected to the gas path. In the first configuration, the controller can be configured to admit sample particles into the second pre-concentrator and collect the admitted sample particles at a third gas pressure on the adsorbent material of the second pre-concentrator, and heat collected sample particles on the adsorbent material of the first sample pre-concentrator at the second gas pressure. In the second configuration, the controller can be configured admit sample particles into the first sample pre-concentrator and collect the admitted sample particles at the first gas pressure on the adsorbent material of the first pre-concentrator, and heat collected sample particles on the adsorbent material of the second sample pre-concentrator at a fourth gas pressure lower than the third gas pressure. The second and fourth gas pressures can be the same. The first and third gas pressures can be the same. The third gas pressure can be 760 Torr or more (e.g., 1000 Torr or more). The fourth gas pressure can be between 100 mTorr and 10 Torr. The fourth gas pressure can be 1 Torr or more. A pressure difference between the fourth gas pressure and a gas pressure in at least one of the ion source, the ion trap, and the ion detector when the desorbed particles from the adsorbent material of the second sample pre-concentrator are introduced into the gas path can be 50 mTorr or less. The controller can be configured to operate the system in the first configuration for a first time interval, and in the second configuration for a second time interval different from the first time interval.

The first and second pre-concentrators can be coupled to at least one actuator and configured to move relative to the core. The controller can be configured to operate the system by activating the at least one actuator to move the first and second pre-concentrators relative to the core to alternately operate the system in the two configurations.

In the first and second configurations, the first and second pre-concentrators can be connected to the gas path, respectively, through a common fluid conduit. In the first and second configurations, the first and second pre-concentrators can be connected to the gas path through different fluid conduits. In the first configuration, the pressure regulation subsystem can be configured to maintain the second gas pressure in the first pre-concentrator, and the second pre-concentrator can be connected to a pump configured to maintain the third gas pressure in the second pre-concentrator. In the first configuration, the pressure regulation subsystem can maintain the second gas pressure in the first pre-concentrator and the third gas pressure in the second pre-concentrator. In the second configuration, the pressure regulation subsystem can be configured to maintain the fourth gas pressure in the second pre-concentrator, and the first pre-concentrator can be connected to a pump configured to maintain the first gas pressure in the first pre-concentrator. In the second configuration, the pressure regulation subsystem can maintain the fourth gas pressure in the second pre-concentrator and the first gas pressure in the first pre-concentrator.

The pre-concentrator can include a module featuring the adsorbent material and a heating element, the system can include a housing featuring a first recess configured to receive the core, and a second recess configured to receive the module, so that the core and module are each independently insertable and removable from the housing, and the module can be configured so that when it is positioned within the second recess and the core is positioned within the first recess, an interior region of the module is connected to the gas path. The pre-concentrator can include electrodes attached to the adsorbent material, and during operation of the system, the controller can be configured to heat the sample particles by directing an electrical current to flow between the electrodes and through the adsorbent material.

The adsorbent material can include activated carbon. The adsorbent material can include a mixture of activated carbon and polymer particles. The adsorbent material can include at least one of polymer particles and silicon particles coated on beads formed of one or more metals. The adsorbent material can include particles of one or more metals.

The pre-concentrator can include a housing packed with the adsorbent material. The pre-concentrator can include a housing, and interior surfaces of the housing can be coated with the adsorbent material.

The pre-concentrator can include: a first layer of adsorbent material, and two electrodes attached to the first layer; a second layer of adsorbent material, and two electrodes attached to the second layer; and a housing enclosing the first and second layers of adsorbent material, where during operation of the system, the controller can be selectively configured to heat sample particles adsorbed to the first layer of adsorbent material or the second layer of adsorbent material by directing an electrical current to flow through the first or second layer of adsorbent material, respectively. A composition of the first layer of adsorbent material can be different from a composition of the second layer of adsorbent material.

The pre-concentrator can include a plurality of metallic wires and the adsorbent material can be deposited on the plurality of metallic wires.

The controller can be configured to heat the sample particles to desorb the sample particles from the adsorbent material within a desorption period of 30 s or less (e.g., 10 s or less). The controller can be configured to heat the sample particles to a temperature of 400° C. or more. The controller can be configured to heat the sample particles to pyrolyze the sample particles and desorb pyrolyzed fragments of the particles from the adsorbent material. The controller can be configured to heat the sample particles in successive temperature increments of between 50° C. and 10° C. to desorb the sample particles.

The systems can include a sample port configured to receive a swab featuring sample molecules adsorbed to the swab. The sample port can include a recess configured to receive the swab, a heating element configured to contact the swab when the swap is positioned in the recess, and a member configured to seal an opening to the sample port, where during operation of the system, when a swab is positioned in the recess and the member is deployed to seal the opening to the sample port, the controller can be configured to activate the heating element to heat the sample molecules adsorbed to the swab to desorb the sample molecules from the swab and introduce the desorbed sample molecules into the core. The systems can include a second pre-concentrator positioned between the sample port and the core, where the second pre-concentrator is configured to receive desorbed sample molecules from the swab and to concentrate the sample molecules before they are introduced into the core.

Embodiments of the systems can also include any of the other features disclosed herein, including combinations of features disclosed in different embodiments, in any combination as appropriate.

In a further aspect, the disclosure features methods for determining mass spectral information, the methods including collecting a plurality of sample particles by adsorbing the sample particles on an adsorbent material at a first gas pressure in a sample pre-concentrator connected to a gas path of a mass spectrometry system, heating the adsorbed sample particles at a second gas pressure lower than the first gas pressure to desorb the sample particles from the adsorbent material, introducing the desorbed sample particles into the gas path, ionizing at least some of the introduced sample particles to generate ions, and measuring electrical signals associated with the generated ions to determine information about the sample particles.

Embodiments of the methods can include any one or more of the following features.

The first gas pressure can be 760 Torr or more (e.g., 1000 Torr or more). The second gas pressure can be between 100 mTorr and 10 Torr. The second gas pressure can be 1 Torr or more.

The methods can include maintaining a pressure difference between the second gas pressure and a gas pressure in at least one of an ion source, an ion trap, and an ion detector of the mass spectrometry system when the desorbed particles are introduced into the gas path of 50 mTorr or less.

The methods can include heating the sample particles by activating a heating element. The methods can include collecting the sample particles on the adsorbent material for an interval of between 5 seconds and 30 minutes. The methods can include introducing the desorbed sample particles into the gas path without passing the sample particles through a flow rate-limiting element. The methods can include desorbing and introducing 10 picograms or more of sample particles into the gas flow path in an interval of between 1 second and 30 seconds. The methods can include analyzing the sample particles introduced into the gas path within a period of 10 s or less to obtain mass spectral information about the sample particles.

The pre-concentrator can be a first pre-concentrator of the mass spectrometry system and the mass spectrometry system can include a second pre-concentrator, and the methods can include alternately operating in each of two configurations, where in a first configuration, the first pre-concentrator is connected to the gas path and the second pre-concentrator is not connected to the gas path, and in a second configuration, the second pre-concentrator is connected to the gas path and the first pre-concentrator is not connected to the gas path.

In the first configuration, the controller can be configured to collect sample particles at a third gas pressure on an adsorbent material of the second pre-concentrator, and heat collected sample particles on the adsorbent material of the first sample pre-concentrator at the second gas pressure. In the second configuration, the controller can be configured to collect sample particles at the first gas pressure on the adsorbent material of the first pre-concentrator, and heat collected sample particles on the adsorbent material of the second sample pre-concentrator at a fourth gas pressure lower than the third gas pressure. The second and fourth gas pressures can be the same. The first and third gas pressures can be the same. The third gas pressure can be 760 Torr or more (e.g., 1000 Torr or more). The fourth gas pressure can be between 100 mTorr and 10 Torr. The fourth gas pressure can be 1 Torr or more. The methods can include maintaining a pressure difference between the fourth gas pressure and a gas pressure in at least one of an ion source, an ion trap, and an ion detector of the mass spectrometry system when the desorbed particles from the adsorbent material of the second sample pre-concentrator are introduced into the gas path of 50 mTorr or less.

The methods can include operating the system in the first configuration for a first time interval, and in the second configuration for a second time interval different from the first time interval. The methods can include moving the first and second pre-concentrators relative to the gas path to select one of the two configurations. The methods can include heating the sample particles by directing an electrical current to flow through the adsorbent material. The methods can include heating the sample particles to desorb the sample particles from the adsorbent material within a desorption period of 30 s or less (e.g., 10 s or less).

The methods can include heating the sample particles to a temperature of 400° C. or more. The methods can include heating the sample particles to pyrolyze the sample particles and desorb pyrolyzed fragments of the particles from the adsorbent material. The methods can include heating the sample particles in successive temperature increments of between 50° C. and 10° C. to desorb the sample particles.

Embodiments of the methods can also include any of the other features disclosed herein, including combinations of features disclosed in connection with different embodiments, in any combination as appropriate.

Unless otherwise defined, all technical and scientific terms used herein have the same meaning as commonly understood by one of ordinary skill in the art to which this disclosure belongs. Although methods and materials similar or equivalent to those described herein can be used in the practice or testing of the subject matter herein, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments are set forth in the accompanying drawings and the description below. Other features and advantages will be apparent from the description, drawings, and claims.

DESCRIPTION OF DRAWINGS

Like reference symbols in the various drawings indicate like elements.

DETAILED DESCRIPTION

I. General Overview

Figure 1A:
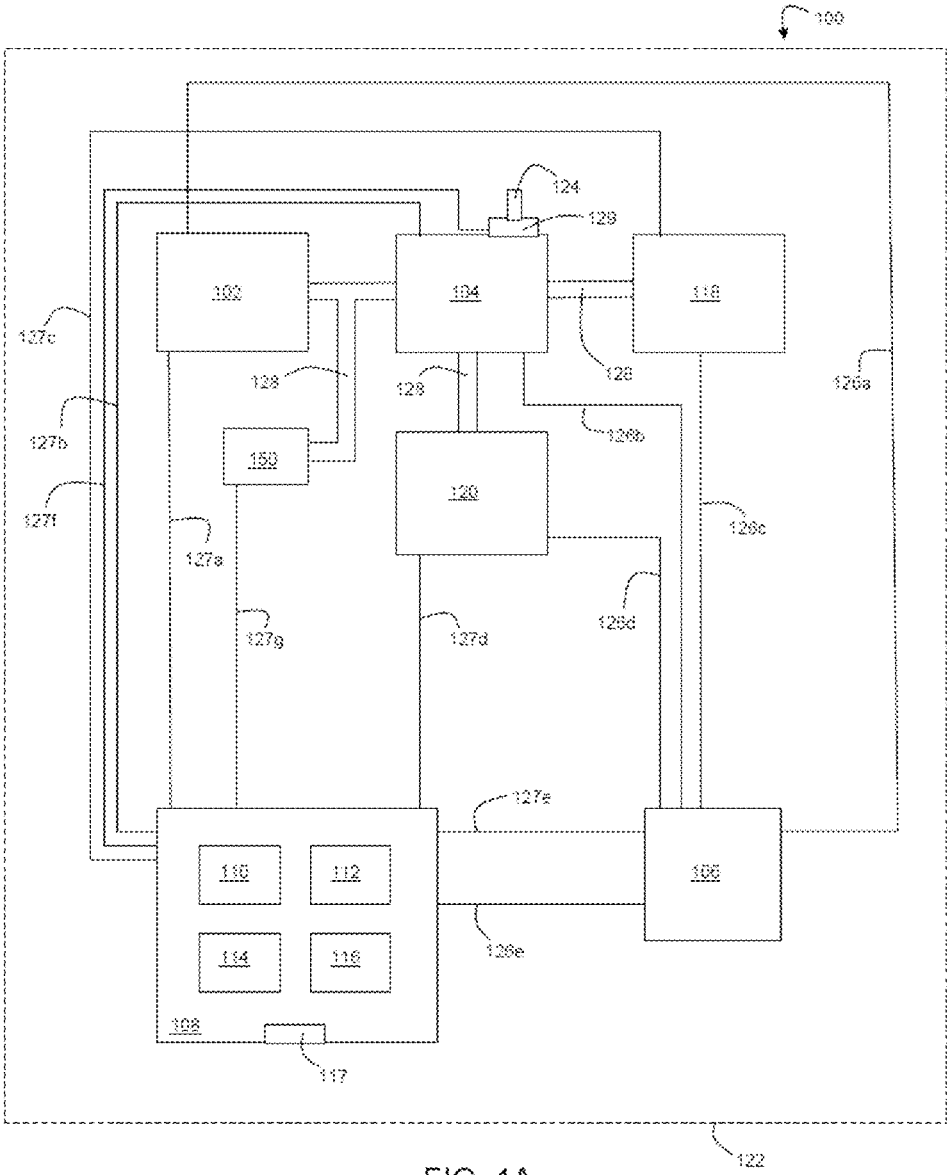
FIG. 1A is a schematic diagram of a compact mass spectrometer.

Mass spectrometers that are used for identification of chemical substances are typically large, complex instruments that consume considerable power. Such instruments are frequently too heavy and bulky to be portable, and thus are limited to applications in environments where they can remain essentially stationary. Further, conventional mass spectrometers are typically expensive and require highly trained operators to interpret the spectra of ion formation patterns that the instruments produce to infer the identities of chemical substances that are analyzed.

To achieve high sensitivity and resolution, conventional mass spectrometers typically use a variety of different components that are designed for operation at low gas pressures. For example, conventional ion detectors such as electron multipliers do not operate effectively at pressures above approximately 10 mTorr. As another example, thermionic emitters that are used in conventional ion sources are also best suited for operation at pressures less than 10 mTorr when oxygen is not present. Further, conventional mass spectrometers typically include mass analyzers with geometries specifically designed only for operation at pressures of less than 10 mTorr, and in particular, at pressures in the microTorr range. As a result, not only are conventional mass spectrometers configured for operation at low pressures, but conventional mass spectrometers—due to the components they use—generally cannot be operated at higher gas pressures. Higher gas pressures can, for example, destroy certain components of conventional spectrometers. Less dramatically, certain components may simply fail to operate at higher gas pressures, or may operate so poorly that the spectrometers can no longer acquire useful mass spectral information. As a result, mass spectrometers with significantly different configurations and components are needed for operation at high pressures (e.g., pressures larger than 100 mTorr).

To achieve low pressures, conventional mass spectrometers typically include a series of pumps for evacuating the interior volume of a spectrometer. For example, a conventional mass spectrometer can include a rough pump that rapidly reduces the internal pressure of the system, and a turbomolecular pump that further reduces the internal pressure to microTorr values. Turbomolecular pumps are large and consume considerable electrical power. Such considerations are only of secondary importance in conventional mass spectrometers, however; the consideration of primary importance is achieving high resolution in measured mass spectra. By using the foregoing components operating at low pressure, conventional mass spectrometers commonly can achieve resolutions of 0.1 atomic mass units (amu) or better.

In contrast to heavy, bulky conventional mass spectrometers, the compact mass spectrometers disclosed herein are designed for low power, high efficiency operation. To achieve low power operation, the compact mass spectrometers disclosed herein do not include turbomechanical or other power hungry vacuum pumps. Instead, the compact mass spectrometers typically include only a single mechanical pump operating at low frequency, which reduces power consumption significantly.

By using smaller pumps, the compact mass spectrometers disclosed herein typically operate within a pressure range of 100 mTorr to 100 Torr, which is significantly higher than the operating pressure range for conventional mass spectrometers. Conventional mass spectrometers are not modifiable to operate at these higher pressures, because the components used in conventional instruments (e.g., electron multipliers, thermionic emitters, and ion trap) do not function within the pressure range in which the compact mass spectrometers disclosed herein operate. Further, conventional mass spectrometers are generally not modified to operate at higher internal pressures, because doing so typically would result in poorer resolution in the mass spectra measured with such devices. Because obtaining mass spectra with the highest possible resolution is generally the goal when using such devices, there is little reason to modify the devices to provide poorer resolution.

However, the compact mass spectrometers disclosed herein provide different types of information to a user than conventional mass spectrometers. Specifically, the compact mass spectrometers disclosed herein typically report information such as a name of a chemical substance being analyzed, hazard information associated with the substance, and/or a class to which the substance belongs. The compact mass spectrometers disclosed herein can also report, for example, whether the substance either is or is not a particular target substance. Typically, the mass spectra recorded are not displayed to the user unless the user activates a control that causes the display of the spectra. As a result, unlike conventional mass spectrometers, the compact mass spectrometers disclosed herein do not need to obtain mass spectra with the highest possible resolution. Instead, as long as the spectra obtained are of high enough quality to determine the information that is reported to the user, further increases in resolution are not a critical performance criterion.

By operating at lower resolution (typically, mass spectra are obtained at resolutions of between 1 amu and 10 amu), the compact mass spectrometers disclosed herein consume significantly less power than conventional mass spectrometers. For example, the compact mass spectrometers disclosed herein feature miniature ion traps that operate efficiently at pressures from 100 mTorr to 100 Torr to separate ions of different mass-to-charge ratio, while at the same time consuming far less power than conventional mass analyzers such as ion traps due to their reduced size. For example, as the size of a cylindrical ion trap decreases, the maximum voltage applied to the trap to separate ions decreases, and the frequency with which the voltage is applied increases. As a result, the size of inductors and/or resonators used in power supply circuitry is reduced, and the sizes and power consumption requirements of other components used to generate the maximum voltage are also reduced.

Further, the compact mass spectrometers disclosed herein feature efficient ion sources such as glow discharge ionization sources and/or capacitive discharge ionization sources that further reduce power consumption relative to ion sources such as thermionic emitters that are commonly found in conventional mass spectrometers. Efficient, low power detectors such as Faraday detectors are used in the compact mass spectrometers disclosed herein, rather than the more power hungry electron multipliers that are present in conventional mass spectrometers. As a result of these low power components, the compact mass spectrometers disclosed herein operate efficiently and consume relatively small amounts of electrical power. They can be powered by standard battery-based power sources (e.g., Li ion batteries), and are portable with a handheld form factor.

Because they provide high resolution mass spectra directly to the user, conventional mass spectrometers are generally ill-suited for applications that involve mobile scanning of substances by personnel without special training. In particular, for applications such as on-the-spot security scanning in transportation hubs such as airports and train stations, conventional mass spectrometers are impractical solutions. In contrast, such applications instead benefit from mass spectrometers that are compact, require relatively low power to operate, and provide information that can readily be interpreted by personnel without advanced training, as described above. Compact, low cost mass spectrometers are also useful for a variety of other applications. For example, such devices can be used in laboratories to provide rapid characterization of unknown chemical compounds. Due to their low cost and tiny footprint, laboratories can provide workers with personal spectrometers, reducing or eliminating the need to schedule analysis time at a centralized mass spectrometry facility. Compact mass spectrometers can also be used for applications such as medical diagnostics testing, both in clinical settings and in residences of individual patients. Technicians performing such testing can readily interpret the information provided by such spectrometers to provide real-time feedback to patients, and also to provide rapidly updated information to medical facilities, physicians, and other health care providers.

This disclosure features compact, low power mass spectrometers that provide a variety of information to users including identification of chemical substances scanned by the spectrometers and/or associated contextual information, including information about a class to which substances belong (e.g., acids, bases, strong oxidizers, explosives, nitrated compounds), information about hazards associated with the substances, and safety instructions and/or information. The spectrometers operate at internal gas pressures that are higher than conventional mass spectrometers. By operating at higher pressures, the size and power consumption of the compact mass spectrometers is significantly reduced relative to conventional mass spectrometers. Moreover, even though the spectrometers operate at higher pressures, the resolution of the spectrometers is sufficient to permit accurate identification and quantification of a wide variety of chemical substances.

FIG. 1A is a schematic diagram of an embodiment of a compact mass spectrometer 100. Spectrometer 100 includes an ion source 102, an ion trap 104, a voltage source 106, a controller 108, a detector 118, a pressure regulation subsystem 120, and a sample inlet 124. Sample inlet 124 includes a valve 129. Optionally included in spectrometer 100 is a buffer gas source 150. The components of spectrometer 100 are enclosed within a housing 122. Controller 108 includes an electronic processor 110, a user interface 112, a storage unit 114, a display 116, and a communication interface 117.

Controller 108 is connected to ion source 102, ion trap 104, detector 118, pressure regulation subsystem 120, voltage source 106, valve 129, and optional buffer gas source 150 via control lines 127*a*-127*g*, respectively. Control lines 127*a*-127*g* permit controller 108 (e.g., electronic processor 110 in controller 108) to issue operating commands to each of the components to which it is connected. Such commands can include, for example, signals that activate ion source 102, ion trap 104, detector 118, pressure regulation subsystem 120, valve 129, and buffer gas source 150. Commands that activate the various components of spectrometer 100 can include instructions to voltage source 106 to apply electrical potentials to elements of the components. For example, to activate ion source 102, controller 108 can transmit instructions to voltage source 106 to apply electrical potentials to electrodes in ion source 102. As another example, to activate ion trap 104, controller 108 can transmit instructions to voltage source 106 to apply electrical potentials to electrodes in ion trap 104. As a further example, to activate detector 118, controller 108 can transmit instructions to voltage source 106 to apply electrical potentials to detection elements in detector 118. Controller 108 can also transmit signals to activate pressure regulation subsystem 120 (e.g., through voltage source 106) to control the gas pressure in the various components of spectrometer 100, and to valve 129 (e.g., through voltage source 106) to allow gas particles to enter spectrometer 100 through sample inlet 124.

Further, controller 108 can receive signals from each of the components of spectrometer 100 through control lines 127*a*-127*g*. For example, such signals can include information about the operational characteristics of ion source 102 and/or ion trap 104 and/or detector 118 and/or pressure regulation subsystem 120. Controller 108 can also receive information about ions detected by detector 118. The information can include ion currents measured by detector 118, which are related to abundances of ions with specific mass-to-charge ratios. The information can also include information about specific voltages applied to electrodes of ion trap 104 as particular ion abundances are measured by detector 118. The specific applied voltages are related to specific values of mass-to-charge ratio for the ions. By correlating the voltage information with the measured abundance information, controller 108 can determine abundances of ions as a function of mass-to-charge ratio, and can present this information using display 116 in the form of mass spectra.

Voltage source 106 is connected to ion source 102, ion trap 104, detector 118, pressure regulation subsystem 120, and controller 108 via control lines 126*a*-*e*, respectively. Voltage source 106 provides electrical potentials and electrical power to each of these components through control lines 126*a*-*e*. Voltage source 106 establishes a reference potential that corresponds to an electrical ground at a relative voltage of 0 Volts. Potentials applied by voltage source 106 to the various components of spectrometer 100 are referenced to this ground potential. In general, voltage source 106 is configured to apply potentials that are positive and potentials that are negative, relative to the reference ground potential, to the components of spectrometer 100. By applying potentials of different signs to these components (e.g., to the electrodes of the components), electric fields of different signs can be generated within the components, which cause ions to move in different directions. Thus, by applying suitable potentials to the components of spectrometer 100, controller 108 (through voltage source 106) can control the movement of ions within spectrometer 100.

Ion source 102, ion trap 104, and detector 118 are connected such that an internal pathway for gas particles and ions, gas path 128, extends between these components. Sample inlet 124 and pressure regulation subsystem 120 are also connected to gas path 128. Optional buffer gas source 150, if present, is connected to gas path 128 as well. Portions of gas path 128 are shown schematically in FIG. 1A. In general, gas particles and ions can move in any direction in gas path 128, and the direction of movement can be controlled by the configuration of spectrometer 100. For example, by applying suitable electrical potentials to electrodes in ion source 102 and ion trap 104, ions generated in ion source 102 can be directed to flow from ion source 102 into ion trap 104.

Figure 1B:
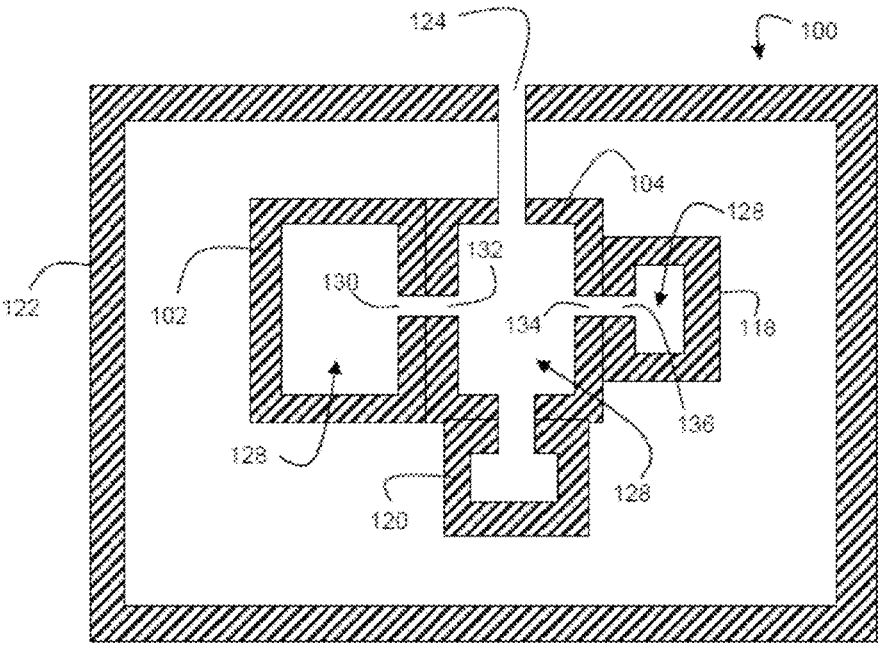
FIG. 1B is a cross-sectional diagram of an embodiment of a mass spectrometer.

FIG. 1B shows a partial cross-sectional diagram of mass spectrometer 100. As shown in FIG. 1B, an output aperture 130 of ion source 102 is coupled to an input aperture 132 of ion trap 104. Further, an output aperture 134 of ion trap 104 is coupled to an input aperture 136 of detector 118. As a result, ions and gas particles can flow in any direction between ion source 102, ion trap 104, and detector 118. During operation of spectrometer 100, pressure regulation subsystem 120 operates to reduce the gas pressure in gas path 128 to a value that is less than atmospheric pressure. As a result, gas particles to be analyzed enter sample inlet 124 from the environment surrounding spectrometer 100 (e.g., the environment outside housing 122) and move into gas path 128. Gas particles that enter ion source 102 through gas path 128 are ionized by ion source 102. The ions propagate from ion source 102 into ion trap 104, where they are trapped by electrical fields created when voltage source 106 applies suitable electrical potentials to the electrodes of ion trap 104.

The trapped ions circulate within ion trap 104. To analyze the circulating ions, voltage source 106, under the control of controller 108, varies the amplitude of a radiofrequency trapping field applied to one or more electrodes of ion trap 104. The variation of the amplitude occurs repetitively, defining a sweep frequency for ion trap 104. As the amplitude of the field is varied, ions with specific mass-to-charge ratios fall out of orbit and some are ejected from ion trap 104. The ejected ions are detected by detector 118, and information about the detected ions (e.g., measured ion currents from detector 118, and specific voltages that are applied to ion trap 104 when particular ion currents are measured) is transmitted to controller 108.

Figure 1C:
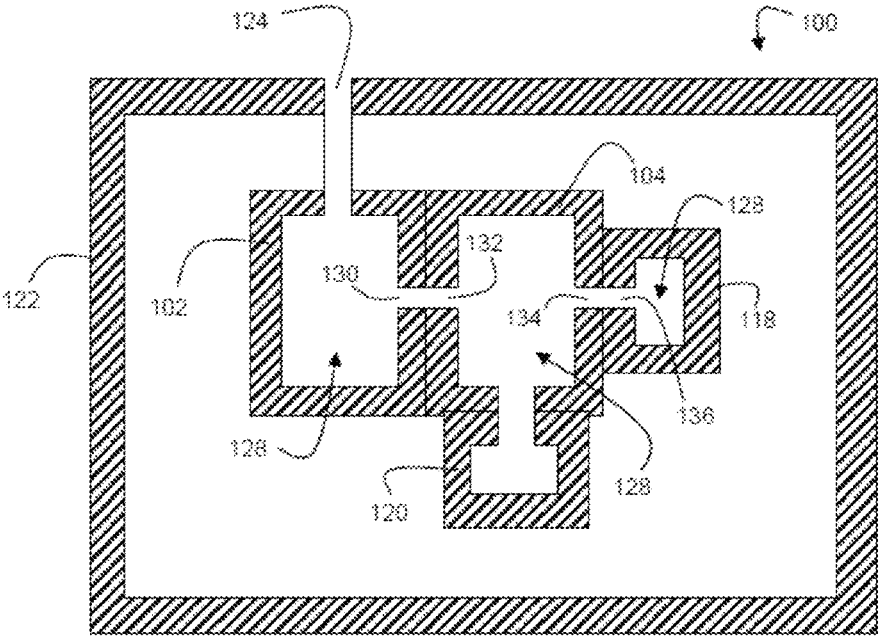
FIG. 1C is a cross-sectional diagram of another embodiment of a mass spectrometer.

Although sample inlet 124 is positioned in FIGS. 1A and 1B so that gas particles enter ion trap 104 from the environment outside housing 122, more generally sample inlet 124 can also be positioned at other locations. For example, FIG. 1C shows a partial cross-sectional diagram of spectrometer 100 in which sample inlet 124 is positioned so that gas particles enter ion source 102 from the environment outside housing 122. In addition to the configuration shown in FIG. 1C, sample inlet 124 can generally be positioned at any location along gas path 128, provided that the position of sample inlet 124 allows gas particles to enter gas path 128 from the environment outside housing 122.

Communication interface 117 can, in general, be a wired or wireless communication interface (or both). Through communication interface 117, controller 108 can be configured to communicate with a wide variety of devices, including remote computers, mobile phones, and monitoring and security scanners. Communication interface 117 can be configured to transmit and receive data over a variety of networks, including but not limited to Ethernet networks, wireless WiFi networks, cellular networks, and Bluetooth wireless networks. Controller 108 can communicate with remote devices using communication interface 117 to obtain a variety of information, including operating and configuration settings for spectrometer 100, and information relating to substances of interest, including records of mass spectra of known substances, hazards associated with particular substances, classes of compounds to which substances of interest belong, and/or spectral features of known substances. This information can be used by controller 108 to analyze sample measurements. Controller 108 can also transmit information to remote devices, including alerting messages when certain substances (e.g., hazardous and/or explosive substances) are detected by spectrometer 100.

The mass spectrometers disclosed herein are both compact and capable of low power operation. To achieve both compact size and low power operation, the various spectrometer components, including ion source 102, ion trap 104, detector 118, pressure regulation subsystem 120, and voltage source 106, are carefully designed and configured to minimize space requirements and power consumption. In conventional mass spectrometers, the vacuum pumps used to achieve low internal operating pressures (e.g., $1\times10^{-3}$ Torr or considerably less) are both large and consume significant amounts of electrical power. For example, to reach such pressures, conventional mass spectrometers typically employ a series of two or more pumps, including a rough pump that rapidly reduces the internal system pressure from atmospheric pressure to about 0.1-10 Torr, and one or more turbomolecular pumps that reduce the internal system pressure from 10 Torr to the desired internal operating pressure. Both rough pumps and turbomolecular pumps are mechanical pumps that require significant quantities of electrical power to run. Rough pumps (which can include, for example, piston-based pumps) typically generate significant mechanical vibrations. Turbomolecular pumps are typically sensitive to both vibrations and mechanical shocks, and produce effects that are similar to a gyroscope due to their high rotational speeds. As a result, conventional mass spectrometers include power sources sufficient to meet the consumption requirements of their vacuum pumps, and isolation mechanisms (e.g., vibrational and/or rotational isolation mechanisms) to ensure that these pumps remain operating. Conventional mass spectrometers may even require that while operating, the turbomolecular pumps therein cannot be moved, as doing so may result in mechanical vibrations that would destroy these pumps. As a result, the combination of vacuum pumps and electrical power sources used in conventional mass spectrometers makes them large, heavy, and immobile.

In contrast, the mass spectrometer systems and methods disclosed herein are compact, mobile, and achieve low power operation. These characteristics are realized in part by eliminating the turbomolecular, rough, and other large mechanical pumps that are common to conventional spectrometers. In place of these large pumps, small, low power single mechanical pumps are used to control gas pressure within the mass spectrometer systems. The single mechanical pumps used in the mass spectrometer systems disclosed herein cannot reach pressures as low as conventional turbomolecular pumps. As a result, the systems disclosed herein operate at higher internal gas pressures than conventional mass spectrometers.

As will be explained in greater detail below, operating at higher pressure generally degrades the resolution of a mass spectrometer, due to a variety of mechanisms such as collision-induced line broadening and charge exchange among molecular fragments. As used herein, "resolution" is defined as the full width at half-maximum (FWHM) of a measured mass peak. The resolution of a particular mass spectrometer is determined by measuring the FWHM for all peaks that appear within the range of mass-to-charge ratios from 100 to 125 amu, and selecting the largest FWHM that corresponds to a single peak (e.g., peak widths that correspond to closely spaced sets of two or more peaks are excluded) as the resolution. To determine the resolution, a chemical substance with a well known mass spectrum, such as toluene, can be used.

While the resolution of a mass spectrometer may be degraded when operating at higher pressures, the mass spectrometers disclosed herein are configured so that reduced resolution does not compromise the usefulness of the spectrometers. Specifically, the mass spectrometers disclosed herein are configured so that when a chemical substance of interest is scanned using a spectrometer, the spectrometer reports to the user information relating to an identity of the substance, rather than a mass-resolved spectrum of molecular ions, as is common in conventional mass spectrometers. In some embodiments, the algorithms used in the mass spectrometers disclosed herein can compare measured ion fragmentation patterns to information about known fragmentation patterns to determine information such as an identity of the substance of interest, hazard information relating to the substance of interest, and/or one or more classes of compounds to which the substance of interest belongs. In certain embodiments, the algorithms can include expert systems to determine information about the identity of the substance of interest. For example, digital filters can be used to search for particular features in measured spectra for a substance of interest, and the substance can be identified as corresponding to a particular target substance or not corresponding to the target substance based on the presence or absence of the features in the spectra.

When controller 108 performs the foregoing analyses, reduced resolution due to operation at high pressure can be compensated for by the systems disclosed herein. That is, provided a reliable correspondence between a measured fragmentation pattern and reference information can be achieved, the lower resolution due to high pressure operation is of little consequence to users of the mass spectrometers disclosed herein. Thus, even though the mass spectrometers disclosed herein operate at higher pressures than conventional mass spectrometers, they remain useful for a wide variety of applications such as security scanning, medical diagnostics, and laboratory analysis, in which the user is primarily concerned with identifying a substance of interest rather than examining the substance's ion fragmentation pattern in detail, and where the user may not have advanced training in the interpretation of mass spectra.

By using a single, small mechanical pump, the weight, size, and power consumption of the mass spectrometers disclosed herein is substantially reduced relative to conventional mass spectrometers. Thus, the mass spectrometers disclosed herein generally include pressure regulation subsystem 120, which features a small mechanical pump, and which is configured to maintain an internal gas pressure (e.g., a gas pressure in gas path 128, and in ion source 102, ion trap 104, and detector 118, all of which are connected to gas path 128) of between 100 mTorr and 100 Torr (e.g., between 100 mTorr and 500 mTorr, between 500 mTorr and 100 Torr, between 500 mTorr and 10 Torr, between 500 mTorr and 5 Torr, between 100 mTorr and 1 Torr). In some embodiments, the pressure regulation subsystem is configured to maintain an internal gas pressure in the mass spectrometers disclosed herein of more than 100 mTorr (e.g., more than 500 mTorr, more than 1 Torr, more than 10 Torr, more than 20 Torr).

At the foregoing pressures, the mass spectrometers disclosed herein detect ions at a resolution of 10 amu or better. For example, in some embodiments, the resolution of the mass spectrometers disclosed herein, measured as described above, is 10 amu or better (e.g., 8 amu or better, 6 amu or better, 5 amu or better, 4 amu or better, 3 amu or better, 2 amu or better, 1 amu or better). In general, any of these resolutions can be achieved at any of the foregoing pressures using the mass spectrometers disclosed herein.

In addition to a pump, pressure regulation subsystem 120 can include a variety of other components. In some embodiments, pressure regulation subsystem 120 includes one or more pressure sensors. The one or more pressure sensors can be configured to measure gas pressure in a fluid conduit to which pressure regulation subsystem 120 is connected, e.g., gas path 128. Measurements of gas pressure can be transmitted to a pump within pressure regulation subsystem 120, and/or to controller 108, and can be displayed on display 116. In certain embodiments, pressure regulation subsystem 120 can include other elements for fluid handling such as one or more valves, apertures, sealing members, and/or fluid conduits.

To ensure that the pressure regulation subsystem functions efficiently to control the internal pressure in the mass spectrometers disclosed herein, the internal volume of the spectrometers (e.g., the volume that is pumped by the pressure regulation subsystem) is significantly reduced relative to the internal volume of conventional mass spectrometers. Reducing the internal volume has the added benefit of reducing the overall size of the mass spectrometers disclosed herein, making them compact, portable, and capable of one-handed operation by a user.

As shown in FIGS. 1B and 1C, the internal volume of the mass spectrometers disclosed herein includes the internal volumes of ion source 102, ion trap 104, and detector 118, and regions between these components. More generally, the internal volume of the mass spectrometers disclosed herein corresponds to the volume of gas path 128—that is, the volumes of all of the connected spaces within mass spectrometer 100 where gas particles and ions can circulate. In some embodiments, the internal volume of mass spectrometer 100 is 10 $cm^3$ or less (e.g., 7.0 $cm^3$ or less, 5.0 $cm^3$ or less, 4.0 $cm^3$ or less, 3.0 $cm^3$ or less, 2.5 $cm^3$ or less, 2.0 $cm^3$ or less, 1.5 $cm^3$ or less, 1.0 $cm^3$ or less).

Figure 1D:
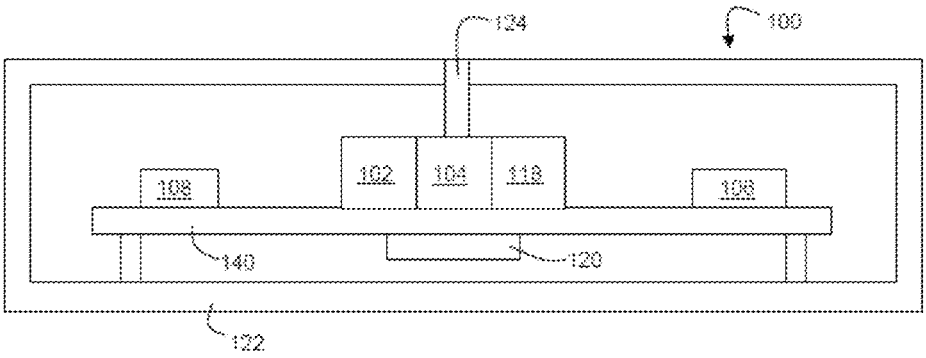
FIG. 1D is a schematic diagram of a mass spectrometer with components mounted to a support base.

In some embodiments, the mass spectrometers disclosed herein are fully integrated on a single support base. FIG. 1D is a schematic diagram of an embodiment of mass spectrometer 100 in which all of the components of spectrometer 100 are integrated onto a single support base 140. As shown in FIG. 1D, ion source 102, ion trap 104, detector 118, controller 108, and voltage source 106 are each mounted to, and electrically connected to, support base 140. Support base 140 can be, for example, a printed circuit board, and can include control lines that extend between the components of spectrometer 100. Thus, for example, voltage source 106 provides electrical power to ion source 102, ion trap 104, detector 118, controller 108, and pressure regulation subsystem 120 through control lines (e.g., control lines 126*a-e*) integrated into support base 140. Further, ion source 102, ion trap 104, detector 118, pressure regulation subsystem 120, and voltage source 106 are each connected to controller 108 through control lines (e.g., control lines 127*a-e*) integrated into support base 140, so that controller 108 can send and receive electrical signals to each of these components through support base 140.

Integration on a single support base such as a printed circuit board provides a number of important advantages. Support base 140 provides a stable platform for the components of spectrometer 100, ensuring that each of the components is mounted stably and securely, and reducing the likelihood that components will be damaged during rough handling of spectrometer 100. In addition, mounting all components on a single support base simplifies manufacturing of spectrometer 100, as support base 140 provides a reproducible template for the positioning and connection of the various components to one another. Further, by integrating all of the control lines onto the support base, such that both electrical power and control signals are transmitted between components through support base 140, the integrity of the electrical connections between components can be maintained—such connections are less susceptible to wear and/or breakage than connections formed by individual wires extending between components.

Further, by integrating the components of spectrometer 100 onto a single support base, spectrometer 100 has a compact form factor. In particular, a maximum dimension of support base 140 (e.g., a largest linear distance between any two points on support base 140) can be 25 cm or less (e.g., 20 cm or less, 15 cm or less, 10 cm or less, 8 cm or less, 7 cm or less, 6 cm or less).

As shown in FIG. 1D, support base 140 is mounted to housing 122 using mounting pins 145. In some embodiments, mounting pins 145 are designed to insulate support base 140 (and the components mounted to support base 140) from mechanical shocks. For example, mounting pins 145 can include shock absorbing materials (e.g., compliant materials such as soft rubber) to insulate support base 140 against mechanical shocks. As another example, grommets or spacers formed from shock absorbing materials can be positioned between support base 140 and housing 122 to insulate support base 140 against mechanical shocks.

Figure 1E:
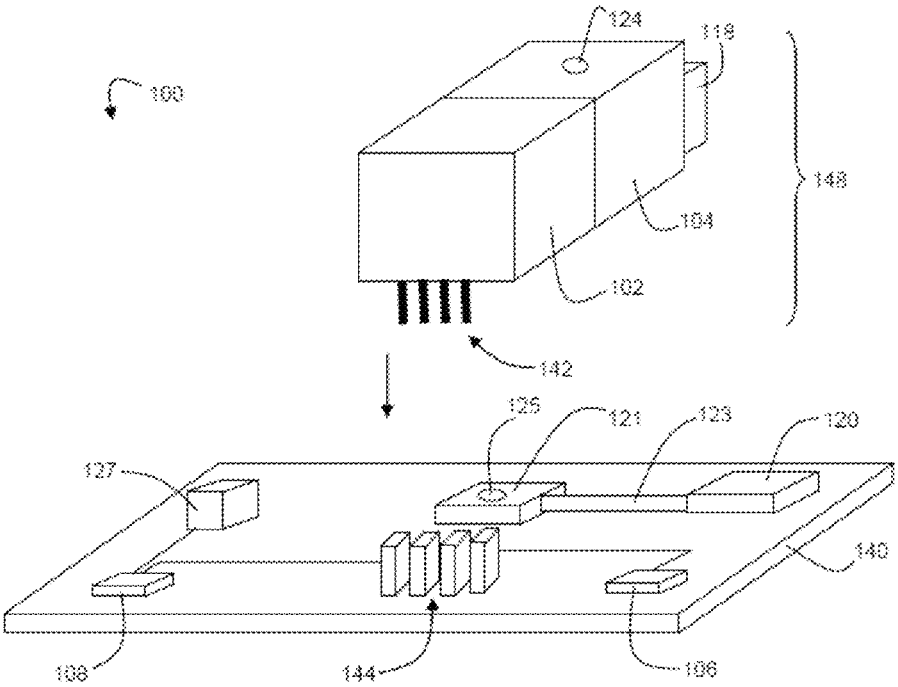
FIG. 1E is a schematic diagram of a mass spectrometer with a pluggable module.

In some embodiments, the mass spectrometers disclosed herein include a pluggable, replaceable module in which multiple system components are integrated. FIG. 1E is a schematic diagram of an embodiment of mass spectrometer 100 that includes a pluggable, replaceable module 148 and a support base 140 configured to receive module 148. Ion source 102, ion trap 104, detector 118, and sample inlet 124 are each integrated into module 148.

Module 148 also includes a plurality of electrodes 142 that extend outward from the module. Within module 148, electrodes 142 are connected to each of the components within the module, e.g., to ion source 102, ion trap 104, and detector 118.

Also shown in FIG. 1E is a support base 140 (e.g., a printed circuit board) on which controller 108, voltage source 106, and pressure regulation subsystem 120 are mounted. Support base 140 includes a plurality of electrodes 144 that are configured to releasably engage and disengage electrodes 142 of module 148. In some embodiments, for example, electrodes 142 are pins, and electrodes 144 are sockets configured to receive electrodes 142. Alternatively, electrodes 144 can be pins, and electrodes 142 can be sockets configured to receive the pins. Module 148 can be connected to support base 140 by applying a force in the direction shown by the arrow in FIG. 1E with electrodes 142 of module 148 aligned with corresponding electrodes 144 of support base, so that module 148 can be releasably connected to, or disconnected from, support base 140. Module 148 can be disengaged from support base 140 by applying a force in a direction opposite to the arrow.

Electrodes 144 of support base 140 are connected to controller 108 and voltage source 106, as shown in FIG. 1E. When a connection is established between electrodes 142 and electrodes 144, controller 108 can send and receive signals to/from each of the components integrated within module 148, as discussed above in connection with control lines 127. Further, voltage source 106 can provide electrical power to each of the components integrated within module 148, as discussed above in connection with control lines 126

Pressure regulation subsystem 120, which is mounted to support base 140, is connected to a manifold 121 via conduit 123 Manifold 121, which includes one or more apertures 125, is positioned on support base 140 so that when module 148 is connected to support base 140, a sealed fluid connection is established between manifold 121 and module 148. In particular, a fluid connection is established between apertures 125 in manifold 121 and corresponding apertures in module 148 (not shown in FIG. 1E). The apertures in module 148 can be formed in the walls of ion source 102, ion trap 104, and/or detector 118. When the sealed fluid connection is established, pressure regulation subsystem 120 can control gas pressure within the components of module 148 by pumping gas particles out of the module through manifold 121.

Other configurations of module 148 are also possible. In some embodiments, for example, detector 118 is not part of module 148, and is instead mounted to support base 140. In such a configuration, detector 118 is positioned on support base 140 so that when module 148 is connected to support base 140, a sealed fluid connection is established between ion trap 104 and detector 118. Establishing a sealed fluid connection allows circulating ions within ion trap 104 to be ejected from the trap and detected using detector 118, and also allows pressure regulation subsystem 120 to maintain reduced gas pressure (e.g., between 100 mTorr and 100 Torr) in detector 118.

In certain embodiments, pressure regulation subsystem 120 can be integrated into module 148. For example, pressure regulation subsystem 120 can be attached to the underside of ion trap 104 and connected directly to gas path 128 within module 148. Pressure regulation subsystem 120 is also electrically connected to electrodes 142 of module 148. When module 148 is connected to support base 140, pressure regulation subsystem 120 can transmit and receive electrical signals to/from controller 108 and voltage source 106 through electrodes 142.

The modular configuration of mass spectrometer 100 shown in FIG. 1E provides a number of advantages. For example, during operation of mass spectrometer 100, certain components can become contaminated with analyte residues. For example, analyte residues can adhere to the walls of the ion trap 104, reducing the efficiency with which ion trap 104 can separate ions, and contaminating analyses of other substances. By integrating ion trap 104 within module 148, the entire module 148 can be replaced easily and rapidly if ion trap 104 is contaminated, ensuring that mass spectrometer 100 can quickly be returned to operational status in the field even by an untrained user. Similarly, if either ion source 102 or detector 118 becomes contaminated or undergoes failure, module 148 can easily be replaced by a user of spectrometer 100 to return spectrometer 100 to operation.

The modular configuration shown in FIG. 1E also ensures that spectrometer 100 remains compact and portable. In some embodiments, for example, a maximum dimension of module 148 (e.g., a maximum linear distance between any two points on module 148) is 10 cm or less (e.g., 9 cm or less, 8 cm or less, 7 cm or less, 6 cm or less, 5 cm or less, 4 cm or less, 3 cm or less, 2 cm or less, 1 cm or less).

A module 148 with reduced functionality (e.g., a module that has become contaminated with analyte particles that adhere to interior walls of ion source 102, ion trap 104, and/or detector 118) can be regenerated and returned to use. In some embodiments, to return a module 148 to normal operation, the module can be heated while it is installed within spectrometer 100. Heating can be accomplished using a heating element 127 mounted on support base 140. As shown in FIG. 1E, heating element 127 is positioned on support base 140 so that when module 148 is connected to support base 140, heating element 127 contacts one or more of the components of module 148 (e.g., ion source 102, ion trap 104, and detector 118).

Controller 108 can be configured to activate heating element 127 by directing voltage source 106 to apply suitable electrical potentials to heating element 127. Commencement of heating, and the temperature and duration of heating, can be controlled by a user of spectrometer 100, e.g., by activating a control on display 116 and/or by entering user configuration settings into storage unit 114. In certain embodiments, controller 108 can be configured to determine automatically when regeneration of module 148 is appropriate. For example, controller 108 can monitor detected ion currents over a period of time, and if the ion current falls by more than a threshold amount (e.g., 25% or more, 50% or more, 60% or more, 70% or more) within a particular time period (e.g., 1 hour or more, 5 hours or more, 10 hours or more, 24 hours or more, 2 days or more, 5 days or more, 10 days or more), then controller 108 determines that regeneration of module 148 is needed.

Although heating element 127 is mounted on support base 140 in FIG. 1E, other configurations are also possible. In some embodiments, for example, heating element 147 is part of module 148, and can be attached so that it directly contacts some or all of the components of module 148 (e.g., ion source 102, ion trap 104, and detector 118).

In certain embodiments, module 148 can be removed from spectrometer 100 for regeneration. For example, when module 148 exhibits reduced functionality (e.g., as determined by a user of spectrometer 100, or as determined automatically by controller 108 using the above criteria), module 148 can be removed from spectrometer 100 and heated to restore it to normal operating condition. Heating can be accomplished in a variety of ways, including heating in general purpose ovens. In some embodiments, spectrometer 100 can include a dedicated plug-in heater that includes a slot configured to receive module 148. When a module is inserted into the slot and the heater is activated, the module is heated to restore its functionality.

While ion source 102, ion trap 104, and detector 118 are generally configured to detect and identify a wide variety of chemical substances, in certain embodiments these components can be specifically tailored for detection of certain classes of substances. In some embodiments, ion source 102 can be specifically configured for use with certain substances. For example, different electrical potentials can be applied to the electrodes of ion source 102 to generate either positive or negative ions from gas particles. Further, the magnitudes of the electrical potentials applied to the electrodes of ion source 102 can be varied to control the efficiency with which certain substances ionize. In general, different substances have different affinities for ionization depending upon their chemical structure. By adjusting the polarity and the electrical potential difference between electrodes of ion source 102, ionization of a variety of substances can be carefully controlled.

In certain embodiments, ion trap 104 can be specifically configured for use with certain substances. For example, the internal dimensions (e.g., the internal diameter) of ion trap 104 can be selected to favor trapping and detection of ions with higher mass-to-charge ratio.

In some embodiments, internal gas pressures within one or more of ion source 102, ion trap 104, and detector 118 can be selected to favor softer or harder ionization mechanisms, or positive or negative ion generation. Further, the magnitudes and polarities of the electrical potentials applied to the electrodes of ion source 102 and ion trap 104 can be selected to favor certain ionization mechanisms. As discussed above, different substances have different affinities for ionization, and may ionize more efficiently in one manner (e.g., according to one mechanism) than another. By adjusting the gas pressures and electrical potentials applied to various electrodes within spectrometer 100, the spectrometer can be adapted to specifically detect a wide variety of substances and classes of substances. In addition, by adjusting the geometry of ion trap 104 and/or the electrical potentials applied to its electrodes, the mass window of ion trap 104 (e.g., the range of ion mass-to-charge ratios that can be maintained in circulating orbit within ion trap 104) can be selected.

In certain embodiments, ion source 102 can include a particular type of ionizer tailored for certain types of substances. For examples, ionization sources based on glow discharge ionization, electrospray mass ionization, capacitive discharge ionization, dielectric barrier discharge ionization, and any of the other ionizer types disclosed herein can be used in ion source 102.

In some embodiments, detector 118 can be specifically tailored for certain types of detection tasks. For example, detector 118 can any one or more of the detectors disclosed herein. The detectors can be arranged in specific configurations, e.g., in array form, with a plurality of detection elements such as a plurality of Faraday cup detectors, as will be discussed subsequently, and/or in any arrangement within detector 118. In addition to being tailored for detection of certain substances, detector 118 can also be tailored for use with certain types of ion sources and ion traps. For example, the arrangement and types of detection elements within detector 118 can be selected to correspond to the arrangement of ion chambers within ion trap 104, particularly where ion trap 104 includes multiple ion chambers.

In certain embodiments, one or more internal surfaces of module 148 (e.g., of ion source 102 and/or ion trap 104 and/or detector 118) can include one or more coatings and/or surface treatments. The coatings and/or surface treatments can be adapted for specific applications, including detection of specific types of substances, operation within specific gas pressure ranges, and/or operation at certain applied electrical potentials. Examples of coatings and surface treatments that can be used to tailor module 148 for specific substances and/or applications include Teflon® (more generally, fluorinated polymer coatings), anodized surfaces, nickel, and chrome.

Other components of module 148 can also be adapted to detect specific substances or classes of substances. For example, sample inlet 124 can be equipped with a filter that is configured to selectively allow only certain classes of substances to pass into spectrometer 100, or similarly, delay the passage of certain materials into the spectrometer compared to the passage of others. In some embodiments, for example, the filter can include a HEPA filter (or a similar type of filter) that removes solid, micron-sized particles such as dust particles from the flow of gas particles that enters sample inlet 124. In certain embodiments, the filter can include a molecular sieve-based filter that removes water vapor from the flow of gas particles that enters sample inlet 124. Both of these types of filters do not filter atmospheric gas particles (e.g., nitrogen molecules and oxygen molecules), and instead allow atmospheric gas particles to pass through and enter gas path 128 of spectrometer 100. Where this disclosure refers to a filter that does not remove or filter atmospheric gas particles, it is to be understood that the filter allows at least 95% or more of the atmospheric gas particles that encounter the filter to pass through.

Accordingly, in some embodiments, mass spectrometer 100 can include multiple replaceable modules 148. Some of the modules can be the same, and can function as direct replacements for one another (e.g., in the event of contamination). Other modules can be configured for different modes of operation. For example, the multiple replaceable modules 148 can be configured to detect different classes of substances. A user operating spectrometer 100 can select a suitable module for a particular class of substances, and can plug in the selected module to support base 140 prior to initiating an analysis. To analyze a different class of substances, the user can disengage the first module from support base 140, select a new module, and plug in the new module to support base 140. As a result, re-configuring the components of mass spectrometer 100 for a variety of different applications is rapid and straightforward. Modules can also be specifically configured to different types of measurements (e.g., using different ionization methods, different trapping and/or ejection potentials applied to the electrodes of ion trap 104, and/or different detection methods). In general, each of the multiple replaceable modules 148 can include any of the features disclosed herein. Thus, some of the modules can differ based on their ion sources, some of the modules can differ based on their ion traps, and some of the modules can differ based on their detectors. Certain modules may differ from one another based on more than one of these components.

In the following sections, the various components of mass spectrometer 100 will be discussed in greater detail, and various operating modes of spectrometer 100 will also be discussed. Additional features and aspects of the mass spectrometry systems and methods disclosed herein can be found, for example, in U.S. Pat. Nos. 8,525,111 and 8,921,774, the entire contents of each of which are incorporated herein by reference.

II. Ion Source

In general, ion source 102 is configured to generate electrons and/or ions. Where ion source 102 generates ions directly from gas particles that are to be analyzed, the ions are then transported from ion source 102 to ion trap 104 by suitable electrical potentials applied to the electrodes of ion source 102 and ion trap 104. Depending upon the magnitude and polarity of the potentials applied to the electrodes of ion source 102 and the chemical structure of the gas particles to be analyzed, the ions generated by ion source 102 can be positive or negative ions. In some embodiments, electrons and/or ions generated by ion source 102 can collide with neutral gas particles to be analyzed to generate ions from the gas particles. During operation of ion source 102, a variety of ionization mechanisms can occur at the same time within ion source 102, depending upon the chemical structure of the gas particles to be analyzed and the operating parameters of ion source 102.

By operating at higher internal gas pressures than conventional mass spectrometers, the compact mass spectrometers disclosed herein can use a variety of ion sources. In particular, ion sources that are small and that require relatively modest amounts of electrical power to operate can be used in spectrometer 100. In some embodiments, for example, ion source 102 can be a glow discharge ionization (GDI) source. In certain embodiments, ion source 102 can be a capacitive discharge ion source.

A variety of other types of ion sources can also be used in spectrometer 100, depending upon the amount of power required for operation and their size. For example, other ion sources suitable for use in spectrometer 100 include dielectric barrier discharge ion sources and thermionic emission sources. As a further example, ion sources based on electrospray ionization (ESI) can be used in spectrometer 100. Such sources can include, but are not limited to, sources that employ desorption electrospray ionization (DESI), secondary ion electrospray ionization (SESI), extractive electrospray ionization (EESI), and paper spray ionization (PSI). As yet another example, ion sources based on laser desorption ionization (LDI) can be used in spectrometer 100. Such sources can include, but are not limited to, sources that employ electrospray-assisted laser desorption ionization (ELDI), and matrix-assisted laser desorption ionization (MALDI). Still further, ion sources based on techniques such as atmospheric solid analysis probe (ASAP), desorption atmospheric pressure chemical ionization (DAPCI), desorption atmospheric pressure photoionization (DAPPI), and sonic spray ionization (SSI) can be used in spectrometer 100. Ion sources based on arrays of nanofibers (e.g., arrays of carbon nanofibers) are also suitable for use. Other aspects and features of the foregoing ion sources, and other examples of ion sources suitable for use in spectrometer 100, are disclosed, for example, in the following publications, the entire contents of each of which is incorporated by reference herein: Alberici et al., "Ambient mass spectrometry: bringing MS into the 'real world,'" *Anal. Bioanal. Chem.* 398: 265-294 (2010); Harris et al. "Ambient Sampling/Ion Mass Spectrometry: Applications and Current Trends," *Anal. Chem.* 83: 4508-4538 (2011); and Chen et al., "A Micro Ionizer for Portable Mass Spectrometers using Double-gated Isolated Vertically Aligned Carbon Nanofiber Arrays," *IEEE Trans. Electron Devices* 58(7): 2149-2158 (2011).

GDI sources are particularly advantageous for use in spectrometer 100 because they are compact and well suited for low power operation. The glow discharge that occurs when these sources are active occurs only when gas pressures are sufficient, however. Typically, for example, GDI sources are limited in operation to gas pressures of approximately 200 mTorr and above. At pressures lower than 200 mTorr, sustaining a stable glow discharge can be difficult. As a result, GDI sources are not used in conventional mass spectrometers, which operate at pressures of 1 mTorr or less. However, because the mass spectrometers disclosed herein typically operate at gas pressures of between 100 mTorr and 100 Torr, GDI sources can be used.

Figure 2:
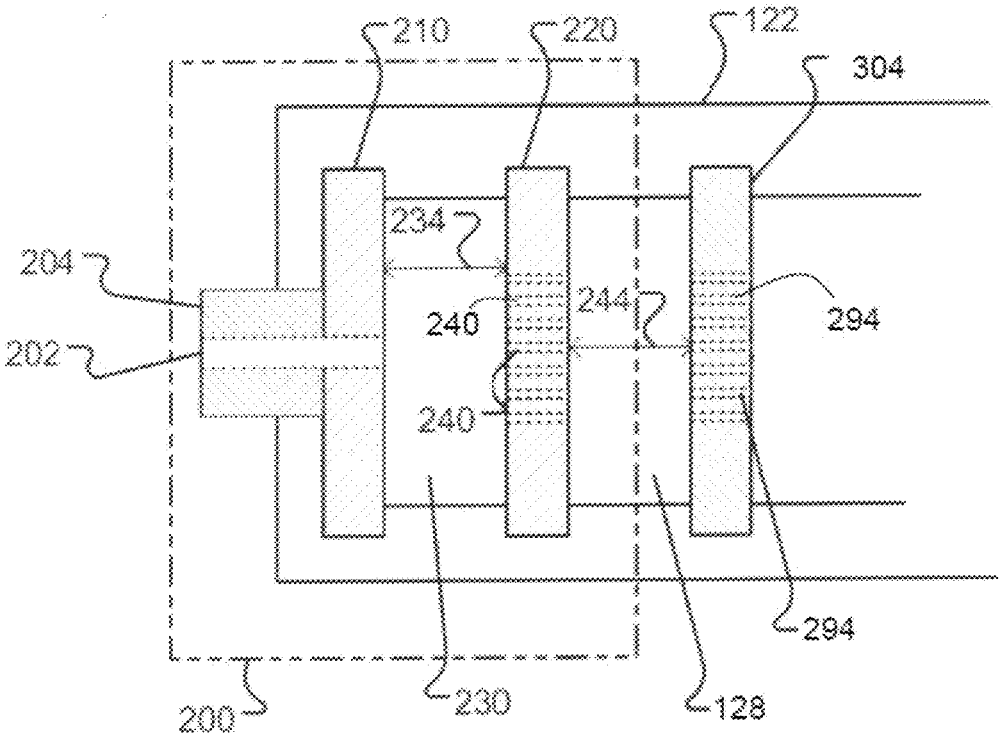
FIG. 2 is a schematic diagram of an ion source.

FIG. 2 shows an example of a GDI source 200 that includes a front electrode 210 and a back electrode 220. The two electrodes 210 and 220, along with the housing 122, form the GDI chamber 230. In some embodiments, GDI source 200 can also include a housing (not shown in FIG. 2) that encloses the electrodes of the source.

As shown in FIG. 2, front electrode 210 has an aperture 202 in which gas particles to be analyzed enter GDI chamber 230. As used herein, the term "gas particles" refers to atoms, molecules, or aggregated molecules of a gas that exist as separate entities in the gaseous state. For example, if the substance to be analyzed is an organic compound, then the gas particles of the substance are individual molecules of the substance in the gas phase.

Aperture 202 is surrounded by an insulating tube 204. In FIG. 2, aperture 202 is connected to sample inlet 124 (not shown), so that gas particles to be analyzed are drawn into GDI chamber 230 due to the pressure difference between the atmosphere external to spectrometer 100 and GDI chamber 230. In addition to gas particles to be analyzed, atmospheric gas particles are also drawn into GDI chamber 230 due to the pressure difference. As used herein, the term "atmospheric gas particles" refers to atoms or molecules of gases in air, such as molecules of oxygen gas and nitrogen gas.

In some embodiments, additional gas particles can be introduced into GDI source 200 to assist in the generation of electrons and/or ions in the source. For example, as explained above in connection with FIG. 1A, spectrometer 100 can include a buffer gas source 150 connected to gas path 128. Buffer gas particles from buffer gas source 150 can be introduced directly into GDI source 200, or can be introduced into another portion of gas path 128 and diffuse into GDI source 200. The buffer gas particles can include nitrogen molecules, and/or noble gas atoms (e.g., He, Ne, Ar, Kr, Xe). Some of the buffer gas particles can be ionized by electrodes 210 and 220.

Alternatively, in some embodiments, a mixture of gas particles that includes the gas particles to be analyzed and atmospheric gas particles are the only gas particles that are introduced into GDI chamber 230. In such embodiments, only the gas particles to be analyzed may be ionized in GDI chamber 230. In certain embodiments, both the gas particles to be analyzed and admitted atmospheric gas particles may be ionized in GDI chamber 230.

Although aperture 202 is positioned in the center of the front electrode 210 in FIG. 2, more generally aperture 202 can be positioned at a variety of locations in GDI source 200. For example, aperture 202 can be positioned in a sidewall of GDI chamber 230, where it is connected to sample inlet 124. Further, as has been described previously, in some embodiments sample inlet 124 can be positioned so that gas particles to be analyzed are drawn directly into another one of the components of spectrometer 100, such as ion trap 104 or detector 118. When the gas particles are drawn into a component other than ion source 102, the gas particles diffuse through gas path 128 and into ion source 102. Alternatively, or in addition, when the gas particles to be analyzed are drawn directly into a component such as ion trap 104, ion source 102 can generate ions and/or electrons which then collide with the gas particles to be analyzed within ion trap 104, generating ions from the gas particles directly inside the ion trap.

Thus, depending upon where the gas particles to be analyzed are introduced intro spectrometer 100 (e.g., the position of sample inlet 124), ions can be generated from the gas particles at a variety of different locations. Ion generation can occur directly in ion source 102, and the generated ions can be transported into ion trap 104 by applying suitable electrical potentials to the electrodes of ion source 102 and ion trap 104. Ion generation can also occur within ion trap 104, when charged particles such as ions (e.g., buffer gas ions) and electrons generated by ion source 102 enter ion trap 104 and collide with gas particles to be analyzed. Ion generation can occur in multiple places at once (e.g., in both ion source 102 and ion trap 104), with all of the generated ions eventually becoming trapped within ion trap 104. Although the discussion in this section focuses largely on direct generation of ions from gas particles of interest within ion source 102, the aspects and features disclosed herein are also applicable generally to the secondary generation of ions from gas particles of interest in other components of spectrometer 100.

A variety of different spacings between electrodes 210 and 220 can be used. In general, the efficiency with which ions are generated is determined by a number of factors, including the potential difference between electrodes 210 and 220, the gas pressure within GDI source 200, the distance 234 between electrodes 210 and 220, and the chemical structure of the gas particles that are ionized. Typically, distance 234 is relatively small to ensure that GDI source 200 remains compact. In some embodiments, for example, distance 234 between electrodes 210 and 220 is be 1.5 cm or less (e.g., 1 cm or less, 0.75 cm or less, 0.5 cm or less, 0.25 cm or less, 0.1 cm or less).

The gas pressure in GDI chamber 230 is generally regulated by pressure regulation subsystem 120. In some embodiments, the gas pressure in GDI chamber 230 is approximately the same as the gas pressure in ion trap 104 and/or detector 118. In certain embodiments, the gas pressure in GDI chamber 230 differs from the gas pressure in ion trap 104 and/or detector 118. Typically, the gas pressure in GDI chamber 230 is 100 Torr or less (e.g., 50 Torr or less, 20 Torr or less, 10 Torr or less, 5 Torr or less, 1 Torr or less, 0.5 Torr or less) and/or 100 mTorr or more (e.g., 200 mTorr or more, 300 mTorr or more, 500 mTorr or more, 1 Torr or more, 10 Torr or more, 20 Torr or more).

During operation, GDI source 200 generates a self-sustaining glow discharge (or plasma) when a voltage difference is applied between front electrode 210 and back electrode 220 by voltage source 106 under the control of controller 108. In some embodiments, the voltage difference can be 200V or higher (e.g., 300V or higher, 400V or higher, 500V or higher, 600V or higher, 700V or higher, 800V or higher) to sustain the glow discharge. As discussed above, detector 118 detects the ions generated by GDI source 200, and the potential difference between electrodes 210 and 220 can be adjusted by controller 108 to control the rate at which ions are generated by GDI source 200.

In some embodiments, GDI source 200 is directly mounted to support base 140, and electrodes 210 and 220 are directly connected to voltage source 106 through support base 140, as shown in FIG. 1D. In certain embodiments, GDI source 200 forms a part of module 148, and electrodes 210 and 220 are connected to electrodes 142 of module 148, as shown in FIG. 1E. When module 148 is plugged into support base 140, electrodes 210 and 220 are connected to voltage source 106 through electrodes 144 that engage electrodes 142.

By applying electrical potentials of differing polarity relative to the ground potential established by voltage source 106. GDI source 200 can be configured to operate in different ionization modes. For example, during typical operation of GDI source 200, a small fraction of gas particles is initially ionized in GDI chamber 230 due to random processes (e.g., thermal collisions). In some embodiments, electrical potentials are applied to front electrode 210 and back electrode 220 such that front electrode 210 serves as the cathode and back electrode 220 serves as the anode. In this configuration, positive ions generated in GDI chamber 230 are driven towards the front electrode 210 due to the electric field within the chamber. Negative ions and electrons are driven towards the back electrode 220. The electrons and ions can collide with other gas particles, generating a larger population of ions. Negative ions and/or electrons exit GDI chamber 230 through the back electrode 220.

In certain embodiments, suitable electrical potentials are applied to front electrode 210 and back electrode 220 so that front electrode 210 serves as the anode and back electrode 220 serves as the cathode. In this configuration, positively charged ions generated in GDI chamber 230 leave the chamber through back electrode 220. The positively charged ions can collide with other gas particles, generating a larger population of ions.

After ions are generated and leave GDI chamber 230 through back electrode 220 in either operating mode, the ions enter ion trap 104 through end cap electrode 304. In general, back electrode 220 can include one or more apertures 240. The number of apertures 240 and their cross-sectional shapes are generally chosen to create a relatively uniform spatial distribution of ions incident on end cap electrode 304. As the ions generated in GDI chamber 230 leave the chamber through the one or more apertures 240 in back electrode 220, the ions spread out spatially from one another due to collisions and space-charge interactions. As a result, the overall spatial distribution of ions leaving GDI source 200 diverges. By selecting a suitable number of apertures 240 having particular cross-sectional shapes, the spatial distribution of ions leaving GDI source 200 can be controlled so that the distribution overlaps or fills all of the apertures 292 formed in end cap electrode 304. In some embodiments, an additional ion optical element (e.g., an ion lens) can be positioned between back electrode 220 and end cap electrode 304 to further manipulate the spatial distribution of ions emerging from GDI source 200. However, a particular advantage of the compact ion sources disclosed herein is that suitable ion distributions can be obtained without any additional elements between back electrode 220 and end cap electrode 304.

End cap electrode 304 of ion trap 104 can also include one or more apertures 294. In some embodiments, end cap electrode 304 includes a single aperture 294 with a cross-sectional shape that is circular, square, rectangular, or in the shape of another n-sided polygon. In certain embodiments, the aperture has an irregular cross-sectional shape. More generally, end cap electrode 304 can include multiple apertures 294, with properties similar to those discussed above.

In some embodiments, back electrode 220 and end cap electrode 304 can be formed as a single element, and ions formed in GDI chamber 230 can directly enter the ion trap 104 by passing through the element. In such embodiments, the combined back and end cap electrode can include a single aperture or multiple apertures, as described above.

Further, in certain embodiments, the end cap electrodes of ion trap 104 can function as the front electrode 210 and the back electrode 220 of GDI source 200. As will be discussed in more detail subsequently, ion trap 104 includes two end cap electrodes 304 and 306 positioned on opposite sides of the trap. By applying suitable potentials (e.g., as described above with reference to front electrode 210 and back electrode 220) to these electrodes, end cap electrode 304 can function as front electrode 210, and end cap electrode 306 can function as back electrode 220. Accordingly, in these embodiments, ion trap 104 also functions as a glow discharge ion source 102.

A variety of materials can be used to form the electrodes in ion source 102, including electrodes 210 and 220 in GDI source 200. In certain embodiments, the electrodes of ion source 102 can be made from materials such as copper, aluminum, silver, nickel, gold, and/or stainless steel. In general, materials that are less prone to adsorption of sticky particles are advantageous, as the electrodes formed from such materials typically require less frequent cleaning or replacement.

The foregoing discussion has focused on the use of GDI source 200 in spectrometer 100. However, the features, design criteria, algorithms, and aspects described above are equally applicable to other types of ion sources that can be used in spectrometer 100, such as capacitive discharge sources and thermionic emitter sources. In particular, capacitive discharge sources are well suited for use at the relatively high gas pressures at which spectrometer 100 operates. Additional aspects and features of capacitive discharge sources are disclosed, for example, in U.S. Pat. No. 7,274,015, the entire contents of which are incorporated herein by reference.

Due to the use of compact, closely spaced electrodes, the overall size of ion source 102 can be small. The maximum dimension of ion source 102 refers to the maximum linear distance between any two points on the ion source. In some embodiments, the maximum dimension of ion source 102 is 8.0 cm or less (e.g., 6.0 cm or less, 5.0 cm or less, 4.0 cm or less, 3.0 cm or less, 2.0 cm or less, 1.0 cm or less).

III. Ion Trap

As explained above in Section I, ions generated by ion source 102 are trapped within ion trap 104, where they circulate under the influence of electrical fields created by applying electrical potentials to the electrodes of ion trap 104. The potentials are applied to the electrodes of ion trap 104 by voltage source 106, after receiving control signals from controller 108. To eject the circulating ions from ion trap 104 for detection, controller 108 transmits control signals to voltage source 106 which cause voltage source 106 to modulate the amplitude of a radiofrequency (RF) field within ion trap 104. Modulation of the amplitude of the RF field causes the circulating ions within ion trap 104 to fall out of orbit and exit ion trap 104, entering detector 118 where they are detected.

To ensure that mass spectrometer 100 is both compact and consumes a relatively small amount of electrical power during operation, mass spectrometer 100 uses only a single, small mechanical pump in pressure regulation subsystem 120 to regulate its internal gas pressure. As a result, mass spectrometer 100 operates at internal gas pressures that are higher than internal pressures in conventional mass spectrometers. To ensure that gas particles drawn in to spectrometer 100 are quickly ionized and analyzed, the internal volume of mass spectrometer 100 is considerably smaller than the internal volume of conventional mass spectrometers. By reducing the internal volume of spectrometer 100, pressure regulation subsystem 120 is capable of drawing gas particles quickly into spectrometer 100. Further, by ensuring quick ionization and analysis, a user of spectrometer 100 can rapidly obtain information about a particular substance. A smaller internal volume of spectrometer 100 has the added advantage of a smaller internal surface area that is susceptible to contamination during operation. Conventional mass spectrometers use a variety of different mass analyzers, many of which have large internal volumes that are maintained at low pressure during operation, and/or consume large amounts of power during operation. For example, certain mass spectrometers use linear quadrupole mass filters, which have large internal volumes due to their extension in the axial direction, which enables mass filtering and large charge storage capacities. Some conventional mass spectrometers use magnetic sector mass filters, which are also typically large and may consume large amounts of power to generate mass-filtering magnetic fields. Conventional mass spectrometers can also use hyperbolic ion traps, which can have large internal volumes, and can also be difficult to manufacture.

Figure 3A:
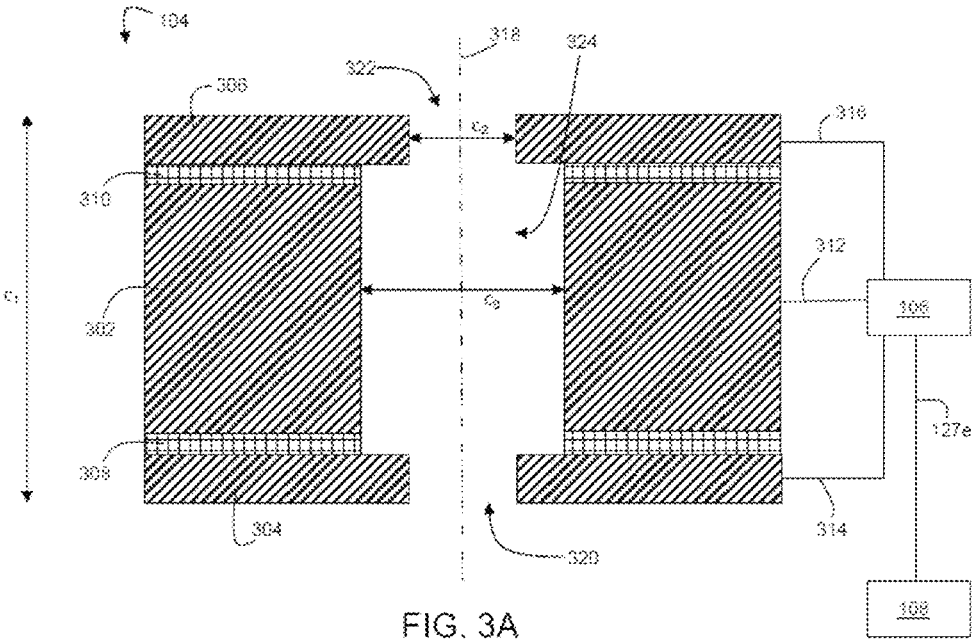
FIG. 3A is a cross-sectional diagram of an embodiment of an ion trap.

In contrast to the foregoing conventional ion trap technologies, the mass spectrometers disclosed herein use compact, cylindrical ion traps for trapping and analyzing ions. FIG. 3A is a cross-sectional diagram of an embodiment of ion trap 104. Ion trap 304 includes a cylindrical central electrode 302, two end cap electrodes 304 and 306, and two insulating spacers 308 and 310. Electrodes 302, 304, and 306 are connected to voltage source 106 via control lines 312, 314, and 316, respectively. Voltage source 106 is connected to controller 108 via control line 127*e*, controller 108 transmits signals to voltage source 106 via control line 127*e*, directing voltage source 106 to apply electrical potentials to the electrodes of ion trap 104.

During operation, ions generated by ion source 102 enter ion trap 104 through aperture 320 in electrode 304. Voltage source 106 applies potentials to electrodes 304 and 306 to create an axial field (e.g., symmetric about axis 318) within ion trap 104. The axial field confines the ions axially between electrodes 304 and 306, ensuring that the ions do not leave ion trap through aperture 320, or through aperture 322 in electrode 306. Voltage source 106 also applies an electrical potential to central electrode 302 to generate a radial confinement field within ion trap 104. The radial field confines the ions radially within the internal aperture of electrode 302.

With both axial and radial fields present within ion trap 104, the ions circulate within the trap. The orbital geometry of each ion is determined by a number of factors, including the geometry of electrodes 302, 304, and 306, the magnitudes and signs of the potentials applied to the electrodes, and the mass-to-charge ratio of the ion. By changing the amplitude of the electrical potential applied to central electrode 302, ions of specific mass-to-charge ratios will fall out of orbit within trap 104 and exit the trap through electrode 306, entering detector 118. Therefore, to selectively analyze ions of different mass-to-charge ratios, voltage source 106 (under the control of controller 108) changes the amplitude of the electrical potential applied to electrode 302 in stepwise fashion. As the amplitude of the applied potential changes, ions of different mass-to-charge ratio are ejected from ion trap 104 and detected by detector 118.

Electrodes 302, 304, and 306 in ion trap 104 are generally formed of a conductive material such as stainless steel, aluminum, or other metals. Spacers 308 and 310 are generally formed of insulating materials such as ceramics, Teflon® (e.g., fluorinated polymer materials), rubber, or a variety of plastic materials.

The central openings in end-cap electrodes 304 and 306, in central electrode 302, and in spacers 308 and 310 can have the same diameter and/or shape, or different diameters and/or shapes. For example, in the embodiment shown in FIG. 3A, the central openings in electrode 302 and spacers 308 and 310 have a circular cross-sectional shape and a diameter $c_0$, and end-cap electrodes 304 and 306 have central openings with a circular cross-sectional shape and a diameter $c_2<c_0$. As shown in FIG. 3A, the openings in the electrodes and spacers are axially aligned along axis 318 so that when the electrodes and spacers are assembled into a sandwich structure, the openings in the electrodes and spacers form a continuous axial opening that extends through ion trap 104.

In general, the diameter $c_0$ of the central opening in electrode 302 can be selected as desired to achieve a particular target resolving power when selectively ejecting ions from ion trap 104, and also to control the total internal volume of spectrometer 100. In some embodiments, $c_0$ is approximately 0.6 mm or more (e.g., 0.8 mm or more, 1.0 mm or more, 1.2 mm or more, 1.4 mm or more, 1.6 mm or more, 1.8 mm or more). The diameter $c_2$ of the central opening in end-cap electrodes 304 and 306 can also be selected as desired to achieve a particular target resolving power when ejecting ions from ion trap 104, and to ensure adequate confinement of ions that are not being ejected. In certain embodiments, $c_2$ is approximately 0.25 mm or more (e.g., 0.35 mm or more, 0.45 mm or more, 0.55 mm or more, 0.65 mm or more, 0.75 mm or more).

The axial length $c_1$ of the combined openings in electrode 302 and spacers 308 and 310 can also be selected as desired to ensure adequate ion confinement and to achieve a particular target resolving power when ejecting ions from ion trap 104. In some embodiments, $c_1$ is approximately 0.6 mm or more (e.g., 0.8 mm or more, 1.0 mm or more, 1.2 mm or more, 1.4 mm or more, 1.6 mm or more, 1.8 mm or more).

It has been determined experimentally that the resolving power of spectrometer 100 is greater when $c_0$ and $c_1$ are selected such that $c_1/c_0$ is greater than 0.83. Therefore, in certain embodiments, $c_0$ and $c_1$ are selected so that the value of $c_1/c_0$ is 0.8 or more (e.g., 0.9 or more, 1.0 or more, 1.1 or more, 1.2 or more, 1.4 or more, 1.6 or more).

Due to the relatively small size of ion trap 104, the number of ions that can simultaneously be trapped in ion trap 104 is limited by a variety of factors. One such factor is space-charge interactions among the ions. As the density of trapped ions increases, the average spacing between the trapped, circulating ions decreases. As the ions (which all have either positive or negative charges) are forced closer together, the magnitude of repulsive forces between the trapped ions increases.

Figure 3B:
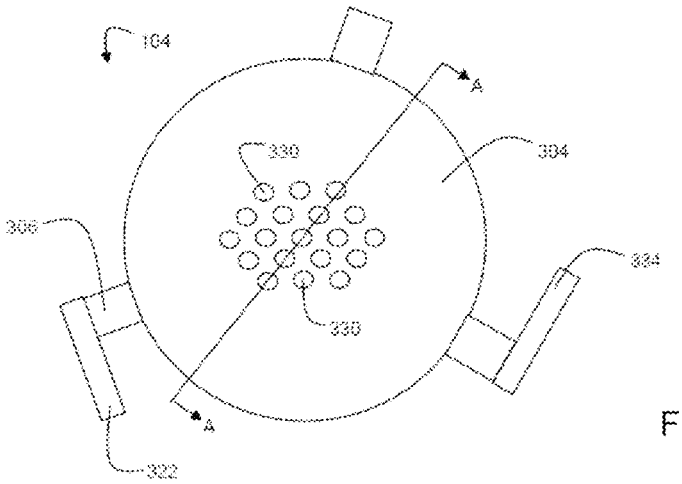
FIG. 3B is a schematic diagram of another embodiment of an ion trap.

To overcome limitations on the number of ions that can simultaneously be trapped in ion trap 104 and increase the capacity of spectrometer 100, in some embodiments spectrometer 100 can include an ion trap with multiple chambers. FIG. 3B shows a schematic diagram of an ion trap 104 with a plurality of ion chambers 330, arranged in a hexagonal array. Each chamber 330 functions in the same manner as ion trap 104 in FIG. 3A, and includes two end cap electrodes and a cylindrical central electrode. End cap electrode 304 is shown in FIG. 3B, along with a portion of end-cap electrode 306. End cap electrode 304 is connected to voltage source 106 through connection point 334, and end cap electrode 306 is connected to voltage source 106 through connection point 332.

Figure 3C:
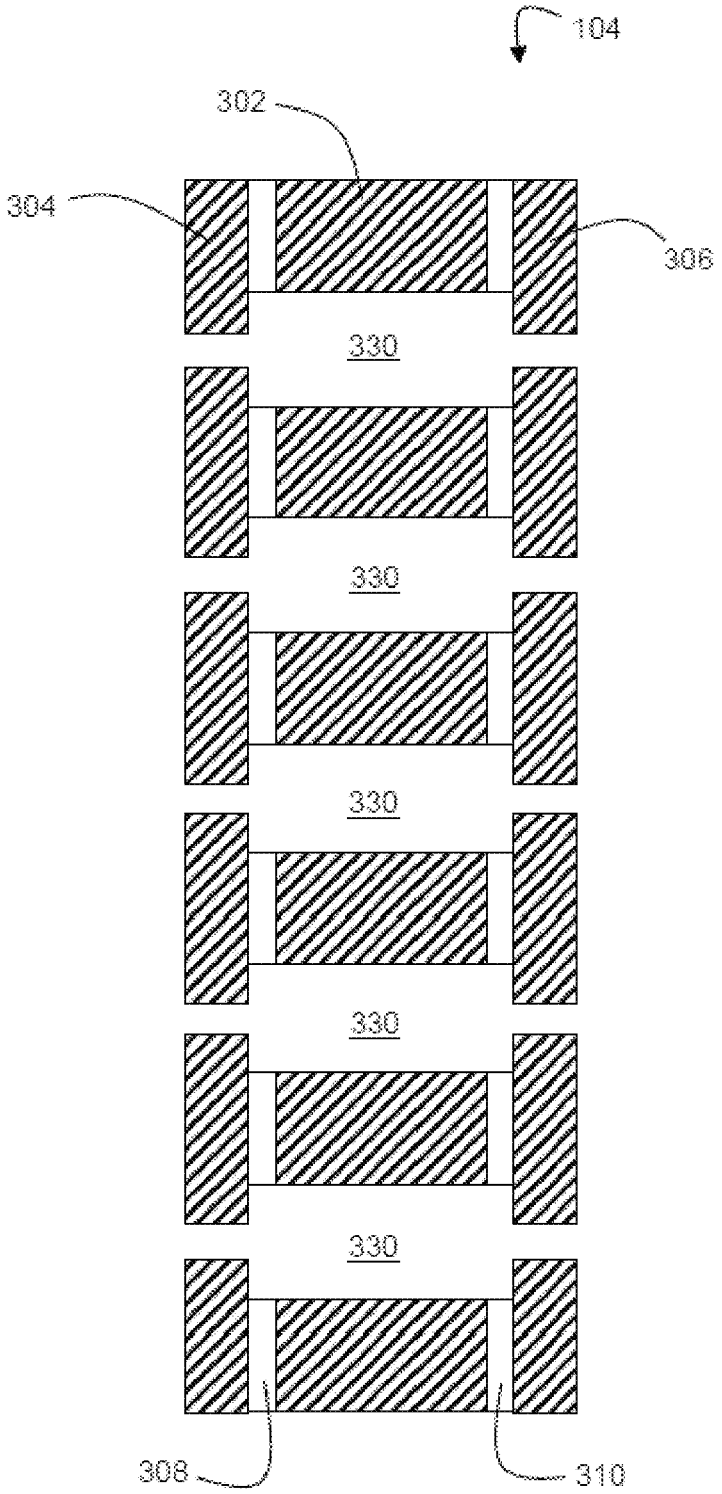
FIG. 3C is a cross-sectional diagram of the ion trap of FIG. 3B.

FIG. 3C is a cross-sectional diagram through section line A-A in FIG. 3B. Each of the five ion chambers 330 that fall along section line A-A are shown. Voltage source 106 is connected via a single connection point (not shown in FIG. 3C) to central electrode 302. As a result, by applying suitable potentials to electrode 302, voltage source 106 (under the control of controller 108) can simultaneously trap ions within each of the chambers 330, and eject ions with selected mass-to-charge ratios from each of the chambers 330.

In some embodiments, the number of ion chambers 330 in ion trap 104 can be matched to the number of apertures formed in end cap electrode 304. As described in Section II, end cap electrode 304 can, in general, include one or more apertures. When end cap electrode 304 includes a plurality of apertures, ion trap 104 can also include a plurality of ion chambers 330, so that each aperture formed in end cap electrode 304 corresponds to a different ion chamber 330. In this manner, ions generated within ion source 102 can be efficiently collected by ion trap 104, and trapped within ion chambers 330. The use of multiple chambers, as described above, reduces space-charge interactions among the trapped ions, increasing the trapping capacity of ion trap 104. In general, the positions and cross-sectional shapes of ion chambers 330 can be the same as the arrangements and shapes of apertures 240 and 294 discussed in Section II.

As an example, referring to FIG. 3B, end cap electrode 304 includes a plurality of apertures arranged in a hexagonal array. Each of the apertures formed in electrode 304 is matched to a corresponding ion chamber 330, and therefore ion chambers 330 are also arranged in a hexagonal array.

In certain embodiments, the number, arrangement, and/or cross-sectional shapes of ion chambers 330 are not matched to the arrangement of apertures in end cap electrode 304. For example, end cap electrode 304 can include only one or a small number of apertures 294, and ion trap 304 can nonetheless include a plurality of ion chambers 330. Because the use of multiple ion chambers 330 increases the trapping capacity of ion trap 104, using multiple ion chambers can provide advantages even if the arrangement of the ion chambers is not matched to the arrangement of apertures in end cap electrode 304.

Additional features of ion trap 104 are disclosed, for example, in U.S. Pat. Nos. 6,469,298, 6,762,406, and 6,933,498, the entire contents of each of which are incorporated herein by reference.

IV. Detector

Detector 118 is configured to detect charged particles leaving ion trap 104. The charged particles can be positive ions, negative ions, electrons, or a combination of these.

Figure 4A:
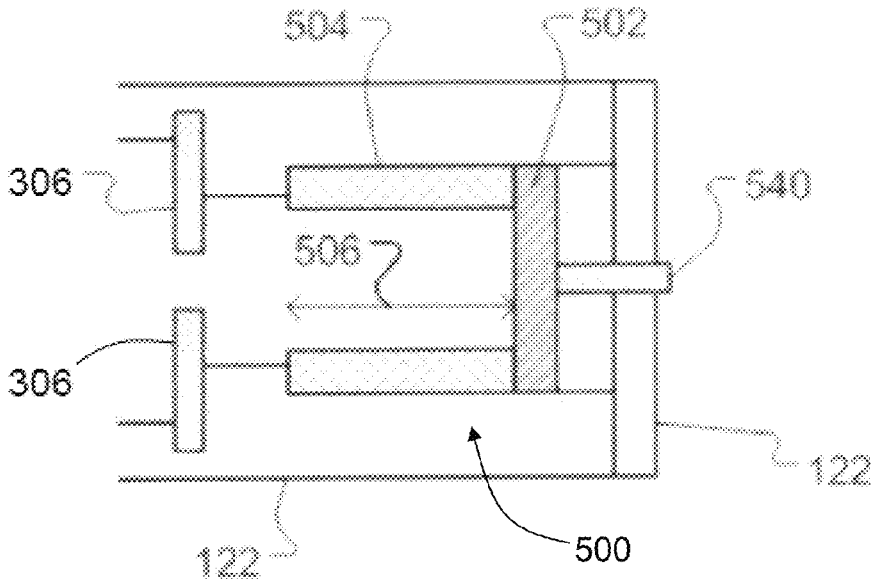
FIG. 4A is a schematic diagram of an embodiment of a Faraday cup charged particle detector.

A wide variety of different detectors can be used in spectrometer 100. In some embodiments, for example, detector 118 can include one or more Faraday cups. FIG. 4A shows a side view of a Faraday cup 500. In some embodiments, the length 506 of sidewall 504 can be 20 mm or less (e.g., 10 mm or less, 5 mm or less, 2 mm or less, 1 mm or less, or even 0 mm). In general, length 506 can be selected according to various criteria, including maintaining the compactness of spectrometer 100, providing the required selectivity during detection of charged particles, and resolution. In some embodiments, sidewall 504 conforms to the cross-sectional shape of base 502. More generally, however, sidewall 504 is not required to conform to the shape of base 502, and can have a variety of cross-sectional shapes that are different from the shape of base 502. Moreover, sidewall 504 does not have to be cylindrical in shape. In some embodiments, for example, sidewall 504 can be curved along the axial direction of Faraday cup 500.

In general, Faraday cup 500 can relatively small. The maximum dimension of Faraday cup 500 corresponds to the largest linear distance between any two points on the cup. In some embodiments, for example, the maximum dimension of Faraday cup 500 is 30 mm or less (e.g., 20 mm or less, 10 mm or less, 5 mm or less, 3 mm or less).

Typically, the thickness of base 502 and/or the thickness of sidewall 504 are chosen to ensure efficient detection of charged particles. In some embodiments, for example, the thickness of base 502 and/or of sidewall 504 are 5 mm or less (e.g., 3 mm or less, 2 mm or less, 1 mm or less).

The sidewall 504 and base 502 of Faraday cup 500 are generally formed from one or more metals. Metals that can be used to fabricate Faraday cup 500 include, for example, copper, aluminum, and silver. In some embodiments, Faraday cup 500 can include one or more coating layers on the surfaces of base 502 and/or sidewall 504. The coating layer(s) can be formed from materials such as copper, aluminum, silver, and gold.

During operation of spectrometer 100, as charged particles are ejected from ion trap 104, the charged particles can drift or be accelerated into Faraday cup 500. Once inside Faraday cup 500, the charged particles are captured at the surface of Faraday cup 500 (e.g., the surface of base 502 and/or sidewall 504). Charged particles that are captured either by base 502 or sidewall 504 generate an electrical current, which is measured (e.g., by an electrical circuit within detector 118) and reported to controller 108. If the charged particles are ions, the measured current is an ion current, and its amplitude is proportional to the abundance of the measured ions.

To obtain a mass spectrum of an analyte, the amplitude of the electrical potential applied to central electrode 302 of ion trap 104 is varied (e.g., a variable amplitude signal, high voltage RF signal 482, is applied) to selectively eject ions of particular mass-to-charge ratios from ion trap 104. For each change in amplitude corresponding to a different mass-to-charge ratio, an ion current corresponding to ejected ions of the selected mass-to-charge ratio is measured using Faraday cup 500. The measured ion current as a function of the potential applied to electrode 302—which corresponds to the mass spectrum—is reported to controller 108, In some embodiments, controller 108 converts applied voltages to specific mass-to-charge ratios based on algorithms and/or calibration information for ion trap 104.

Following ejection from ion trap 104 through end cap electrode 306, charged particles can be accelerated to impact detector 118 by forming an electric field between the detector 118 and end cap electrode 306. In certain embodiments, where detector 118 includes Faraday cup 500 for example, the conducting surface of the Faraday cup 500 is maintained at the ground potential established by voltage source 106, and a positive potential is applied to end cap electrode 306. With these applied potentials, positive ions are repelled from end cap electrode 306 toward the grounded conducting surface of Faraday cup 500. Further, electrons passing through end cap electrode 306 are attracted toward end cap electrode 306, and thus do not impact Faraday cup 500. This configuration therefore leads to improved signal-to-noise ratio. More generally, in this configuration, Faraday cup 500 can be at a potential other than ground, as long as it is at a lower potential than end cap electrode 306.

In some embodiments, it is desirable to detect negatively charged particles (e.g., negative ions and/or electrons). To detect such particles, Faraday cup 500 is biased to a higher voltage than end cap electrode 306 to attract negatively charged particles to the Faraday cup 500.

Figure 4B:
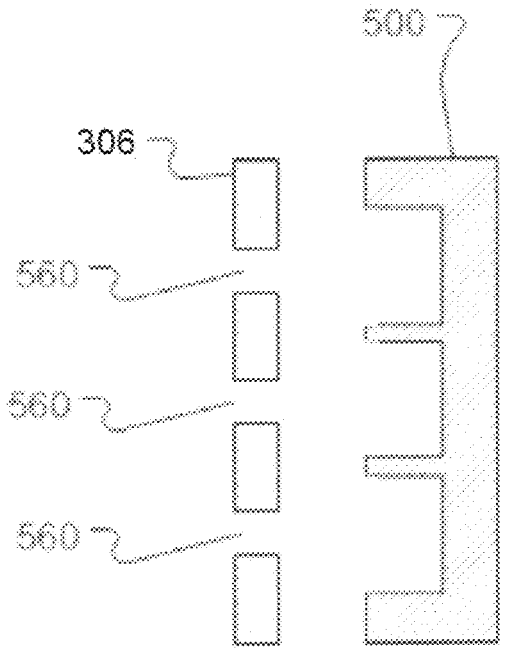
FIG. 4B is a schematic diagram of an array of Faraday cup detectors.

FIG. 4B is a schematic diagram of an embodiment of detector 118 that includes an array of Faraday cup detectors 500, which may or may not be monolithically formed. Arrays of detectors can be advantageous, for example, when ion trap 104 includes an array of ion chambers 330. End cap electrode 306 can include a plurality of apertures 560 aligned with each of the ion chambers, so that ions ejected from each chamber pass through substantially only one of the apertures 560. After passing through one of the apertures 560, the ions are incident on one of the Faraday cup detectors 500 in the array. This array-based approach to ejection and detection of ions can significantly increase the efficiency with which ejected ions are detected. In the array geometry shown in FIG. 4B, the size of each Faraday cup 500 can conform to the size of each aperture 560 formed in end cap electrode 306.

While the preceding discussion has focused on Faraday cup detectors due to their low power operation and compact size, more generally a variety of other detectors can be used in spectrometer 100. For example, other suitable detectors include electron multipliers, photomultipliers, scintillation detectors, image current detectors, Daly detectors, phosphor-based detectors, and other detectors in which incident charged particles generate photons which are then detected (i.e., detectors that employ a charge-to-photon transduction mechanism).

V. Pressure Regulation Subsystem

Pressure regulation subsystem 120 is generally configured to regulate the gas pressure in gas path 128, which includes the interior volumes of ion source 102, ion trap 104, and detector 118. As discussed above in Section I, during operation of spectrometer 100, pressure regulation subsystem 120 maintains a gas pressure within spectrometer 100 that is 100 mTorr or more (e.g., 200 mTorr or more, 500 mTorr or more, 700 mTorr or more, 1 Torr or more, 2 Torr or more, 5 Torr or more, 10 Torr or more), and/or 100 Torr or less (e.g., 80 Torr or less, 60 Torr or less, 50 Torr or less, 40 Torr or less, 30 Torr or less, 20 Torr or more).

In some embodiments, pressure regulation subsystem 120 maintains gas pressures within the above ranges in certain components of spectrometer 100. For example, pressure regulation subsystem 120 can maintain gas pressures of between 100 mTorr and 100 Torr (e.g., between 100 mTorr and 10 Torr, between 200 mTorr and 10 Torr, between 500 mTorr and 10 Torr, between 500 mTorr and 50 Torr, between 500 mTorr and 100 Torr) in ion source 102 and/or ion trap 104 and/or detector 118. In certain embodiments, the gas pressures in at least two of ion source 102, ion trap 104, and detector 118 are the same. In some embodiments, the gas pressure in all three components is the same.

In certain embodiments, gas pressures in at least two of ion source 102, ion trap 104, and detector 118 differ by relatively small amounts. For example, pressure regulation subsystem 120 can maintain gas pressures in at least two of ion source 102, ion trap 104, and detector 118 that differ by 100 mTorr or less (e.g., 50 mTorr or less, 40 mTorr or less, 30 mTorr or less, 20 mTorr or less, 10 mTorr or less, 5 mTorr or less, 1 mTorr or less). In some embodiments, the gas pressures in all three of ion source 102, ion trap 104, and detector 118 differ by 100 mTorr or less (e.g., 50 mTorr or less, 40 mTorr or less, 30 mTorr or less, 20 mTorr or less, 10 mTorr or less, 5 mTorr or less, 1 mTorr or less).

In some embodiments, pressure regulation subsystem 120 can include one or more scroll pumps. Typically, a scroll pump includes one or more interleaving scroll flanges, and during operation, relative orbital motion between the scroll flanges traps gases and liquids, leading to pumping activity. In certain embodiments, one scroll flange can be fixed while another scroll flange orbits eccentrically with or without rotation. In some embodiments, both scroll flanges move with offset centers of rotation. Examples of scroll flange geometries include (but are not limited to) involute, Archimedean spiral, and hybrid curves.

The orbital motion of scroll flanges allows a scroll pump generate only very small amplitude vibrations and low noise during operation. As such, scroll pumps can be directly coupled to ion trap 104 in system 100 without introducing substantial detrimental effects during mass spectrum measurements. To further reduce vibrational coupling, orbiting scroll flanges can be counterbalanced with simple masses. Because scroll pumps have few moving parts and generate only very small amplitude vibrations, the reliability of such pumps is generally very high.

Scroll pumps suitable for use in pressure regulation subsystem 120 are available, for example, from Agilent Technologies Inc. (Santa Clara, Calif.). In addition to scroll pumps, other pumps can also be used in pressure regulation subsystem 120. Examples of suitable pumps include diaphragm pumps, diaphragm pumps, and roots blower pumps.

Using a small, single mechanical pump provides a number of advantages relative to the pumping schemes used in conventional mass spectrometers. In particular, conventional mass spectrometers typically use multiple pumps, at least one of which operates at high rotational frequency. Large mechanical pumps operating at high rotational frequencies generate mechanical vibrations that can couple into the other components of the spectrometer, generating undesirable noise in measured information. In addition, even if measures are taken to isolate the components from such vibrations, the isolation mechanisms typically increase the size of the spectrometers, sometimes considerably. Furthermore, large pumps operating at high frequencies consume large amounts of electrical power. Accordingly, conventional mass spectrometers include large power supplies for meeting these requirements, further enlarging the size of such instruments.

In contrast, a single mechanical pump such as a scroll pump can be used in the spectrometers disclosed herein to control gas pressures in each of the components of the system. By operating the mechanical pump at a relatively low rotational frequency, the mechanical coupling of vibrations into other components of the spectrometer can be substantially reduced or eliminated. Further, by operating at low rotational frequencies, the amount of power consumed by the pump is small enough that its modest requirements can be met by voltage source 106.

It has been determined experimentally that in some embodiments, by operating the single mechanical pump at a frequency of less than 6000 cycles per minute (e.g., less than 5000 cycles per minute, less than 4000 cycles per minute, less than 3000 cycles per minute, less than 2000 cycles per minute), the pump is capable of maintaining desired gas pressures within spectrometer 100, and at the same time, its power consumption requirements can be met by voltage source 106.

In some embodiments, spectrometer 100 is configured to operate at even higher gas pressures, e.g., at pressures up to 1 atm (e.g., 760 Torr). That is, the internal gas pressure in one or more of ion source 102, ion trap 104, and/or detector 118 is between 100 Torr and 760 Torr (e.g., 200 Torr or more, 300 Torr or more, 400 Torr or more, 500 Torr or more, 600 Torr or more) when spectrometer 100 is detecting ions according to a mass-to-charge ratio for the ions.

Certain components disclosed herein are already well suited to operation at pressures of up to 1 atm (and even higher pressures). For example, some of the ion sources disclosed herein, such as glow discharge ion sources, can operate at pressures up to 1 atm with little or no modification. In addition, certain types of detectors such as Faraday detectors (e.g., Faraday cup detectors and arrays thereof) can also operate at pressures of up to 1 atm with little or no modification.

The ion traps disclosed herein can be modified for operation at pressures of up to 1 atm. For example, to operate at pressures of 1 atm, dimension $c_0$ of ion trap 104 can be reduced to between 1.5 microns and 0.5 microns (e.g., between 1.5 microns and 0.7 microns, between 1.2 microns and 0.5 microns, between 1.2 microns and 0.8 microns, approximately 1 micron). Further, to operate at gas pressure of up to 1 atm, voltage source 106 can be modified to provide sweeping voltages to ion trap 104 that repeat with a frequency in the GHz range, e.g., a frequency of 1.0 GHz or more (e.g., 1.2 GHz or more, 1.4 GHz or more, 1.6 GHz or more, 2.0 GHz or more, 5.0 GHz or more, or even more). With these modifications to ion trap 104 and voltage source 106, mass spectrometer 100 can operate at pressures of up to 1 atm, so that the use of pressure regulation subsystem 120 is significantly curtailed. In some embodiments, it can even be possible to eliminate pressure regulation subsystem 120 from spectrometer 100, e.g., so that spectrometer 100 is a pump-less spectrometer.

VI. Housing

Figure 5:
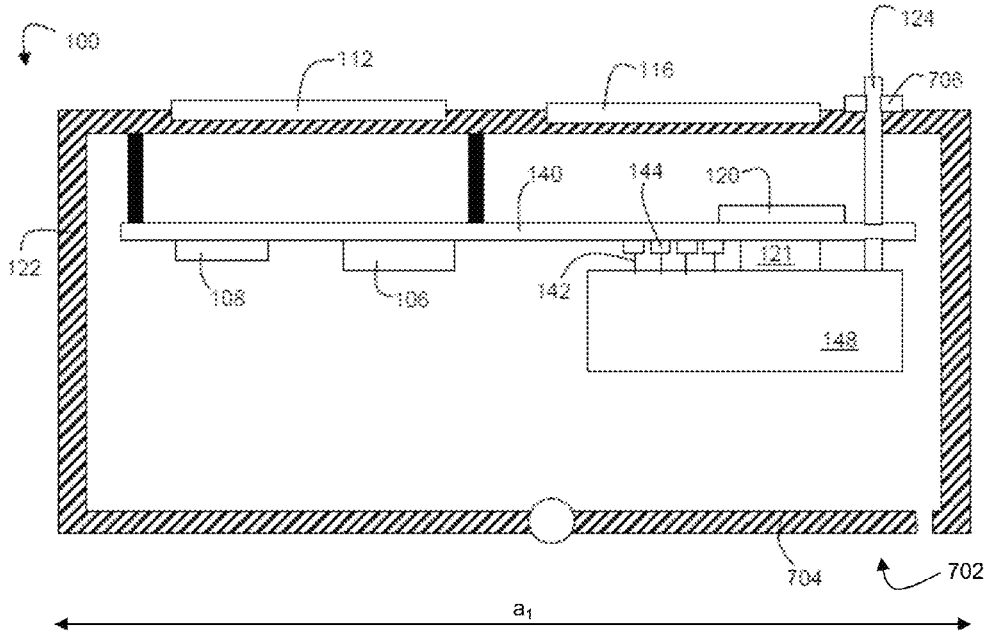
FIG. 5 is a cross-sectional diagram of an embodiment of a compact mass spectrometer.

As described above in Section I, mass spectrometer 100 includes a housing 122 that encloses the components of the spectrometer. FIG. 5 shows a schematic diagram of an embodiment of housing 122. Sample inlet 124 is integrated within housing 122 and configured to introduce gas particles into gas path 128. Also integrated into housing 122 are display 116 and user interface 112.

In some embodiments, display 116 is a passive or active liquid crystal or light emitting diode (LED) display. In certain embodiments, display 116 is a touchscreen display. Controller 108 is connected to display 116, and can display a variety of information to a user of mass spectrometer 100 using display 116. The information that is displayed can include, for example, information about an identity of one or more substances that are scanned by spectrometer 100. The information can also include a mass spectrum (e.g., measurements of abundances of ions detected by detector 118 as a function of mass-to-charge ratio). In addition, information that is displayed can include operating parameters and information for mass spectrometer 100 (e.g., measured ion currents, voltages applied to various components of mass spectrometer 100, names and/or identifiers associated with the current module 148 installed in spectrometer 100, warnings associated with substances that are identified by spectrometer 100, and defined user preferences for operation of spectrometer 100). Information such as defined user preferences and operating settings can be stored in storage unit 114 and retrieved by controller 108 for display In some embodiments, user interface 112 includes a series of controls integrated into housing 122. The controls, which can be activated by a user of spectrometer 100, can include buttons, sliders, rockers, switches, and other similar controls. By activating the controls of user interface 112, a user of spectrometer 100 can initiate a variety of functions. For example, in some embodiments, activation of one of the controls initiates a scan by spectrometer 100, during which spectrometer draws in a sample (e.g., gas particles) through sample inlet 124, generates ions from the gas particles, and then traps and analyzes the ions using ion trap 104 and detector 118. In certain embodiments, activation of one of the controls resets spectrometer 100 prior to performing a new scan. In some embodiments, spectrometer 100 includes a control that, when activated by a user, re-starts spectrometer 100 (e.g., after changing one of the components of spectrometer 100 such as module 148 and/or a filter connected to sample inlet 124).

When display 116 is a touchscreen display, a portion, or even all, of user interface 112 can be implemented as a series of touchscreen controls on display 116. That is, some or all of the controls of user interface 112 can be represented as touch-sensitive areas of display 116 that a user can activate by contacting display 116 with a finger.

As described in Section I, in some embodiments, mass spectrometer 100 includes a replaceable, pluggable module 148 that includes ion source 102, ion trap 104, and (optionally) detector 118. When mass spectrometer 100 includes a pluggable module 148, housing 122 can include an opening to allow a user to access the interior of housing 122 to replace module 148, without disassembling housing 122. As shown in FIG. 5, housing 122 can include an optional opening 702 and a closure 704 that seals opening 702. When module 148 is to be replaced, a user of spectrometer 100 can open closure 704 to expose the interior of spectrometer 100. Closure 704 is positioned so that it provides direct access to pluggable module 148, allowing the user to unplug module 148 from support base 140, and to install another module in its place, without disassembling housing 122. The user can then re-seal opening 702 by fastening closure 704. In FIG. 5, closure 704 is implemented in the form of a retractable door. More generally, however, a wide variety of closures can be used to seal the opening in housing 122. For example, in some embodiments, closure 704 can be implemented as a lid that is fully detachable from housing 122.

In general, mass spectrometer 100 can include a variety of different sample inlets 124. For example, in some embodiments, sample inlet 124 includes an aperture configured to draw gas particles directly from the environment surrounding spectrometer 100 into gas path 128. Sample inlet 124 can include one or more filters 706. For example, in some embodiments, filter 706 is a HEPA filter, and prevents dust and other solid particles from entering spectrometer 100. In certain embodiments, filter 706 includes a molecular sieve material that traps water molecules.

As discussed previously, conventional mass spectrometers operate at low internal gas pressures. To maintain low gas pressures, conventional mass spectrometers include one or more filters attached to sample inlets. These filters are selective, and filter out particles of certain types of substances, such as atmospheric gas particles (e.g., nitrogen and/or oxygen molecules) from entering the mass spectrometer. The filters can also be specifically tailor for certain classes of analytes such as biological molecules, and can filter out other types of molecules. As a result, the filters that are used in conventional mass spectrometers—which can include pinch valves, and membrane filters formed from materials such as polydimethylsiloxane which permit selective transport of substances—filter the incoming stream of gas particles to remove certain types of particles from the stream. Without such filters, conventional mass spectrometers could not function, as the low internal gas pressure could not be maintained, and some of the particles admitted into the mass spectrometers would prevent operation of certain components. As an example, thermionic ion sources that are used in conventional mass spectrometers do not operate in the presence of even moderate concentrations of atmospheric oxygen.

The use of substance-specific filters in conventional mass spectrometers has a number of disadvantages. For example, because the filters are selective, fewer analytes can be analyzed without changing filters and/or operating conditions, which can be cumbersome. In particular, for an untrained user of a mass spectrometer, re-configuring the spectrometer for specific analytes by choosing an appropriate selective filter may be difficult. Further, the filters used in conventional mass spectrometers introduce a time delay, because analyte particles do not diffuse instantly through the filters. Depending upon the selectivity of the filters and the concentration of the analyte, a considerable delay can be introduced between the time the analyte is first encountered, and the time when sufficient quantities of analyte ions are detected to generate mass spectral information.

However, because the systems disclosed herein operate at higher pressures, there is no need to include a filter such as a membrane filter to maintain low gas pressures within the spectrometer. By operating without the types of filters that are used in conventional mass spectrometers, the systems disclosed herein can analyze a greater number of different types of samples without significant re-configuration, and can perform analyses faster. Moreover, because the components of the spectrometers disclosed herein are generally not sensitive to atmospheric gases such as nitrogen and oxygen, these gases can be admitted to the spectrometers along with particles of the analyte of interest, which significantly increases the speed of analysis and decreases the operating requirements (e.g., the pumping load on pressure regulation subsystem 120) of the other components of the spectrometers.

Accordingly, in general, the filters used in the spectrometers disclosed herein (e.g, filter 706) do not filter atmospheric gas particles (e.g., nitrogen molecules and oxygen molecules) from the stream of gas particles entering sample inlet 124. In particular, filter 706 allows at least 95% or more of the atmospheric gas particles that encounter the filter to pass through.

Housing 122 is generally shaped so that it can be comfortably operated by a user using either one hand or two hands. In general, housing 122 can have a wide variety of different shapes. However, due to the selection and integration of components of spectrometer 100 disclosed herein, housing 122 is generally compact. As shown in FIG. 5, regardless of overall shape, housing 122 has a maximum dimension $a_1$ that corresponds to a longest straight-line distance between any two points on the exterior surface of the housing. In some embodiments, $a_1$ is 35 cm or less (e.g., 30 cm or less, 25 cm or less, 20 cm or less, 15 cm or less, 10 cm or less, 8 cm or less, 6 cm or less, 4 cm or less).

Further, due to the selection of components within spectrometer 100, the overall weight of spectrometer 100 is significantly reduced relative to conventional mass spectrometers. In certain embodiments, for example, the total weight of spectrometer 100 is 4.5 kg or less (e.g., 4.0 kg or less, 3.0 kg or less, 2.0 kg or less, 1.5 kg or less, 1.0 kg or less, 0.5 kg or less).

VII. Operating Modes

Figure 6A:
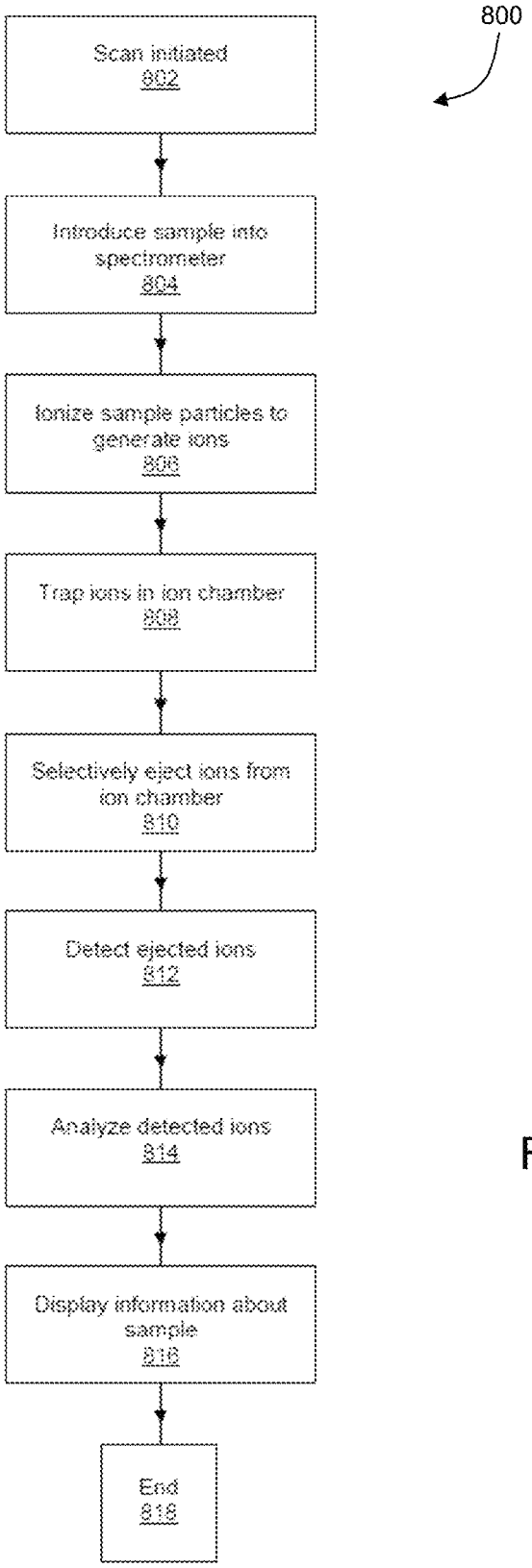
FIG. 6A is a flow chart showing a series of steps for measuring mass spectral information and displaying information about a sample.

In general, mass spectrometer 100 operates according to a variety of different operating modes. FIG. 6A is a flow chart 800 that shows a general sequence of steps that are performed in the different operating modes to scan and analyze a sample. In the first step 802, a scan of the sample is initiated. In some embodiments, the scan is initiated by a user of spectrometer 100. For example, spectrometer 100 can be configured to operate in a "one touch" mode where the user can initiate a scan of a sample simply by activating a control in user interface 112. In some embodiments, controller 108 can initiate a scan automatically based on one or more sensor readings. For example, when spectrometer 100 includes limit sensors such as photoionization detectors and/or LEL sensors, controller 108 can monitor signals from these sensors. If the sensors indicate that a substance of potential interest has been detected, for example, controller 108 can initiate a scan. In general, a wide variety of different sensor-based events or conditions can be used by controller 108 to initiate a scan automatically.

In certain embodiments, spectrometer 100 can be configured to run in "continuous scan" mode. After spectrometer 100 has been placed in continuous scan mode, a scan is repeatedly initiated after expiration of a fixed time interval. The time interval is configurable by the user, and the value of the time interval can be stored in storage unit 114 and retrieved by controller 108. Thus, in step 802 of FIG. 6A, the scan is initiated by spectrometer 100 when the spectrometer is in continuous scan mode.

After the scan has been initiated, the sample is introduced into spectrometer 100 in step 804. A variety of different methods can be used to introduce the sample into the spectrometer. In some embodiments, where the sample consists of gas particles, controller 108 activates valve 129, opening the value to admit the gas particles into spectrometer 100 (e.g., into gas path 128). If sample inlet 124 includes a filter 706, the gas particles pass through the filter, which removes dust and other solid materials from the stream of gas particles. As disclosed above, the pressure regulation subsystem maintains a gas pressure that is less than atmospheric pressure in gas path 128. As a result, when valve 129 opens, gas particles 822 are drawn in to sample inlet 124 by the pressure differential between gas path 128 and the environment surrounding spectrometer 100. Alternatively, or in addition, pressure regulation subsystem 120 can cause the gas particles to flow into spectrometer 100.

In certain embodiments, a sample in a partially ionized state can be drawn into spectrometer 100 by electrostatic or electrodynamic forces. For example, by applying suitable electrical potentials to electrodes in spectrometer 100, charged particles can be accelerated into spectrometer 100 (e.g., through sample inlet 124).

Next, in step 806, the sample is ionized in ion source 102. As disclosed above, a sample inlet 124 can be positioned in different locations along gas path 128, relative to the other components of spectrometer 100. For example, in some embodiments, sample inlet 124 is positioned so that gas particles introduced into spectrometer 100 enter ion trap 104 first from sample inlet 124. In certain embodiments, sample inlet 124 is positioned so that gas particles introduced into spectrometer 100 enter ion source 102 first from sample inlet 124. In some embodiments, sample inlet 124 is positioned so that gas particles enter detector 118 first from sample inlet 124. Still further, sample inlet 124 can be positioned so that gas particles that enter spectrometer 100 enter gas path 128 at a point between ion source 102 and/or ion trap 104 and/or detector 118.

After the sample (e.g., as gas particles 822) has been introduced into spectrometer 100 at a point along gas path 128, some of the gas particles enter ion source 102. If sample inlet 124 is not positioned so that gas particles 822 enter ion source 102 directly, then movement of gas particles 822 into ion source 102 occurs by diffusion. Once inside ion source 102, controller 108 activates ion source 102 to ionize the gas particles.

Next, the ions generated in step 806 are trapped in ion trap 104 in step 808. As disclosed above, movement of the ions from ion source 102 to ion trap 104 generally occurs under the influence of electric fields generated between ion source 102 and ion trap 104. Once inside ion trap 104, the ions are trapped by electric fields internal to the trap, and circulate within the opening in central electrode 302, and between end cap electrodes 304 and 306. The electric fields within ion trap 104 are generated by voltage source 106 under the control of controller 108, which applies suitable electrical potentials to electrodes 302, 304, and 306 to generate the trapping fields.

In step 810, the trapped, circulating ions in ion trap 104 are selectively ejected from the trap. Selective ejection of ions from trap 104 occurs under the control of controller 108, which transmits signals to voltage source 106 to vary the amplitude of the applied RF voltage to the central electrode 302. As the amplitude of the potential is varied, the amplitude of the electric field in the internal opening of central electrode 302 also varies. Further, as the amplitude of the field within central electrode 302 varies, circulating ions with specific mass-to-charge ratios fall out of circulating orbit within central electrode 302, and are ejected from ion trap 104 through one or more apertures in end cap electrode 306. Controller 108 is configured to direct voltage source 106 to sweep the amplitude of the applied potential according to a defined function (e.g., a linear amplitude sweep) to selectively eject ions of specific mass-to-charge ratios from ion trap 104 into detector 118. The rate at which the applied potential is swept can be determined automatically by controller 108 (e.g., to achieve a target resolving power of spectrometer 100), and/or can be set by a user of spectrometer 100.

After the ions have been selectively ejected from ion trap 104, they are detected by detector 118 in step 812. A variety of different detectors can be used to detect the ions. For example, in some embodiments, detector 118 includes a Faraday cup that is used to detect the ejected ions.

For each mass-to-charge ratio selected by the amplitude of the electrical potential applied to central electrode 302 in ion trap 104, detector 118 measures a current related to the abundance of ions detected with the selected mass-to-charge ratio. The measured currents are transmitted to controller 108. As a result, the information that controller 108 receives from detector 118 corresponds to detected abundances of ions as a function of mass-to-charge ratio for the ions. This information corresponds to a mass spectrum of the sample.

More generally, controller 108 is configured to detect ions according to a mass-to-charge ratio for the ions, which means that controller 108 detects or receives signals that correlate with the detection of ions and are related to the mass-to-charge ratio for the ions. In some embodiments, controller 108 detects ions or receives information about ions directly as a function of mass-to-charge ratio. In certain embodiments, controller 108 detects ions or receives information about ions as a function of another quantity, such as an electrical potential applied to ion trap 104, that is related to the mass-to-charge ratio for the ions. In all such embodiments, controller 108 detects ions according to a mass-to-charge ratio.

In step 814, the information received from detector 118 is analyzed by controller 108. In general, to analyze the information, controller 108 (e.g., electronic processor 110 in controller 108) compares the mass spectrum of the sample to reference information to determine whether the mass spectrum of the sample is indicative of any of the known substances. The reference information can be stored, for example, in storage unit 114, and retrieved by controller 108 to perform the analysis. In some embodiments, controller 108 can also retrieve reference information from databases that are stored at remote locations. For example, controller 108 can communicate with such databases using communication interface 117 to obtain mass spectra of known substances, for use in analyzing the information measured by detector 118.

The information measured by detector 118 is analyzed by controller 108 to determine information about an identity of the sample. If the sample includes multiple compounds, controller 108—by comparing the measured information from detector 118 to reference information—can determine information about the identities of some or all of the multiple compounds.

Controller 108 is configured to determine a variety of information about the identity of a sample. For example, in some embodiments, the information includes one or more of the sample's common name, IUPAC name, CAS number, UN number, and/or its chemical formula. In certain embodiments, the information about the identity of the sample includes information about whether the sample belongs to a certain class of substances (e.g., explosives, high energy materials, fuels, oxidizers, strong acids or bases, toxic agents). In some embodiments, the information can include information about hazards associated with the sample, handling instructions, safety warnings, and reporting instructions. In certain embodiments, the information can include information about a concentration or level of the sample measured by the spectrometer.

In certain embodiments, the information can include an indication as to whether or not the sample corresponds to a target substance. For example, when a scan is initiated in step 802, a user of spectrometer 100 can place the spectrometer in targeting mode, in which spectrometer 100 scans samples to specifically determine whether a sample corresponds to any of a series of identified target substances. Controller 108 can use a variety of data analysis techniques such as digital filtering and expert systems to search for particular spectral features in the measured mass spectral information. For a particular target substance, controller 108 can search for particular mass spectral features that are characteristic for the target substance, such as peaks at particular mass-to-charge ratios. If certain spectral features are missing from the measured mass spectral information, or if the measured information includes spectral features where none should appear, the information about the identity of the sample determined by controller 108 can include an indication that the sample does not correspond to the target substance. Controller 108 can be configured to determine such information for multiple target compounds.

After the sample analysis is complete, controller 108 displays information about the sample to the user in step 816, using display 116. The information that is displayed depends upon the operating mode of spectrometer 100 and the actions of the user. As discussed above, spectrometer 100 is configured so that it can be used by persons who do not have special training in the interpretation of mass spectra. For persons without such training, complete mass spectra (e.g., ion abundances as a function of mass-to-charge ratio) often carry little meaning. As a result, spectrometer 100 is configured so that in step 816, it does not display the measured mass spectrum of the sample to the user. Instead, spectrometer 100 displays only some (or all) of the information about the identity of the sample, as determined in step 814, to the user. For users without special training, information about the identity of the sample is of primary significance.

In addition to the information about the identity of the sample, controller 108 can also display other information. For example, in some embodiments, spectrometer 100 can access a database (e.g., stored in storage unit 114, or accessible via communication interface 117) of known hazardous materials. If the information about the identity of the sample is present in the database of hazardous materials, controller 108 can display alerting messages and/or additional information to the user. The alerting messages can include, for example, information about the relative hazardousness of the sample. The additional information can include, for example, actions that the user should consider taking, including actions to limit exposure of the user or others to the substance, and other security-related actions.

In some embodiments, spectrometer 100 is configured to display the mass spectrum of the sample to the user when a control is activated. This information can be useful, for example, when a conclusive match between the measured mass spectral information and reference information is not obtained and/or for analyses in laboratories, to infer more detailed chemical information, such as the fragmentation mechanism for particular ions.

In step 818, the process shown in flow chart 800 terminates. If the scan was initiated in step 802 by the user activating control 820, then spectrometer 100 waits for control 820 to be activated again before initiating another scan. Alternatively, if spectrometer 100 is in continuous scan mode, then spectrometer 100 waits for a defined time interval, and then initiates another scan automatically after the interval has elapsed, or waits for another external trigger such as a sensor signal.

Useful information about a sample, including information about the identity of the sample, can often be obtained and provided to a user by measuring the sample's mass spectrum even when the mass spectrometer's resolution is less than optimum, e.g., the resolution is lower than the highest possible value. In particular, sufficiently precise correspondences between measured mass spectral information and reference information can be achieved even when mass spectrometer 100 operates at a higher internal gas pressure—and therefore a poorer resolution—than conventional mass spectrometers.

Because mass spectrometer 100 can operate at lower resolution than a conventional mass spectrometer, mass spectrometer 100 can be further configured, in some embodiments, to adaptively adjust the operation of certain components to further reduce its overall power consumption. Components are adaptively operated either to achieve a target resolution in the measured mass spectral information, or to achieve a sufficient correspondence between the mass spectral information and reference information on a known substance or condition.

Figure 6B:
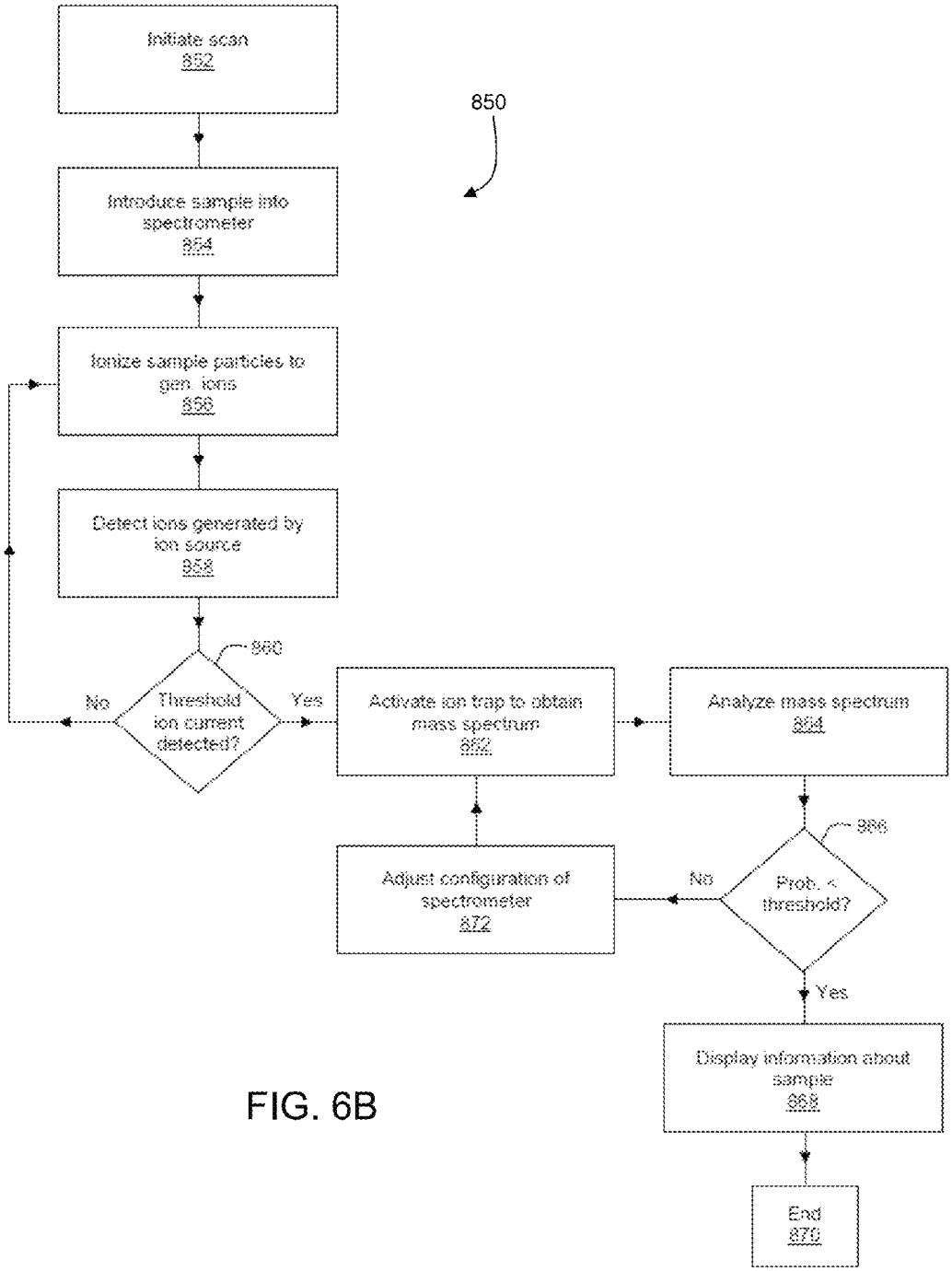
FIG. 6B is a flow chart showing a series of steps for measuring mass spectral information and adjusting a configuration of a mass spectrometer.

FIG. 6B shows a flow chart 850 that includes a series of steps for adaptive operation of mass spectrometer 100 to achieve a sufficient correspondence between measured mass spectral information and reference information on a known substance or condition. The target resolution can be set by the user of mass spectrometer 100 (e.g., either through a user-defined setting, or through visual inspection of measured mass spectral information), or set automatically by controller 108. In first step 852, a scan is initiated in the same manner as disclosed above in connection with step 802. Next, in step 854, a sample is introduced into spectrometer 100 in the same manner as disclosed above in connection with step 804. In step 856, sample particles are ionized to produce ions, as disclosed above in connection with step 806.

Then, in step 858, sample ions generated by ion source 102 are detected using detector 118. Step 858 can be performed without activating ion trap 104 to trap or selectively eject ions. Instead, in step 858, ions generated by ion source 102 pass directly through end cap electrodes 304 and 306 of ion trap 104, and are incident on detector 118. Voltage source 106 can be configured to apply electrical potentials to electrodes in ion source 102 and detector 118 to create an electric field between ion source 102 and detector 118 to promote the transport of ions.

Next, in step 860, controller 108 determines whether a threshold ion current has been detected by detector 118. The threshold ion current can be a user-defined and/or user-adjustable setting of spectrometer 100. Alternatively, the threshold ion current can be determined automatically by spectrometer 100 based on, for example, a measurement of dark current and/or noise in detector 118 by controller 108. If the threshold current has not yet been reached, ionization of the sample and detection of sample ions continues in steps 856 and 858. Alternatively, if the threshold ion current has been reached, controller 108 activates ion trap 104 in step 862 to trap and selectively eject ions into detector 118. The ejected ions are detected by detector 118, and the mass spectral information is analyzed by controller 108 in step 864 in an attempt to determine information about an identity of the sample.

As part of the analysis in step 864, controller 108 can determine a probability that the measured mass spectral information for the sample originates from a known substance or condition. In step 866, controller 108 compares the determined probability to a threshold probability to determine whether the analysis of the mass spectral information is limited by the resolution of spectrometer 100. If the probability is larger than the threshold value, then controller 108 displays information about the sample (e.g., an identity of the sample and/or information about an identity of the sample) using display 116, and the process concludes at step 870. However, if the probability is less than the threshold probability value in step 866, then the analysis of the mass spectral information may be limited by the resolution of spectrometer 100.

In some embodiments, step 866 includes determining whether a probability of correct detection is sufficiently large (e.g., exceeds a threshold probability value). The probability of correct detection corresponds to a probability that the mass spectral information correctly matches spectral information for a known substance. Such probabilities can be calculated in a variety of ways, including for example by using correspondences between the observed and known fragmentation patterns of target analytes, using abstract features of the observed measurements known to be predictive of analyte presence, using decision trees based on the measured conditions and observed fragmentation patterns from the unknown materials, and using dynamic properties of the unknown samples such its response to positive and negative ionization, or axial excitation. If the probability of correct detection is too low, controller 108 adjusts the configuration of the spectrometer in step 872.

In certain embodiments, step 866 includes determining whether a probability of a false alarm is sufficiently low (e.g., is smaller than a threshold probability value). The probability of a false alarm corresponds to a probability that the measured spectral information corresponds to known spectral information for one or more substances that are hazardous and/or targeted for detection by spectrometer 100 and/or a user of the spectrometer. The probability of a false alarm can be calculated, for example, from the degree of confusion in the algorithms, or the vagueness of the posterior probability distributions. If the probability of a false alarm is sufficiently low (e.g., smaller than the threshold value), then spectrometer 100 continues to step 868. Alternatively, if the probability of a false alarm exceeds the threshold value, controller 108 adjusts the configuration of the spectrometer in step 872.

To increase the enhance the resolution of spectrometer 100, controller 108 adaptively adjusts the configuration of the spectrometer, before control returns to step 862. Controller 108 is configured to adjust the configuration in a variety of ways to increase the resolution of spectrometer 100. In some embodiments, controller 108 is configured to activate buffer gas source 150 to introduce buffer gas particles into gas path 128. The introduced buffer gas particles can include, for example, nitrogen molecules, hydrogen molecules, or atoms of a noble gas such as helium, argon, neon, or krypton. Buffer gas source 150 can include a replaceable cylinder containing the buffer gas particles, and a valve connected to controller 108 via control line 127*g*, or a buffer gas generator. Controller 108 can be configured to activate the valve in buffer gas source 150 so that controlled quantities of buffer gas particles are released into gas path 128. Once released into gas path 128, the buffer gas particles mix with the ions generated by ion source 102, and facilitate trapping and selective ejection of the ions into detector 118, thereby increasing the resolving power of spectrometer 100.

In certain embodiments, controller 108 reduces the internal gas pressure in spectrometer 100 to increase the resolving power of spectrometer 100. To reduce the internal gas pressure, controller 108 activates pressure regulation subsystem 120 via control line 127*d*. Alternatively, or in addition, controller 108 can close valve 129 to reduce the internal gas pressure. In some embodiments, valve 129 can be alternately opened and closed in pulsed fashion with a particular duty cycle to reduce the internal gas pressure. In certain embodiments, spectrometer 100 can include multiple sample inlets, and valve 129 can be closed to seal sample inlet 124, while another in-line valve in a smaller diameter sample inlet can be opened. By using a different sample inlet to reduce the gas pressure in spectrometer 100, no change in pumping speed is necessary. Reducing the internal gas pressure in spectrometer 100 increases the resolution of spectrometer 100 by reducing the frequency of collisions between ions in ion source 102, ion trap 104, and detector 118.

In some embodiments, to improve the resolution of spectrometer 100, controller 108 increases the frequency at which the electrical potential applied to center electrode 302 changes. By decreasing the rate at which the applied potential changes, the rate at which the internal electric field within electrode 302 changes is also decreased. As a result, the selectivity with which ions are ejected from ion trap 104 increases, improving the resolution of spectrometer 100.

In certain embodiments, controller 108 is configured to change the axial electric field frequency or amplitude within ion trap 104 to change the resolution of spectrometer 100. Changing the axial electric field in ion trap 104 can shift the ejection boundary of the ion trap, thereby either extending or reducing the high-mass range of the spectrometer and modifying the resolving power and/or resolution of spectrometer 100.

In some embodiments, controller 108 is configured to increase the resolution of spectrometer 100 by changing a duty cycle of ion source 102. Reducing the ionization time has been observed experimentally to improve resolution in mass spectrometer 100. Thus, by reducing the duration of time during which a bias potential is applied to ion source 102 (e.g., reducing the duty cycle of ion source 102), the resolution of spectrometer 100 can be increased.

Conversely, reducing the resolution of spectrometer 100 can also be useful in certain situations. For example, by increasing the duration of time during which a bias potential is applied to ion source 102 (e.g., increasing the duty cycle of ion source 102), and therefore reducing the duration of time over which the amplitude of the potential applied to electrode 302 of ion trap 104 is increased, the resolution of spectrometer 100 is reduced, but the sensitivity of spectrometer 100 increases, thereby increasing the signal-to-noise ratio of the mass spectral information measured using spectrometer 100. The increased sensitivity can be particularly useful when attempting to detect very low concentrations of certain substances.

In certain embodiments, controller 108 is configured to increase the resolution of spectrometer 100 by increasing the duration of time over which the electrical potential applied to electrode 302 of ion trap 104 is increased. By increasing the sweep duration, circulating ions are ejected more slowly from ion trap 104, increasing the resolution of the measured mass spectral information.

In some embodiments, controller 108 is configured to change the resolution of spectrometer 100 by adjusting the ramp profile associated with the amplitude sweep of the potential applied to electrode 302. The amplitude of the potential applied to electrode 302 typically increases according to a linear ramp function. More generally, however, controller 108 can be configured to increase the amplitude of the potential applied to electrode 302 according to a different ramp profile. For example, the ramp profile can be adjusted by controller 108 so that the applied potential increases according to a series of different linear ramp profiles, each of which represents a different rate of increase of the potential. As another example, the ramp profile can be adjusted so that the amplitude of the potential applied to electrode 302 increases according to a nonlinear function such as an exponential function or a polynomial function.

As discussed above, controller 108 is configured to take any one or more of the above actions to change the resolution of spectrometer 100. The order in which these actions are taken can either be determined by spectrometer 100, or by user selected preferences. For example, in some embodiments, a user of spectrometer 100 can designate which of the above steps, and in which order, controller 108 takes to increase the resolution and/or reduce the power consumption of spectrometer 100. The user selections can be stored as a set of preferences in storage unit 114. Alternatively, in some embodiments, the order of actions taken by controller 108 can be permanently encoded into the logic circuitry of controller 108, or stored as non-modifiable settings in storage unit 114.

In certain embodiments, controller 108 can determine an order of actions based on other considerations. For example, to ensure that spectrometer 100 consumes as little electrical power as possible, the order of actions taken by controller 108 to improve the resolving power of spectrometer 100 can be determined according to increase in power consumption as a result of each action. Controller 108 can be configured with information about how each of the actions disclosed above increases overall power consumption, and can select an appropriate order of actions based on the power consumption information, with actions that cause the smallest increases in power consumption occurring first. Alternatively, controller 108 can be configured to measure the increase in power consumption associated with each of the actions, and can select an appropriate order of actions based on the measured power consumption values.

Although in flow chart 850 adjustments to the configuration of spectrometer 100 are based on the probability that the measured mass spectral information corresponds to known reference information, adjustments to the configuration of spectrometer 100 can also be made based on other criteria. In some embodiments, for example, adjustments to the configuration of spectrometer 100 can be made based on whether or not a target resolution of spectrometer 100 has been achieved. In step 864, controller 108 determines the actual resolution of spectrometer 100 based on the measured mass spectral information (e.g., based on the largest FWHM of a single ion peak within the measurement window of spectrometer 100). In step 866, the actual resolution is compared by controller 108 to a target resolution for spectrometer 100. If the actual resolution is less than the target resolution, then in step 872, controller 108 adjusts the configuration of spectrometer 100, as discussed above, to improve the resolution of the spectrometer.

VIII. Sample Pre-Concentration

Conventional mass spectrometry systems operate at relatively low gas pressures, e.g., at pressures of about $10^{-6}$ Torr or less. When samples are introduced into such systems, the "leak rate" into the system—the rate at which sample molecules/particles and carrier gas molecules enter the system—must be kept low. If the leak rate is too high, the system's pumps cannot maintain the low internal operating pressure, and the quality of measurement results (e.g., signal resolution) suffers accordingly.

To maintain a small leak rate into conventional systems, samples are typically introduced through a flow-limiting device (e.g., a membrane, filter, and/or aperture). The flow-limiting device restricts the flow of sample molecules/particles into the system, so that the system's pumps can maintain the correct operating pressure. In some cases, the flow-limiting device can also act as a filter to restrict certain types of molecules/particles from entering the system (e.g., water molecules).

As a result of using a flow-limiting device, relatively small quantities of sample particles/molecules are introduced into conventional mass spectrometry systems in each analysis cycle. The quantity of particles/molecules that have been introduced is analyzed, and then a further quantity can be introduced (if available). Because relatively small sample quantities are introduced for each cycle, measurement signals are typically relatively weak, and sensitivity is correspondingly low as a result. However, in conventional systems, this compromise typically occurs so that the low operating pressure can be maintained.

The compact, high pressure mass spectrometry systems disclosed herein do not operate at the low pressures of conventional systems. Moreover, the internal volumes of these compact systems are much smaller (e.g., about 10 $cm^3$ or less) than the internal volumes of conventional systems. As a result, the leak rate into such systems due to sample introduction can be significantly higher than in conventional systems. Following sample introduction into the system, the operating pressure is re-established relatively rapidly by the pressure regulation subsystem, because the operating pressure is significantly higher than in conventional systems, and because the internal volume of the system is considerably smaller than in conventional systems.

Because the operating pressure can be re-established relatively quickly following sample introduction, larger quantities of a sample (e.g., even the entire sample) can be introduced at once into the compact mass spectrometry systems disclosed herein. That is, for each analysis cycle, a larger quantity of sample particles/molecules can be introduced into the systems disclosed herein, compared to conventional mass spectrometry systems. With a larger quantity of sample undergoing analysis, the ion signals measured by the detector are larger in magnitude. As a result, the sensitivity of the systems disclosed herein is increased due to the larger quantity of sample that is introduced in each analysis cycle.

In general, the concentration of sample molecules/particles by adsorbing the molecules/particle on an adsorbent material occurs more efficiently at higher pressures (e.g., the ambient pressure external to a mass spectrometry system) than at the significantly reduced operating pressures common within conventional mass spectrometry systems. In the systems and methods disclosed herein, which have operating pressures that are significantly higher than in conventional systems, the operating pressure can be re-established relatively quickly following sample introduction, as discussed above. Consequently, in some embodiments disclosed herein, the pre-concentrator and the core components (e.g., ion trap, ion source, ion detector) are connected along a common gas path, with no flow rate-limiting device present between the pre-concentrator and the core components. As a result, when adsorbed molecules/particles are desorbed within the pre-concentrator, the desorption occurs at a pressure lower than the ambient pressure external to the systems, i.e., approximately the same pressure as in the gas path, typically between 100 mTorr and 10 Torr.

Performing desorption of particles/molecules at pressures that are less than ambient atmospheric pressure provides a significant advantage to the systems and methods disclosed herein. At reduced pressure, the vapor/condensed phase equilibrium of the adsorbed molecules/particles is shifted towards the vapor phase, as is well known for example from the Clausium-Clapeyron equation. This principle explains, for example, why water boils even at room temperature if placed in a sufficiently low pressure vessel (i.e., at sufficiently low pressure, water preferentially exists as a vapor rather than a liquid, even at room temperature). By performing the desorption at pressures less than the ambient pressure, adsorbed molecules/particles are also shifted toward the vapor phase, leading to more efficient release from the adsorbent material than at ambient pressure.

Further, because the molecules/particles are shifted toward the vapor phase, desorption can occur at a significantly lower temperature than the temperature at which desorption would otherwise occur at ambient pressure. As a result, the adsorbent material onto which the molecules/particles are adsorbed is not heated to as high a temperature to cause desorption, which significantly reduces the power consumption of the systems and methods disclosed herein. Moreover, for a fixed quantity of power used to heat the adsorbent material, the reduced heating requirements allow a larger amount of sample molecules/particles to be concentrated and then desorbed.

For compact mass spectrometry systems that rely on batteries for operating power, the reduction in power consumption discussed above can be a critical advantage of the systems and methods disclosed herein relative to conventional mass spectrometry systems. In conventional mass spectrometry systems, concentrating sample particles/molecules at elevated pressures (e.g., ambient pressure) and then desorbing the particles/molecules at reduced pressure (e.g., the internal operating pressure of the systems) generally does not occur, because the time required to reduce the pressure around the adsorbent material from an elevated pressure (e.g., atmospheric pressure) to the reduced operating pressure (e.g., $10^{-6}$ Torr or less) is too long to make analysis practical. In contrast, the relatively high internal operating pressures and relatively low internal volumes of the systems disclosed herein make it possible for desorption to occur at approximately the same pressure (e.g., reduced relative to ambient pressure) as the operating pressure of the systems, so that significant reductions in power consumption can be realized as discussed above.

In some embodiments, aerosols and other samples that include gas molecules, suspended liquid droplets, and/or suspended solid particulates (collectively referred to in the following sections as "sample particles") can be introduced into the systems disclosed herein directly through inlet 124. That is, pressure regulation subsystem 120 establishes a gas pressure within system 100 that is less than atmospheric pressure, and the pressure differential between the internal volume of system 100 and the environment outside of spectrometer 100 causes sample particles to flow into system 100 through inlet 124.

In general, sample particles enter inlet 124 in this manner in low concentrations, and direct analysis of the sample particles at such concentrations leads to low-magnitude ion signals. The magnitudes of the measured ion signals can be increased by pre-concentrating the sample particles, so that a higher-concentration sample is introduced into system 100.

Figure 7:
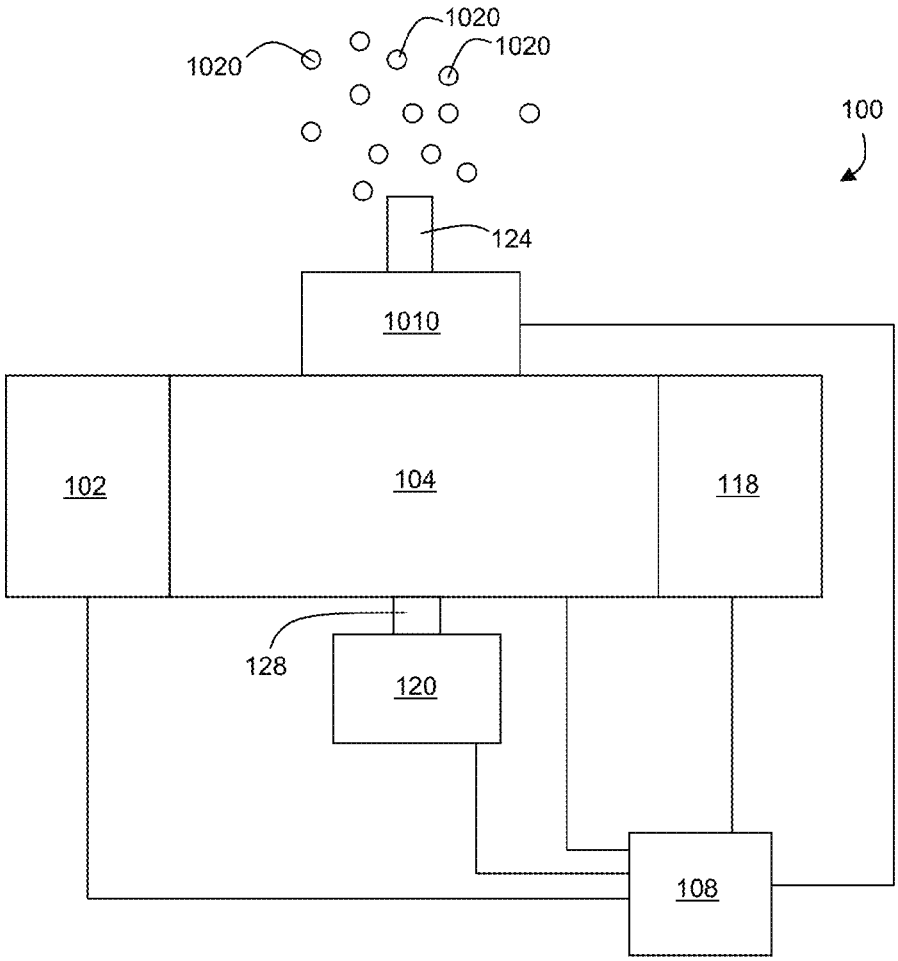
FIG. 7 is a schematic diagram of an embodiment of a mass spectrometry system that includes a sample pre-concentrator.

FIG. 7 shows a schematic diagram of a portion of a mass spectrometry system 100. In addition to an ion source 102, an ion trap 104, an ion detector 118, and a pressure regulation subsystem 120, system 100 includes an inlet 124 connected to a sample pre-concentrator 1010. Pre-concentrator 1010 is connected to controller 108 via a control line. In general, system 100 can also include any of the other components shown and discussed in connection with the other embodiments herein.

During operation of system 100, sample particles 1020 are drawn into inlet 124 due to the pressure difference between the interior volume of system 100 (e.g., the pressure within gas path 128) and the environment external to system 100. Sample particles enter inlet 124 and pass through pre-concentrator 1010 before they are introduced into ion trap 104. Pre-concentrator 1010 concentrates the sample particles so that when they are introduced into ion trap 104, they concentration of the sample particles is increased, relative to their spatial concentration before entering inlet 124.

By using pre-concentrator 1010, in some embodiments, sample particles 1020 can be drawn into inlet 124 continuously during operation of system 100. As the sample particles enter inlet 124, they are concentrated in pre-concentrator 1010. After a concentration interval, the accumulated sample particles are introduced into ion trap 104 from pre-concentrator 1010 for analysis. The, additional sample particles 1020 begin to accumulate within pre-concentrator 1010, in preparation for a subsequent introduction into ion trap 104 after the next concentration interval is complete.

Figure 8:
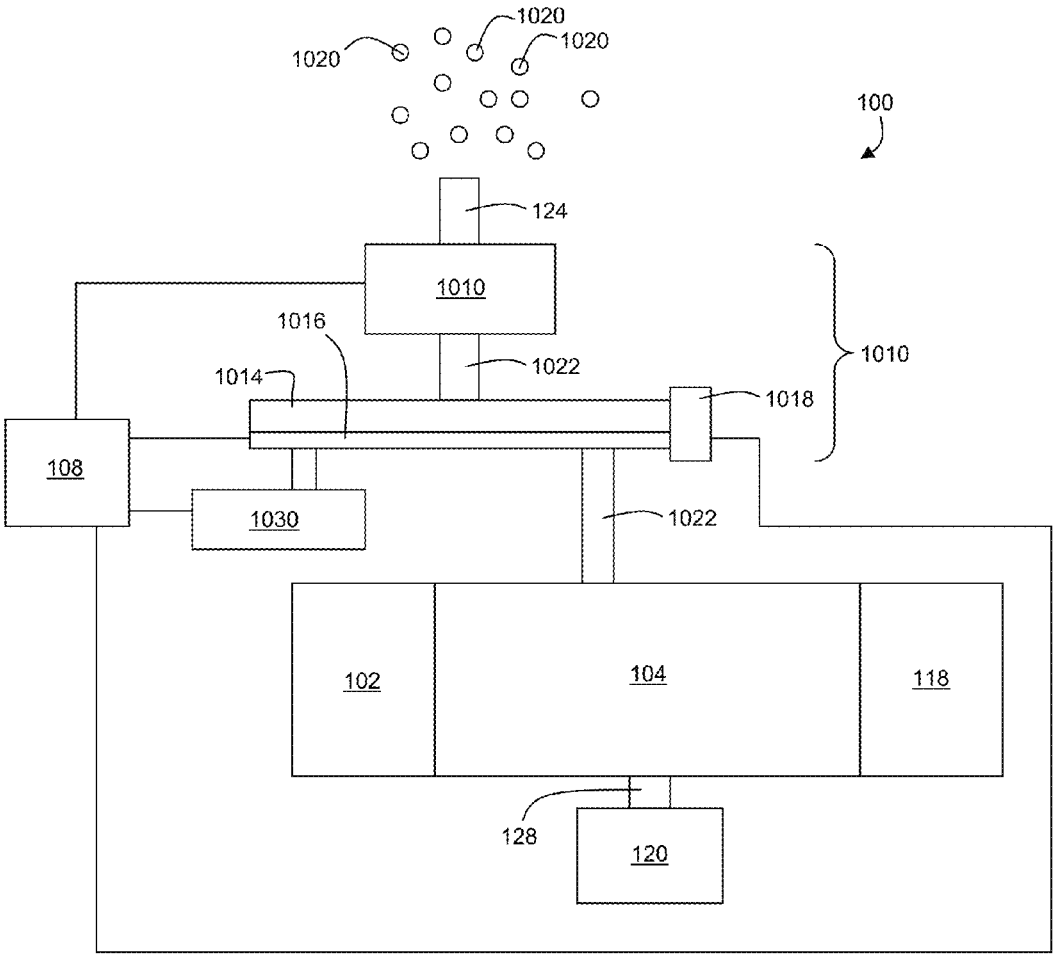
FIG. 8 is a schematic diagram of another embodiment of a mass spectrometry system that includes a sample pre-concentrator.

A variety of different pre-concentrators can be implemented in system 100. FIG. 8 is a schematic diagram showing an embodiment of pre-concentrator 1010. Pre-concentrator 1010 includes an inertial impactor 1012 (also referred to as a cascade impactor), a sorbent bed 1014, a heater 1016, and an actuator 1018. A continuous gas flow path extends from inlet 124 through inertial impactor 1012, conduit 1022 (which can optionally include a valve), sorbent bed 1014, heater 1016, and conduit 1024. Sample particles leaving pre-concentrator 1010 through conduit 1024 enter ion trap 104 of system 100.

During operation, air that includes sample particles 1020 is drawn into inlet 124 and enters inertial impactor 1012. The sample particles are filtered by inertial impactor 1012, which effectively functions as a size filter, allowing particles up to a certain size to pass, while trapping larger particles. Thus, inertial impactor 1012 allows selective filtering so that particles of interest (as determined by particle size) are passed into system 100 for analysis, while larger particles that are not of interest are rejected.

To filter the incoming particle stream, inertial impactor 1012 implements a convoluted gas flow path that prevents larger particles from passing all the way through the gas path due to their inability to navigate all of the turns in the path. Filtering by inertial impactor 1012 is primarily effective for streams of solid particulates. If the sample particles are single gas molecules, the molecules pass directly through inertial impactor 1012 and are not trapped. In some embodiments, for example, inertial impactor 1012 is configured to allow solid particles of diameter 10 microns or less (e.g., 8 microns or less, 6 microns or less, 4 microns or less, 3 microns or less, 2 microns or less, 1 micron or less) to pass through, while trapping larger particles.

Figure 9:
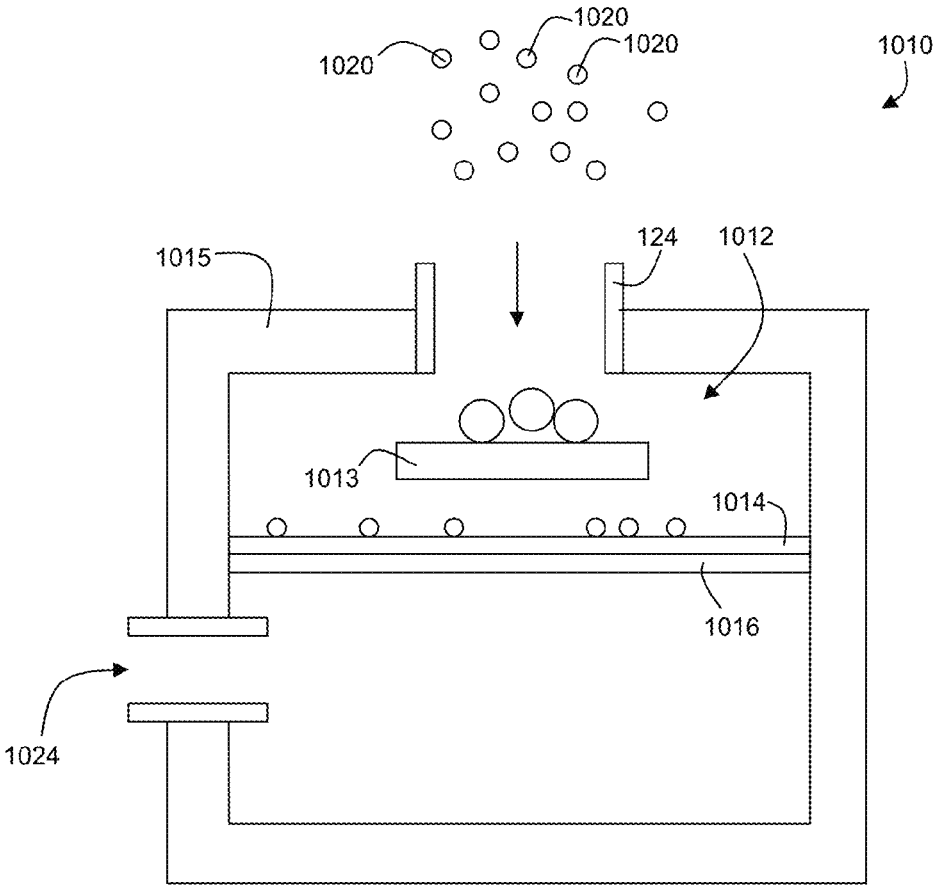
FIG. 9 is a schematic diagram of an embodiment of a sample pre-concentrator.

FIG. 9 shows a cross-sectional diagram of an embodiment of pre-concentrator 1010. Pre-concentrator 1010 is enclosed by a housing 1015. Sample particles 1020 enter inlet 124. Particles larger than a cutoff size contact impaction ring 1013 and are trapped on the ring. Particles smaller than the cutoff size pass through the channel between impaction ring 1013 and the upper wall of housing 1015, and are adsorbed on sorbent bed 1014. After pre-concentration, the adsorbed particles are liberated from sorbent bed 1014 and leave pre-concentrator 1010 through conduit 1024.

Referring again to FIG. 8, after passing through inertial impactor 1012, sample particles are adsorbed onto sorbent bed 1014. Sorbent bed 1014 includes one or more layers of adsorbent material such as activated carbon particles. Sample particles 1020 adsorb onto the surface of the adsorbent material, where intermolecular forces (e.g., dipole-dipole forces, van der Waals forces) ensure that the sample particles remain adsorbed.

As more sample particles 1020 pass through inertial impactor 1012, the particles accumulate on sorbent bed 1014. Accumulation of the particles on sorbent bed 1014 continues for a concentration interval. In some embodiments, for example, the concentration interval is between 5 seconds and 30 minutes (e.g., between 10 seconds and 20 minutes, between 20 seconds and 20 minutes, between 30 seconds and 20 minutes, between 5 seconds and 10 minutes, between 5 seconds and 5 minutes, between 5 seconds and 3 minutes, between 5 seconds and 2 minutes, between 5 seconds and 1 minute).

Adsorption of sample particles 1020 onto sorbent bed 1014 typically occurs at pressures equal to, or elevated relative to, the internal operating gas pressure within any one or more of ion trap 104, ion source 102, detector 118, and more generally, gas path 128 (e.g., an internal operating gas pressure of between 100 mTorr and 10 Torr), and consequently, elevated relative to the gas pressure in sorbent 1014 during desorption. In some embodiments, adsorption of sample particles 1020 onto sorbent bed 1014 occurs at pressures that are larger than atmospheric pressure, to increase the efficiency of concentration of sample particles. For example, adsorption of sample particles 1020 onto sorbent bed 1014 can occur at a gas pressure of 150 mTorr or more (e.g., 200 mTorr or more, 300 mTorr or more, 500 mTorr or more 1 Torr or more, 5 Torr or more, 10 Torr or more, 20 Torr or more, 50 Torr or more, 100 Torr or more, 200 Torr or more, 500 Torr or more, 760 Torr or more, 1000 Torr or more, 1500 Torr or more, 2000 Torr or more, 3000 Torr or more, 4000 Torr or more).

At the end of the concentration interval, adsorbed particles on sorbent bed 1014 are desorbed from the sorbent bed and flow into ion trap 104 via conduit 1024. To de-sorb the particles, controller 108—which is connected to heater 1016—activates heater 1016. Heater 1016 increases the temperature of the sorbent material of sorbent bed 1014, transferring heat to the adsorbed sample particles. Adsorbed sample gas molecules are re-vaporized when heated, and readily flow through sorbent bed 1014 and heater 1016, leaving through conduit 1024. Adsorbed solid particulates essentially sublime to gas molecules when heated, and also leave through conduit 1024.

In this manner, a concentrated quantity of sample particles is delivered to ion trap 104. Because the concentration of sample particles within a particular gas volume is significantly larger than in the environment external to system 100, ion signals generated by the sample particles are significantly increased in magnitude. As a result, the sensitivity of system 100 to the sample (i.e., the reliability with which the sample can be detected) is significantly improved.

In certain embodiments, the entire quantity of adsorbed sample particles is introduced into ion trap 104 through conduit 1024 without passing the sample particles through a membrane, a valve, a filter, a narrowing aperture, or another flow rate-limiting element. As discussed above, in conventional mass spectrometry systems, the particle stream entering the system is flow rate-limited because in conventional systems, a low operating pressure must be maintained. In the systems disclosed herein, which operate at considerably higher pressures and have much smaller internal volumes, the particle stream is not flow rate-limited as it enters ion trap 104 (or, alternatively, ion source 102, or detector 118, or gas path 128). While the particle stream can be delivered without passing through a flow rate-limiting element at any operating gas pressure of system 100, this method of sample introduction is particularly effective at operating gas pressures of 1 Torr or more, as the time required for pressure regulation subsystem 120 to re-establish the operating gas pressure within system 100 following sample introduction is particularly short.

Because the adsorbed sample particles are introduced without passing the particles through a flow rate-limiting device, the gas pressure within sorbent bed 1014 and ion trap 104 (or, alternatively, ion source 102, or detector 118, or gas path 128) can be the same (e.g., isobaric operation), or differ by only a very small amount. That is, desorption of the sample particles/molecules from sorbent bed 1014 within pre-concentrator 1010 can occur at gas pressures approximately equal to, or differing by only a small amount from, the operating gas pressure within any one or more of ion trap 104, ion source 102, detector 118, and/or gas path 128. For example, in some embodiments, the gas pressures can differ by 50 mTorr or less (e.g., 30 mTorr or less, 20 mTorr or less, 10 mTorr or less, 5 mTorr or less) during desorption of the sample particles/molecules.

As explained above, by performing desorption at reduced pressure (e.g., at a pressure reduced relative to atmospheric pressure, such as the operating gas pressure within ion trap 104, ion source 102, detector 118, and/or gas path 128), sample particles/molecules are more efficiently desorbed, due to the shift of the particles/molecules toward favoring the vapor phase. This results in a significant reduction of power consumption during desorption, and for a fixed quantity of power, allows a larger amount of sample particles/molecules to be desorbed. Due to the time required to re-establish their internal operating gas pressures, conventional mass spectrometry systems generally do not concentrate sample particles/molecules on an adsorbent bed at high pressures, and then desorb the particles/molecules at the reduced operating pressure of the system, because it takes too long to reduce the pressure within the desorption chamber from the adsorption pressure to the reduced operating pressure of the system for measurements to be practical.

Introducing the entire quantity of adsorbed sample particles without using a flow rate-limiting device can provide another important advantage. When the flow of molecules/particles into ion trap 104 is restricting, "plating out" or deposition of the molecules/particles around the flow rate-limiting device can occur, contaminating the interior of the system and providing fewer molecules/particles for analysis. By rapidly introducing the entire quantity of sample particles/molecules at once without restricting the flow into ion trap 104, plating out is significantly reduced and even largely eliminated.

To prevent plating out of the molecules/particles, in some embodiments, conduit 1024 can also be heated by a heating element. Heating conduit 1024 reduces the likelihood that molecules/particles in the vapor phase, desorbed from sorbent bed 1014, will plate out in the conduit, and also reduces that likelihood that the molecules/particles will plate out in ion trap 104, as the temperature of the molecules/particles remains elevated. Further, in certain embodiments, a trap connected to conduit 1024 can be used to remove lower temperature molecules/particles from the flowing stream through the conduit, so that the stream of molecules/particles that enters ion trap 104 includes higher temperature molecules/particles which are less likely to plate out.

For example, in the systems and methods disclosed herein, the gas particle stream from pre-concentrator 1010 into ion trap 104 (or ion source 102, or detector 118, or more generally, gas path 128)—which generally includes both desorbed sample particles from sorbent bed 1014 and molecules of air gases—flows at a rate of 100 mL/min. or more (e.g., 500 mL/min. or more, 750 mL/min. or more, 1.0 L/min. or more, 3.0 L/min. or more, 5.0 L/min. or more, 7.5 mL/min. or more, 10.0 L/min. or more).

A relatively large quantity of adsorbed sample particles can be desorbed and introduced into ion trap 104 over a relatively short period of time. For example, in some embodiments, 10 picograms or more of sample particles (e.g., 100 picograms or more, 500 picograms or more, 1.0 nanogram or more, 10 nanograms or more, 100 nanograms or more, 500 nanograms or more, 1.0 microgram or more, 10 micrograms or more, 100 micrograms or more, 500 micrograms or more, 1.0 milligram or more) are desorbed and introduced into ion trap 104 (or ion source 102, or detector 118, or gas path 128) over an interval of between 1 second and 30 seconds (e.g., between 1 second and 20 seconds, between 5 seconds and 30 seconds, between 5 seconds and 20 seconds, between 1 second and 15 seconds, between 5 seconds and 15 seconds, between 1 seconds and 10 seconds, between 5 seconds and 10 seconds).

Once introduced into ion trap 104 or ion source 102 or detector 118 (or more generally, gas path 128), system 100 typically ionizes the introduced sample particles and measures corresponding ion signals within a relatively short period of time. In some embodiments, for example, the ionization and measurement of signals corresponding to sample particles is performed by system 100 within 10 s or less (e.g., 8 s or less, 6 s or less, 5 s or less, 4 s or less, 3 s or less, 2 s or less).

In FIG. 8, a flow pump 1030 forms a fluid connection to sorbent bed 1014, conduit 1022, inertial impactor 1012, and inlet 124. Flow pump 1030 draws in air and sample particles 1020 into inlet 124 and through inertial impactor 1012 by reducing the pressure in sorbent bed 1014, conduit 1022, inertial impactor 1012, and inlet 124, relative to the environmental pressure outside system 100. In general, the flow rate of air and sample particles 1020 into inlet 124 is higher than the flow rate of desorbed molecules from sorbent bed 1014 into conduit 1024.

As shown in FIG. 8, in some embodiments, sampling pump 1030 provides the flow of air and sample particles into pre-concentrator 1010, which another pump (e.g., pressure regulation subsystem 120) provides the reduced pressure that leads to flow of desorbed molecules from sorbent bed 1014 into ion trap 104. In certain embodiments, pressure regulation subsystem 120 performs both functions, and forms a first fluid connection to sorbent bed 1014 through gas path 128 and ion trap 104, as shown in FIG. 8, and a second fluid connection directly with sorbent bed 1014, conduit 1022, inertial impactor 1010, and inlet 124 (in the same manner as flow pump 1030 in FIG. 8).

In general, sampling pump 1030 or pressure regulation subsystem 120 draws a high volume of gas (e.g., air and sample particles) into inlet 124 during operation. In certain embodiments, for example, the flow volume is 0.5 L/min. or more (e.g., 1.0 L/min. or more, 3.0 L/min. or more, 5.0 L/min. or more, 6.0 L/min. or more, 7.0 L/min. or more). By using a larger flow rate, even relatively diffuse (i.e., low concentration) samples external to system 100 can be concentrated and analyzed.

In some embodiments, the flow rate of desorbed gas molecules from sorbent bed 1014 through conduit 1024 and into ion trap 104 is less than the flow rate into inlet 124. For example, the flow rate into ion trap 104 can be 2.0 L/min. or less (e.g., 1.5 L/min. or less, 1.0 L/min. or less, 0.5 L/min. or less).

When using high pressure mass spectrometry systems for environmental sensing, two types of detection scenarios are common. In some circumstances, systems are used to monitor low level concentrations of airborne substances over long periods of time. These scenarios correspond, for example, to workplace exposure to low levels of contaminants or other substances. In certain circumstances, systems are used to rapidly detect high concentrations of substances, such as when a chemical spill or emission occurs.

The analysis timescale for these types of detection scenarios differs markedly. In the first, a sample might be pre-concentrated for a period of several minutes, and then desorbed and analyzed over a period of about 10 seconds or less. In the second, a sample might be pre-concentrated for a period of 1 minute or less before it is desorbed and analyzed over a period of about 10 seconds or less.

Figure 10:
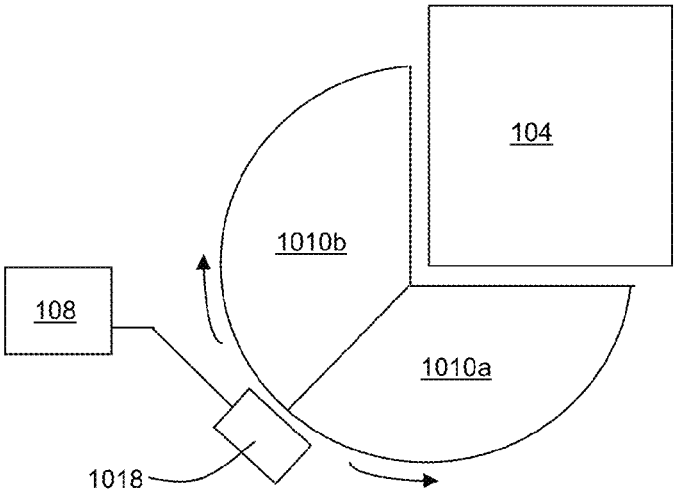
FIG. 10 is a schematic diagram of an embodiment of a mass spectrometry system that includes two sample pre-concentrators.

To allow for concurrent analyses to be performed on both short and long time scales, in some embodiments, the pre-concentrators disclosed herein implement a dual channel structure. FIG. 10 is a schematic diagram showing a mass spectrometry system that includes two pre-concentrators 1010*a* and 1010*b*, each of which can be rotated into position by actuator 1018 (also shown in FIG. 8), which is coupled to controller 108, so that each pre-concentrator can form a fluid connection to ion trap 104 (or ion source 102, or detector 118, or more generally, gas path 128) and direct desorbed sample particles into ion trap 104.

In systems with two or more pre-concentrators, analysis can occur on both short and long time scales as discussed above. For example, during a first analysis time, pre-concentrator 1010*a* is positioned in fluid contact with sampling pump 1030, and sample molecules/particles are swept through the inertial impactor of pre-concentrator 1010*a* and adsorbed onto the sorbent bed of pre-concentrator 1010*a*. At the same time, pre-concentrator 1010*b* is positioned in fluid connection with ion trap 104, and adsorbed sample particles on the sorbent bed of pre-concentrator 1010*b* are desorbed and introduced into ion trap 104.

Then, pre-concentrator 1010*a* is rotated to form a fluid connection with ion trap 104 (and to sever the fluid connection with sampling pump 1030) and pressure regulation subsystem 120 by actuator 1018. Sample particles adsorbed onto the sorbent bed of pre-concentrator 1010*a* are desorbed and introduced into ion trap 104. At the same time, pre-concentrator 1010*b* is rotated into position to form a fluid connection with sampling pump 1030, and sample molecules/particles are swept through the inertial impactor of pre-concentrator 1010*b* and adsorbed onto the sorbent bed of pre-concentrator 1010*b*.

In the above manner, the two pre-concentrators can be connected to sampling pump 1030 for different amounts of time to implement sample collection over the different time scales discussed above. While adsorbed sample particles in one pre-concentrator are desorbed, ionized, and analyzed, sample molecules/particles are being adsorbed within the other pre-concentrator. As a consequence, system 100 can collect sample molecules/particles nearly continuously. Note that in the foregoing and subsequent discussions, system 100 is described as having a sampling pump 1030 and, separately, a pressure regulation subsystem 120. However, it should be understood that the discussion applies as well to embodiments with only a pressure regulation subsystem 120, where subsystem 120 provides both the reduced pressure environment to sweep in sample molecules/particles through inlet 124 and the pre-concentrators, and the reduced pressure environment to introduce desorbed sample particles into ion trap 104, through two separate fluid connections.

In FIG. 10 (and in several additional figures), system 100 is shown with two pre-concentrators for purposes of discussion. However, the systems and methods disclosed herein are not limited to the use of only one or two pre-concentrators. Instead, the systems and methods disclosed herein can use any number of pre-concentrators (e.g., three, four, five, six, eight, ten, or even more than 10). Each of the pre-concentrators can share certain components among some or all of the pre-concentrators. Alternatively, each of the pre-concentrators can function as a stand-alone component, sharing no components in common with the other pre-concentrators.

Figure 11:
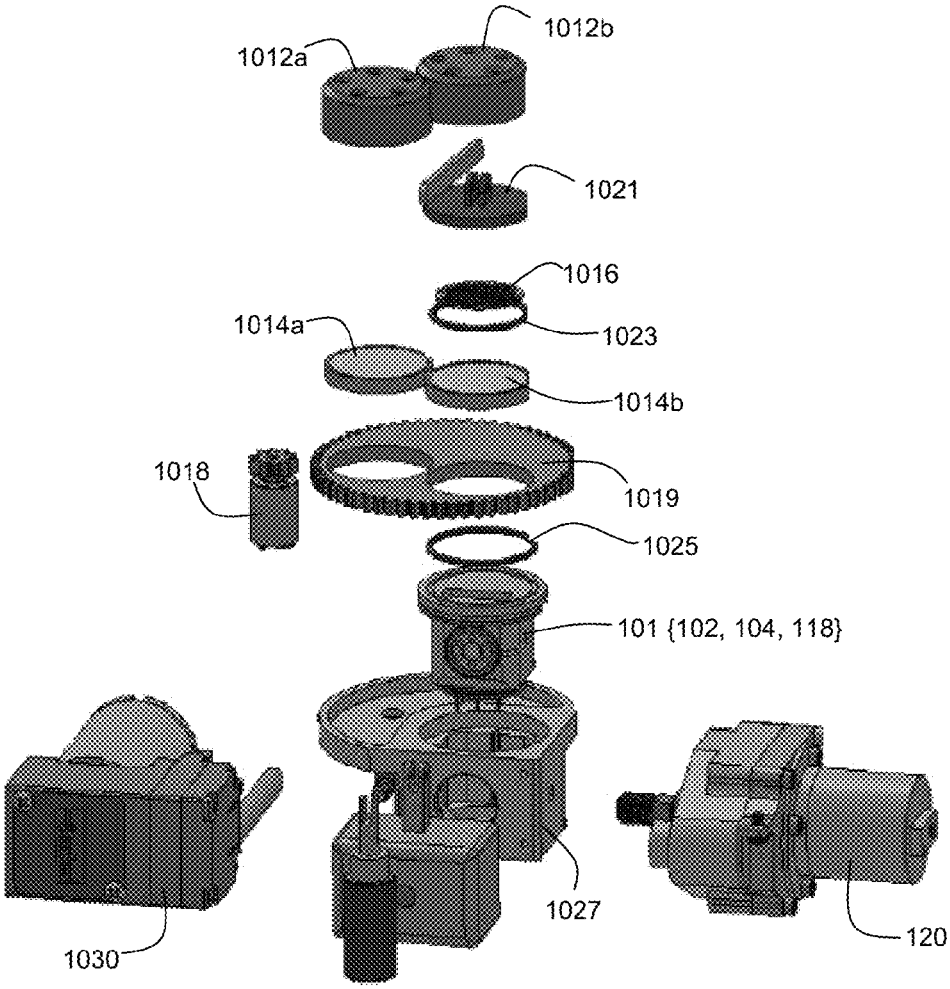
FIG. 11 is a schematic, exploded view of an embodiment of a sample pre-concentrator that includes two sorbent beds.

FIG. 11 shows a schematic, exploded view of a system with two pre-concentrators. The system of FIG. 11 includes two inertial impactors 1012*a* and 1012*b*, a heater cover 1021, a heater 1016, a sealing ring 1023, two sorbent beds 1014*a* and 1014*b*, an actuator 1018 and cooperating rotation frame 1019, and a second sealing ring 1025. Sampling pump 1030 is directly connected to sorbent beds 1014*a* or 1014*b* as described above, while pressure regulation subsystem 120 is connected to a core unit that includes ion source 102, ion trap 104, and detector 118 through a manifold 1017, also as described above.

During operation of the system shown in FIG. 11, when a particular sorbent bed 1014*a* or 1014*b* is rotated into fluid connection with the core unit, heater cover 1021 clamps down onto heater 1016, sealing ring 1023, and the sorbent bed, establishing an air-tight seal between the heater, the sorbent bed, and the core unit. Pressure regulation subsystem maintains the gas pressure within the entire internal volume between heater cover 1021 and the core unit, and sample particles that are desorbed from the sorbent bed aligned with the core unit are swept into the core unit for analysis.

In FIG. 11, the system includes two inertial impactors 1012*a* and 1012*b*. In some embodiments, the system includes only a single inertial impactor that is shared between two sorbent beds 1014*a* and 1014*b*. When one of the sorbent beds is rotated to form a fluid connection with sampling pump 1030, the sorbent bed also forms a fluid connection with the inertial impactor.

Figure 12:
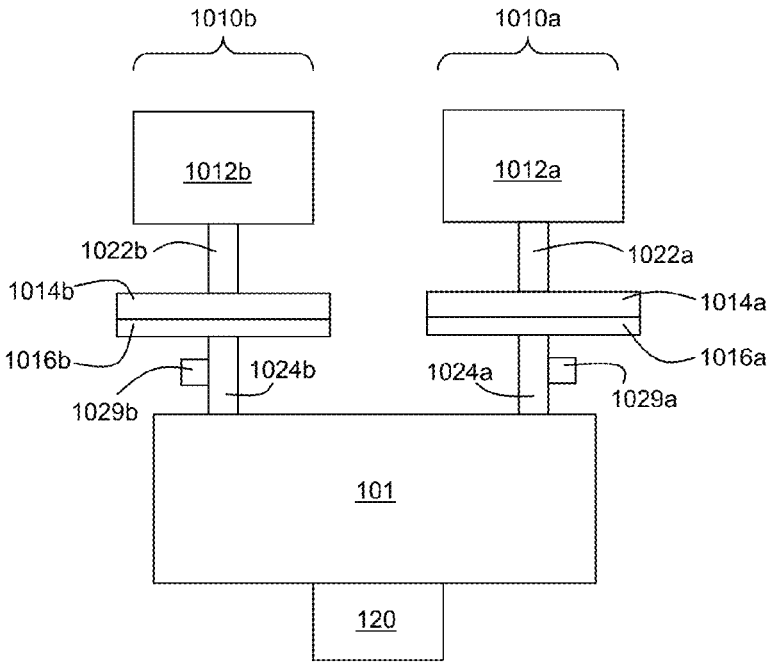
FIG. 12 is a schematic diagram of another embodiment of a sample pre-concentrator that includes two sorbent beds.

FIG. 12 is a schematic diagram of another embodiment of a system with two pre-concentrators 1010*a* and 1010*b*. Each pre-concentrator includes a separate inertial impactor (1012*a* and 1012*b*), sorbent bed (1014*a* and 1014*b*), heater (1016*a* and 1016*b*), and conduits (1022*a* and 1024*a*, and 1022*b* and 1024*b*). During operation of the system, one of the pre-concentrators collects and concentrates sample particles, while the other pre-concentrator desorbs sample particles and introduces the particles into core unit 101, which includes ion source 102, ion trap 104, and detector 118. Valves 1029*a* and 1029*b*, connected to controller 108 (not shown for clarity), can be independently opened and closed to connect one concentrator to core unit 101, and the other concentrator to sampling pump 1030 (also not shown for clarity).

Figure 13:
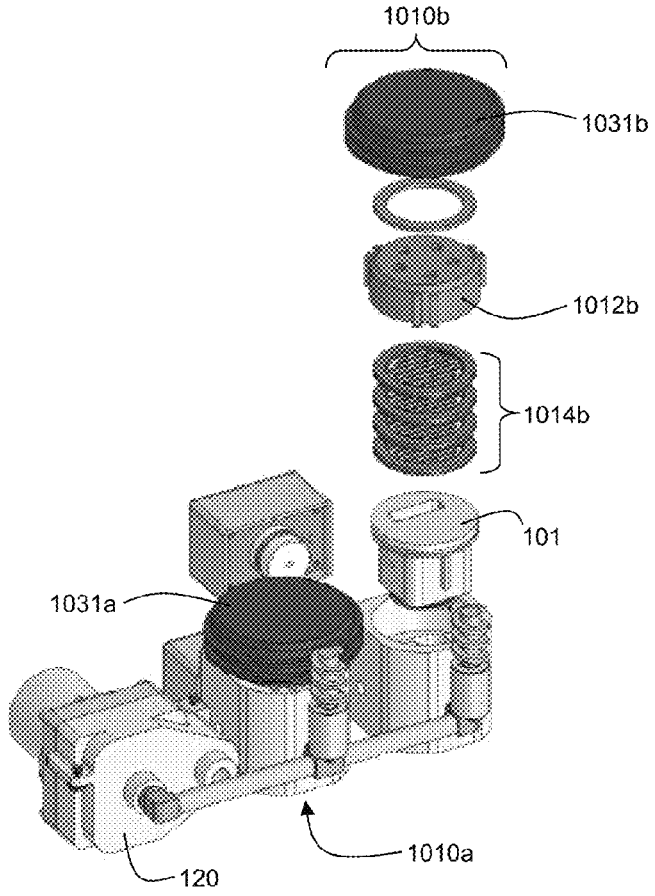
FIG. 13 is a schematic, exploded view of another embodiment of a sample pre-concentrator that includes two sorbent beds.

FIG. 13 is a schematic, exploded view of the system of FIG. 12. The two pre-concentrators are side-by-side in FIG. 13. A common pressure regulation subsystem 120 is coupled to both pre-concentrators, and provides a reduced pressure environment both for drawing in sample molecules/particles for collection and concentration, and for introducing desorbed sample particles into core unit 101.

Each pre-concentrator in FIG. 13 includes an impactor cap 1031*a* or 1031*b*. To introduce sample molecules/particles into either pre-concentrator, the corresponding impactor cap is raised, which opens the corresponding inertial impactor to the external environment. Sample particles/molecules enter the inertial impactor due to the pressure difference between the interior of the impactor and the external environment, as discussed above. Once collection of the sample molecules/particles is complete, the impactor cap is lowered and desorption and analysis of the adsorbed particles occurs. As described above, during operation, one of the pre-concentrators is generally collecting and concentrating sample particles, while the other pre-concentrator is introducing desorbed sample particles into core unit 101, so the system is nearly continuously collecting and analyzing sample molecules/particles.

Figure 14A:
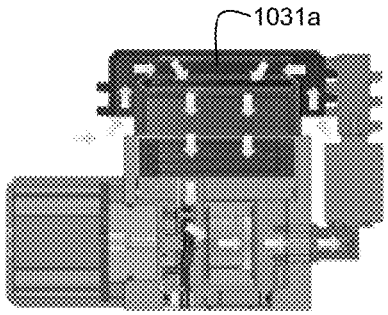
FIGS. 14A and 14B are schematic diagrams of embodiments of a sample pre-concentrator with an inertial impactor cap raised and lowered, respectively.
Figure 14B:
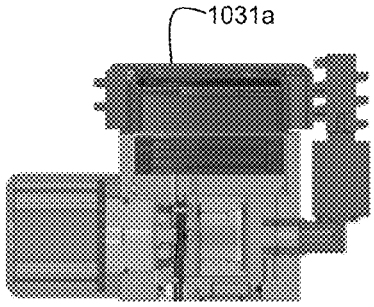

FIGS. 14A and 14B are schematic diagrams illustrating the raising and lowering of impactor cap 1031*a* during operation of pre-concentrator 1010*a*. In FIG. 14A, cap 1031*a* is raised, allowing sample particles/molecules to enter inertial impactor 1010*a* along the directions of the arrows. In FIG. 14B, cap 1031*a* is lowered, preventing sample particles/molecules from entering pre-concentrator 1010*a*.

Although the systems discussed above include an inertial impactor with an impactor cap, other alternatives are also possible. In some embodiments, for example, the systems can include a cyclonic separator for performing size filtering of incoming sample particles/molecules. The cyclonic separator—like the inertial impactor—allows sample particles/molecules smaller than a particular size to pass through, and traps particles/molecules larger than the particular size. As with the inertial impactors discussed above, cyclonic separators are particularly useful for samples that include solid particulates (e.g., aerosols).

Figure 15:
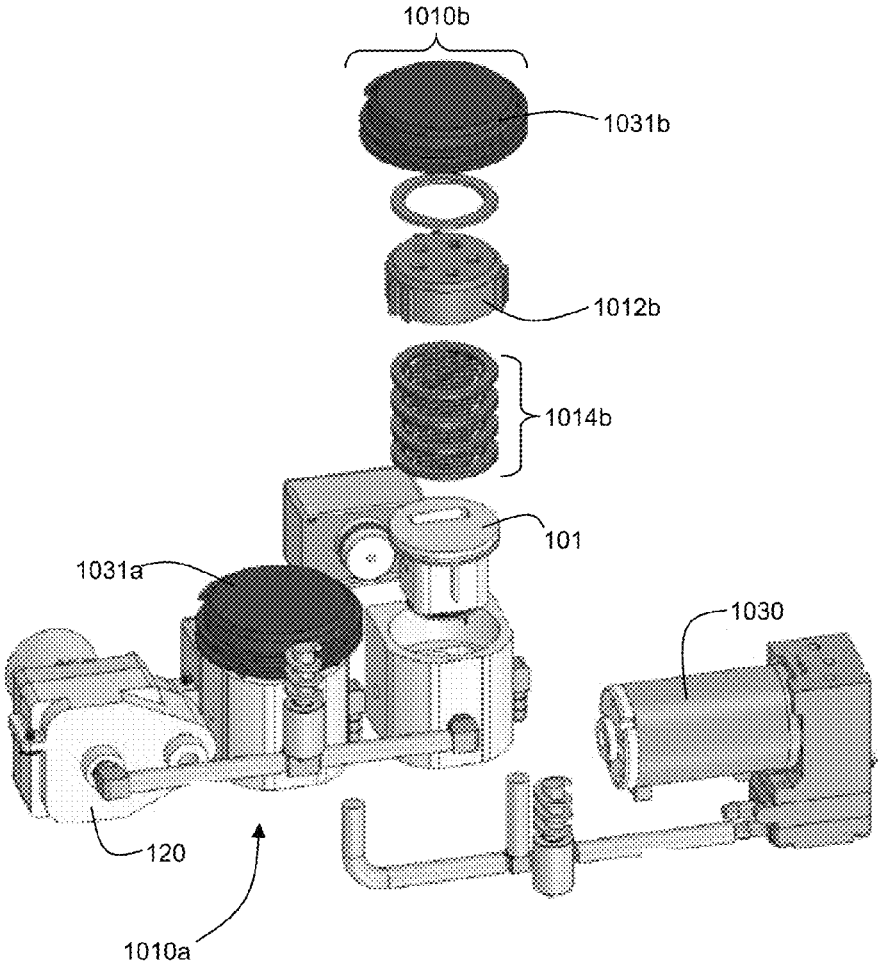
FIG. 15 is a schematic, exploded view of another embodiment of a sample pre-concentrator that includes two sorbent beds.

As discussed above, in some embodiments, the systems disclosed herein can include both a sampling pump 1030 and a pressure regulation subsystem 120. FIG. 15 is a schematic, exploded view of a system that is similar to the system of FIG. 13. In FIG. 15, however, the system includes a separate sampling pump 1030 and pressure regulation subsystem 120. Pressure regulation subsystem 120 is coupled to core unit 101 and, by controlling the pressure within core unit 101, regulates the flow of desorbed sample particles from the pre-concentrator (i.e., 1010*a* or 1010*b*) that is coupled to core unit 101 at a particular time. Sampling pump 1030, at the same time, is coupled to the other pre-concentrator, and controls the pressure within the pre-concentrator's inertial impactor to cause inflow of sample molecules/particles and concentration of the molecules/particles on the pre-concentrator's sorbent bed.

Figure 16:
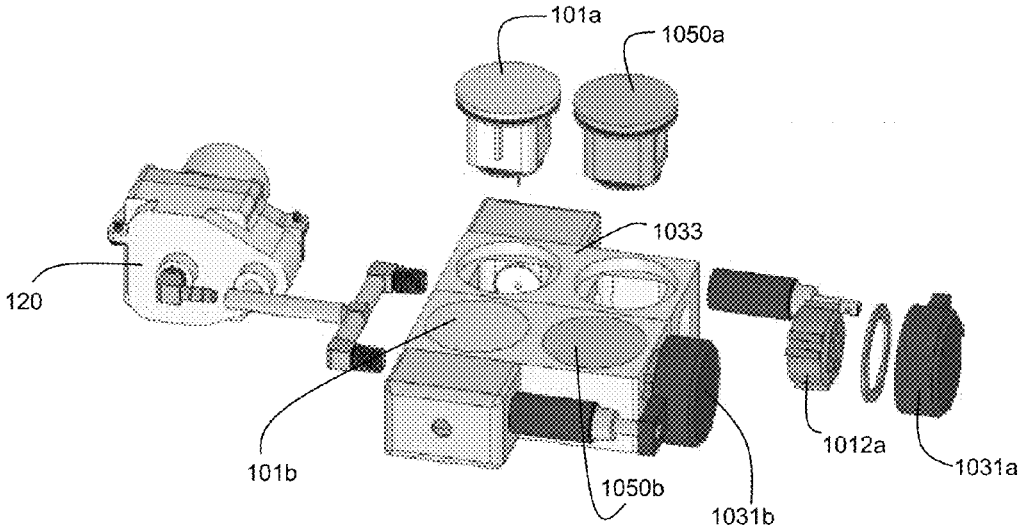
FIG. 16 is a schematic, exploded view of an embodiment of a sample pre-concentrator that includes a removable pre-concentrator unit.

FIG. 16 is a schematic, exploded view of another embodiment of a system with two pre-concentrators 1010*a* and 1010*b*. Various components of the system in FIG. 16 are similar to components of other systems described herein, and so there descriptions will not be repeated. In FIG. 16, the system includes two separate core units 101*a* and 101*b*, each of which features an ion source, an ion trap, and an ion detector. Further, each pre-concentrator features a pre-concentrator unit 1050*a* and 1050*b* in fluid connection with the corresponding core unit 101*a* or 101*b*. Each pre-concentrator unit is insertable and removable from housing 1033, permitting easy replacement and specific selection of both a core unit and a pre-concentrator unit for particular applications. Pressure regulation subsystem 120 is connected to both cores 101*a* and 101*b* and pre-concentrators 1010*a* and 1010*b*, although in some embodiments, as discussed above, separate sampling pumps and pressure regulation subsystems can be used.

As discussed above, to collect and concentrate sample molecules/particles using one of the two pre-concentrators, the pre-concentrator's cap 1031*a* or 1031*b* is raised to allow sample molecules/particles to enter the pre-concentrator. During this time, adsorbed particles on the sorbent bed of the other pre-concentrator (i.e., within the other pre-concentrator's pre-concentration unit 1050*a* or 1050*b*) are desorbed and introduced into the corresponding core unit 101*a* or 101*b*.

Figure 17:
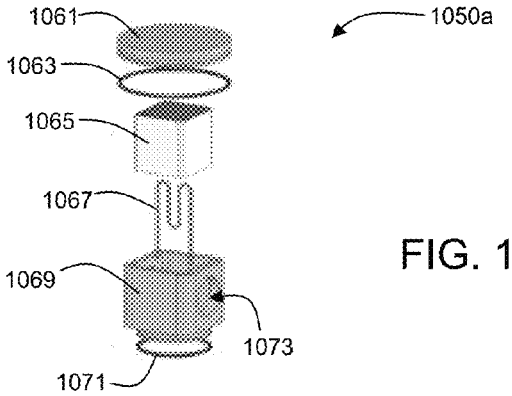
FIG. 17 is a schematic, exploded view of an embodiment of a removable pre-concentrator unit.

FIG. 17 is a schematic, exploded view of an embodiment of pre-concentrator unit 1050*a*. Pre-concentrator unit 1050*a* includes a cap 1061, sealing members 1063 and 1071, a sorbent bed 1065, a heating element 1067, and a base 1069. The structure of pre-concentrator unit 1050*b* is similar.

During operation, sample molecules/particles admitted into pre-concentrator 1010*a* enter base 1069 through aperture 1073, and are adsorbed onto sorbent bed 1065. When the concentrated sample molecules/particles are to be introduced into core unit 101*a*, controller 108 activates heating element 1067 to heat the adsorbed molecules/particles, causing them to desorb from sorbent bed 1065 and enter core unit 101*a*. Electrodes positioned within housing 1033 (not shown in FIG. 16) interface with electrodes positioned on the bottom of pre-concentrator unit 1050, facilitating electrical connection between controller 108 and heating element 1067.

IX. Sample Desorption

As discussed above, to thermally desorb sample molecules/particles adsorbed onto a pre-concentrator's sorbent bed, the adsorbed molecules/particles are heated, providing them with enough thermal energy to overcome the intermolecular forces responsible for adsorption. Typically, the adsorbed molecules/particles are heated either by indirect heating of the sorbent bed (e.g., using a heating element that distributes heat via heat conduction within the sorbent bed), or by flowing a hot gas through the sorbent bed to transfer thermal energy to the adsorbed molecules/particles and the sorbent material.

In some embodiments, however, thermal desorption of the adsorbed molecules/particles can be performed more efficiently by resistively heating the sorbent material itself. That is, an electrical current can be passed through the sorbent material. Due to the electrical resistivity of the sorbent material, Joule heating of the material occurs. The generated heat is directly and efficiently transferred to the adsorbed particles/molecules, which results in significantly increased desorption efficiency relative to indirect heating methods.

Figure 18:
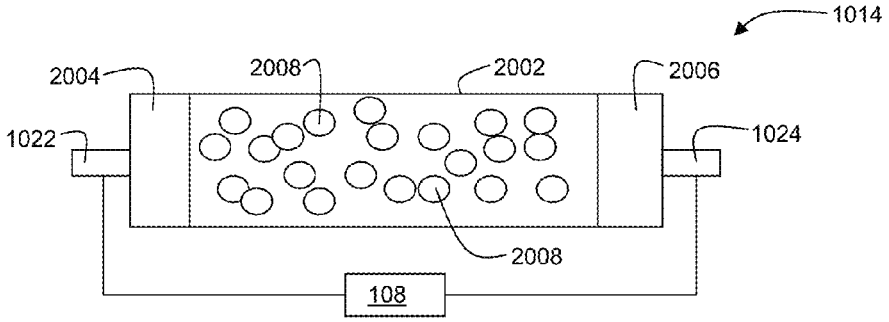
FIG. 18 is a schematic view of an embodiment of a sorbent bed.

FIG. 18 is a schematic diagram of an embodiment of a sorbent bed 1014 that is resistively heated. Sorbent bed includes a housing 2002 such as a glass tube filled with sorbent material 2008. At each end of housing 2002, electrodes 2004 and 2006 are positioned, respectively. The electrodes are coupled to controller 108. Sample molecules/particles enter sorbent bed 1014 through conduit 1022 (e.g., from an inertial impactor), and leave the sorbent bed through conduit 1024 (e.g., to enter ion trap 104, ion source 102, detector 118, or more generally, gas path 128).

Sorbent material 2008 functions as both an adsorbent and a resistive heating element. When sample molecules/particles enter sorbent bed 1014 through conduit 1022, the sorbent molecules/particles adsorb onto the surfaces of sorbent material 2008. To desorb the adsorbed molecules/particles, controller 108 passes an electrical current through sorbent material 2008, so that the sorbent material functions as a resistive heating element. As the sorbent material is resistively heated, heat is also transferred to the adsorbed molecules/particles, leading to thermal desorption.

Implementing sorbent bed 1014 as shown in FIG. 18 provides a number of important advantages relative to indirect heating of adsorbed molecules/particles. Resistive heating of sorbent material 2008 occurs more evenly than indirect heating, because the electrical current circulates through the entire sorbent material at the same time. As a result, the temperature distribution and desorption rate in sorbent bed 1014 is more uniform, ensuring that sample molecules/particles do not remain "stuck" at low temperature locations on the sorbent bed.

Heating also occurs more efficiently, which is an important consideration for the compact mass spectrometry systems disclosed herein. In such systems, power is provided by batteries, and so reducing power consumption is an important consideration. Because resistive heating of sorbent bed 1014 causes more efficient heat transfer and desorption, the adsorbed molecules/particles do not need to be heated for as long to cause desorption, and overall power consumption is thereby reduced.

Further, resistive heating of sorbent bed 1014 yields a system that is mechanically simpler and of reduced weight and size, as various heating elements and their associated control electronics can be eliminated. Mechanically simpler systems are less prone to failure, while implementing a system of reduced weight and size improves the system's portability, and therefore makes it suitable for a wider range of applications.

Still further, resistive heating of sorbent bed 1014 can occur under reduced pressure (for example, at a pressure of between 100 mTorr and 10 Torr, including any of the pressures disclosed herein in connection with pre-concentrator 1010, and any of the internal operating pressures associated with ion source 102, ion trap 104, detector 118, and/or gas path 128, such as about 1 Torr). As discussed above, reducing the pressure at which desorption occurs causes the adsorbed molecules/particles to favor the vapor phase, and as a result, less thermal energy is required to desorb the adsorbed materials, e.g., solid particulates and/or molecules. Consequently, desorption occurs at a lower temperature than under atmospheric pressure, and less power is consumed in causing desorption of the adsorbed molecules/particles, resulting in a significant reduction in power consumption relative to desorption at higher pressures (e.g., atmospheric pressure). Further, a larger fraction of the adsorbed molecules/particles undergo desorption during each heating cycle, and as a result, a more concentrated sample is delivered to ion trap 104 or ion source 102 or ion detector 118 or gas path 128, which improves detection sensitivity as discussed above. In addition, for a given quantity of power used to cause desorption, a larger amount of sample particles/molecules can be desorbed, so that a larger quantity of sample particles/molecules can be delivered to ion trap 104 or ion source 102 or ion detector 118 or gas path 128, further improving detection sensitivity.

A variety of different materials can be used for sorbent material 2008. In some embodiments, granular sorbent beads formed of materials such as activated carbon can be used to form sorbent material 2008. Examples of such materials include Carbopack™ and Carbotrap®, both of which are available from Sigma-Aldrich (St. Louis, Mo.).

In certain embodiments, sorbent material 2008 can include polymer beads. Examples of such materials include Tenax®, available from Sigma-Aldrich. More generally, any one or more of a wide variety of solid phase adsorbents can be used, including liquid chromatography adsorbent materials, gas chromatography adsorbent materials, polymer materials, and silicon beads and/or functionalized silicon beads. When such adsorbents are used, they can be mixed with carbon particles, coated onto a metallic substrate, or coated onto other beads formed of highly conductive materials such as Au and/or Ag, to increase the electrical conductivity of the adsorbents. In this manner, the adsorbents function to both adsorb sample molecules/particles, and conduct electrical current to resistively heat the adsorbed molecules/particles.

Figure 19:
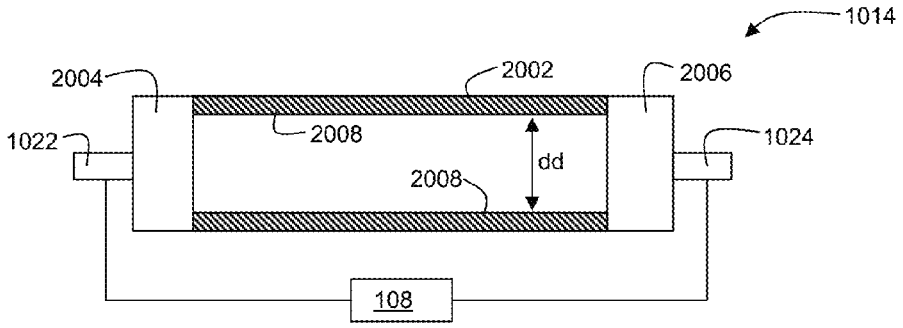
FIG. 19 is a schematic view of another embodiment of a sorbent bed.

In some embodiments, instead of packing housing 2002 with sorbent material 2008, the sorbent material can be mixed with an epoxy or resin and used to coat the internal walls of housing 2002. FIG. 19 is a schematic diagram showing an embodiment of sorbent bed 1014 in which sorbent material 2008 is used to coat the internal walls of housing 2002. In FIG. 19, the interior region of housing 2002 is not filled with a sorbent material. In certain embodiments, however, the interior volume of housing 2002 can also be filled with sorbent material, which can different from, or the same as, the sorbent material used to coat the walls of housing 2002.

In certain embodiments, sorbent material 2008 can include liquid phase adsorbents or coatings such as polyethylene glycols, arylenes and/or polysiloxanes. When such adsorbents are used, they can be mixed with carbon and/or polymeric particles, coated onto a metallic substrate, or coated onto other beads formed of highly conductive materials such as Au and/or Ag, to increase the electrical conductivity of the adsorbents. In this manner, the adsorbents function to both adsorb sample molecules/particles, and conduct electrical current to resistively heat the adsorbed molecules/particles. In some embodiments, these adsorbents can be used alone or as a part of a multi-adsorbent system, where the adsorbents coat the internal walls sorbent bed 1014, and a different adsorbent material is packed (e.g., a particulate adsorbent material) is packed within the open volume of sorbent bed 1014 between the electrodes, as discussed above.

Implementations of sorbent bed 1014 in the form of a housing packed with sorbent material, and in the form of a housing with coated internal walls, each have certain advantages. Sorbent materials in a packed housing, as shown in FIG. 18, typically have very large surface areas, ensuring that a large number of sample particles/molecules can be adsorbed. As a result, operation of the system with such sorbent beds often leads to very high detection sensitivity, as the concentration of desorbed sample molecules that are introduced and analyzed is significantly increased.

Sorbent materials that are coated on the internal walls of housing 2002 yield a sorbent bed with a smaller overall surface area for adsorption. However, such coatings reduce the internal diameter of the flow conduit that extends through housing 2002 (i.e., from conduit 1022 to conduit 1024), resulting in a much lower sample particle flow rate through housing 2002 than for a packed housing. Due to the smaller flow rate, capture of the sample particles/molecules onto the sorbent material by adsorption is much more efficient. In certain embodiments, for example, the internal diameter of the flow channel through housing 2002 (designated "dd" in FIG. 19) is 100 microns or less (e.g., 80 microns or less, 60 microns or less, 50 microns or less, 40 microns or less, 25 microns or less, 20 microns or less, 10 microns or less).

In certain embodiments, the systems disclosed herein can use both types of sorbent beds. For example, the systems can include a two-stage pre-concentrator in which the first stage of the pre-concentrator includes a housing packed with sorbent material, and the second stage of the pre-concentrator includes a housing with internal walls coated with a sorbent material. The use of a two-stage pre-concentrator can provide even more efficient adsorption of sample particles/molecules, and higher sensitivity during analysis. For example, one of the stages may be held at reduced temperature (e.g., a temperature of 300° C. or less, such as 250° C. or less, 200° C. or less, 150° C. or less, 100° C. or less, 75° C. or less, 50° C. or less, 25° C. or less, 10° C. or less, 0° C. or less, −25° C. or less) during sample collection/concentration, which improves the collection efficiency (effectively condensing the material on the cold surface of the adsorbent material). Likewise, one of the stages may be maintained at a pressure higher than atmospheric pressure (e.g., at a pressure of 800 Torr or more, 1000 Torr or more, 1200 Torr or more, 1500 Torr or more, 2000 Torr or more, 3000 Torr or more) to improve the collection efficiency (e.g., condensing the material onto the adsorbent by high pressure). Implementations can also include any of the other types of sorbent beds disclosed herein, and can include more than two stages of pre-concentration.

Figure 20:
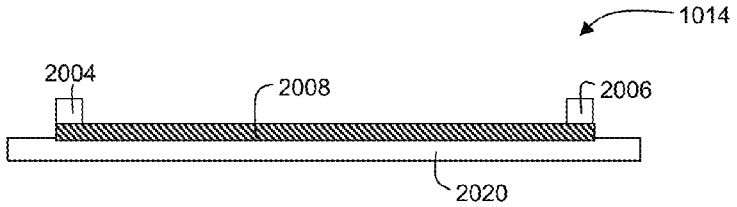
FIG. 20 is a schematic view of another embodiment of a sorbent bed.

In some embodiments, instead of packing housing 2002 with sorbent material to form sorbent bed 1014, sorbent material 2008 can be mixed with an epoxy or resin and cast onto a substrate to form a sheet of adsorbent material. FIG. 20 shows a schematic diagram of a sorbent bed 1014 that includes a mixture of adsorbent material and epoxy or resin cast onto a substrate 2020 to form a sheet of sorbent material 2008. Electrodes 2004 and 2006 contact the sheet of sorbent material so that controller 108 can resistively heat the sorbent material.

Other materials can also be used to form sorbent material. In certain embodiments, for example, one or more current spreading materials can be added to sorbent material 2008 to facilitate uniform current spreading and heating of the sorbent material when an electrical current is applied by controller 108. Suitable current spreading materials can include, for example, conductive materials implemented in the form of particles, wires, filaments, fibers, sheets, wafers, and foils.

In certain embodiments, sorbent material 2008 can include one or more conductive materials to increase the electrical conductivity of the sorbent material. Examples of such conductive materials include, but are not limited to, silver particles, gold particles, brass particles, copper particles, aluminum particles, platinum particles, and nickel particles. Including such materials facilitates resistive heating of the sorbent material, increasing the efficiency with which adsorbed molecules/particles are desorbed.

In some embodiments, sorbent bed 1014 can include more than one different type of sorbent material. The different sorbent materials can mixed together to form a mixture of sorbents distributed through housing 2002. Alternatively, sorbent bed 1014 can include discrete adsorbent units featuring different adsorbent materials and positioned in different regions within housing 2002.

Figure 21:
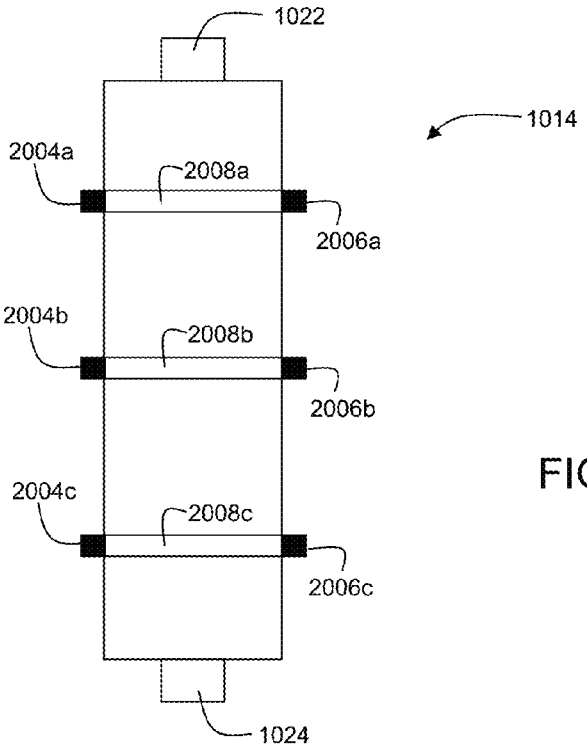
FIG. 21 is a schematic view of another embodiment of a sorbent bed.

FIG. 21 shows a schematic diagram of a sorbent bed 1014 that includes three different sorbent materials 2008*a*, 2008*b*, and 2008*c*. Each sorbent material has an associated pair of electrodes (2004 *a/b/c* and 2006 *a/b/c*) so that each sorbent material can be independently heated by controller 108. The three sorbent materials 2008*a*, 2008*b*, and 2008*c* are different, and are suitable for adsorbing different types of sample molecules/particles. By implementing multiple sorbent materials in a single sorbent bed, the sorbent bed can be used for different applications involving different types of samples. Moreover, different types of adsorbed samples can be selectively desorbed and analyzed by controller 108 by selectively delivering electrical currents to the different sorbent materials. It should be appreciated that while three different sorbent materials are implemented in FIG. 21, more generally, sorbent bed 1014 can include any number of sorbent materials and associated electrode pairs (e.g., 2 or more materials, 3 or more materials, 4 or more materials, 5 or more materials, 6 or more materials, 10 or more materials, or even more than 10 materials).

In certain embodiments, a variety of substrates can be used to support sorbent material 2008. For example, as discussed above in connection with FIG. 20, the sorbent material can be cast as a sheet onto a substrate 2020, which can be formed from materials such as glass, various polymers, and metallic materials that include, for example, one or more of gold, silver, aluminum, platinum, nickel, copper, and brass.

In some embodiments, sorbent material 2008 can be adsorbed or bonded onto a fabric sheet, with electrodes attached to the fabric sheet to direct current through the sorbent material. The fabric sheet can be formed of a conductive material such as carbon fiber to facilitate resistive heating. A carbon fiber sheet alone—without any additional sorbent material adsorbed or bonded thereto—can also form sorbent material 2008.

Figure 22:
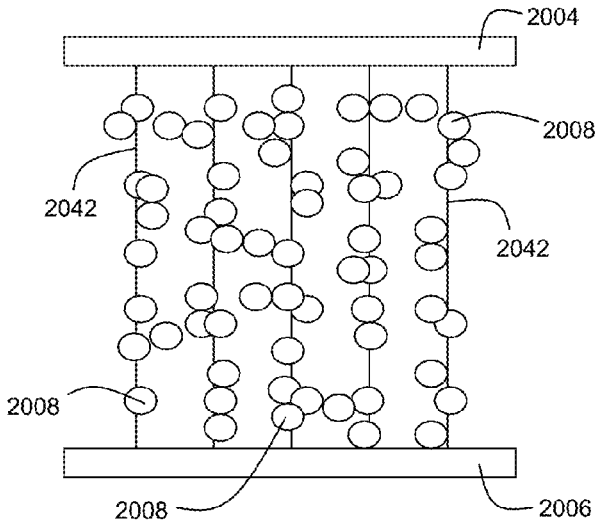
FIG. 22 is a schematic view of another embodiment of a sorbent bed.

In certain embodiments, a metallic wafer, mesh, or series of wires can be used as a substrate for sorbent material 2008. FIG. 22 is a schematic diagram of a sorbent bed 1014 that includes a plurality of wires 2042 extending between electrodes 2004 and 2006. Sorbent material 2008 is deposited onto wires 2042, which function as a support for the sorbent material. To thermally desorb adsorbed sample molecules/particles from sorbent material 2008, controller 108 directs an electrical current to flow through wires 2024 via electrodes 2004 and 2006, resistively heating sorbent material 2008.

Figure 23:
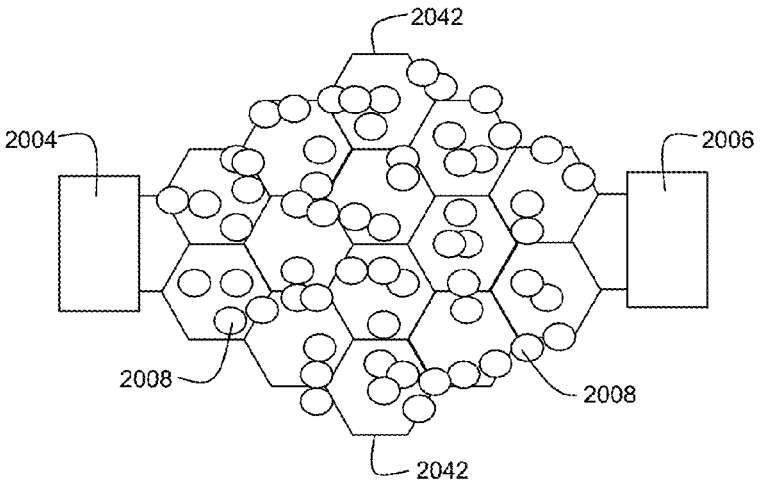
FIG. 23 is a schematic view of another embodiment of a sorbent bed.

In general, the plurality of wires 2042 can be implemented in a wide variety of geometries. For example, in some embodiments, wires 2042 can be implemented as a wire mesh or network that supports sorbent material 2008. FIG. 23 is a schematic diagram of a sorbent bed 1014 in which wires 2042 are implemented as a hexagonal or honeycomb wire mesh.

Figure 26:
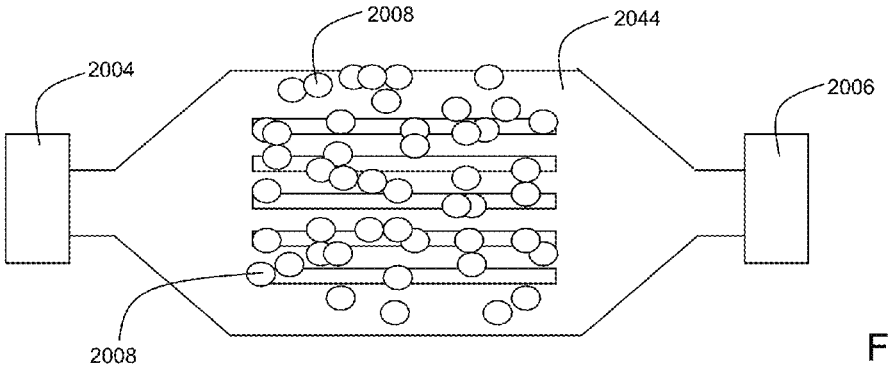
FIG. 26 is a schematic view of another embodiment of a sorbent bed.

In some embodiments, a sheet heater can be used as a support for sorbent material 2008. For example, the sheet heater can be implemented as a resistive, polymer-coated paper. As another example, the support can be a photochemically machined or lithographically etched metal sheet. FIG. 26 is a schematic diagram of a sorbent bed 1014 in which a machined metal sheet 2044 supports sorbent material 2008. Additional features of sheet heaters are disclosed, for example, in U.S. Pat. No. 7,247,822, and in U.S. Patent Application Publication No. US 2003/0155347, the entire contents of each of which are incorporated herein by reference.

In general, sorbent materials suitable for use in sorbent bed 1014 are selected based on the nature of the samples to be detected. Typically, the porosity of the sorbent material plays a significant role in determining which sample particles/molecules will adhere to the sorbent material, and which particles/molecules will not. Generally, sorbent materials with lower porosity values trap smaller molecules/particles more selectively, while sorbent materials with larger porosity values trap larger molecules/particles more selectively.

The electrical current directed through sorbent bed 1014 to cause thermal desorption can vary depending on the nature of sorbent material 2008 and the desired rate of heating. In some embodiments, for example, controller 108 directs an electrical current of 0.5 A or more (e.g., 0.7 A or more, 1.0 A or more, 1.5 A or more, 2.0 A or more, 2.5 A or more, 3.0 A or more) through sorbent material 2008 to cause thermal desorption of adsorbed sample particles/molecules.

In general, the heating time during each desorption cycle is selected to cause thermal desorption of a sufficient number of adsorbed sample molecules/particles, while avoiding excess power consumption (due to unnecessarily extended heating). In certain embodiments, controller 108 is configured to perform a complete heating and desorption cycle in less than 30 s (e.g., less than 20 s, less than 10 s, less than 5 s). In contrast, in conventional mass spectrometry systems, sample desorption typically occurs over longer intervals of as much as several minutes.

By directing a larger current through sorbent material 2008, the rate of desorption can be increased, and the temperature to which sorbent material 2008 is heated can also be increased. In some embodiments, for example, controller 108 is configured to heat sorbent material 2008 to a temperature of 300° C. or more (e.g., 350° C. or more, 400° C. or more, 450° C. or more, 500° C. or more).

In general, heating sorbent material 2008 too quickly can have disadvantageous consequences, as rapid heating of certain adsorbed sample molecules/particles can lead to thermal degradation via pyrolysis. However, the systems and methods disclosed herein can be configured to implement pyrolysis of adsorbed molecules/particles for certain samples, such that the products of the pyrolysis process are introduced into ion trap 104 (or ion source 102, or detector 118, or more generally gas path 128) for analysis. For example, hydrocarbon molecules derived from petrochemicals can be analyzed by adsorbing the molecules onto sorbent material, and then rapidly heating the adsorbed molecules to high temperature by directing an electrical current through sorbent material 2008 to cause simultaneous pyrolysis and desorption of the hydrocarbon molecules.

In some embodiments, a higher pressure (e.g., higher than the gas pressure within sorbent bed 1014) gas pulse can be introduced on one side of sorbent bed 1014 to assist with desorption and transport of adsorbed sample molecules/particles. In some embodiments, pressurized gas pulses can be repetitively introduced to create successive sample "plugs" or "bursts" that are introduced to ion trap 104, ion source 102, detector 118, and/or gas path 128, separated in time. In some embodiments, the pressurized gas pulses can be used to desorb the pre-concentrated sample particles from a mesh or filter to another region of the system for desorption and subsequent analysis.

Generally, controller 108 repeats the heating and desorption cycle after every concentration interval. The length of the concentration interval is chosen to be of sufficient length to ensure a sufficient quantity of sample particles/molecules are concentrated within sorbent bed 1014, and to ensure that heating of sorbent material 2008 does not occur too frequently, thereby unduly increasing power consumption. In addition, however, the length of the concentration interval is chosen to be sufficiently short so that long heating times (to cause nearly complete desorption of all adsorbed sample molecules/particles) are unnecessary, and that a desired number of pre-concentration cycles can be performed within a particular time interval. In some embodiments, the length of the concentration interval is between 5 seconds and 30 minutes (e.g., between 5 seconds and 20 minutes, between 5 seconds and 10 minutes, between 5 seconds and 5 minutes, between 5 seconds and 1 minute, between 5 seconds and 30 seconds, between 30 seconds and 30 minutes, between 30 seconds and 10 minutes, between 30 seconds and 5 minutes, between 1 minute and 30 minutes, between 1 minute and 10 minutes). Shorter concentration intervals (e.g., between 5 seconds and 1 minute) are typically used for rapidly analysis of samples, while longer concentration intervals (e.g., 5 minutes to 30 minutes) are typically used for time-weighted and/or integrated exposure measurements.

In some embodiments, controller 108 can be configured to heat sorbent material 2008 by increasing the sorbent material in a series of steps (e.g., by implementing a temperature ramp). This method is particularly useful when the adsorbed particles/molecules include (or are suspected to include) multiple different species. Increasing the temperature gradually leads to selective desorption of different types of particles/molecules, based on the strength of the intermolecular forces responsible for adsorption. Accordingly, but increasing the temperature gradually during desorption, different types of particles/molecules can be selectively desorbed as a function of time. These different "fractions" of sample particles/molecules can then be introduced into the system and analyzed in turn, which can simplify the analysis of a complex sample.

To implement a temperature ramp, sorbent material 2008 can be heated to any of the temperatures discussed above over a time period of 30 s or more (e.g., 1.0 minute or more, 2.0 minutes or more, 3.0 minutes or more, 5.0 minutes or more, 10.0 minutes or more, 15.0 minutes or more, 20.0 minutes or more, 30.0 minutes or more). Heating can occur in step-wise fashion, with the temperature increased by controller 108 (e.g., by successively increasing the magnitude of the current that passes through sorbent material 2008). In some embodiments, for example, the temperature of sorbent material 2008 is increased in successive steps of between 100° C. and 10° C. (e.g., between 80° C. and 10° C., between 60° C. and 10° C., between 50° C. and 10° C., between 30° C. and 10° C., between 20° C. and 10° C.) by controller 108.

X. Sample Desorption from Sampling Swabs

In a variety of applications, samples are not drawn in to the systems disclosed herein through inlet 124, but are instead collected manually by a system operator who collects the samples by swiping an adsorbent swap against an article or surface where sample molecules/particles are present. For example, security monitoring applications in public locations such as airports often involve using adsorbent swabs to collect samples from luggage, clothing, and other articles carried by passengers. Swabs can be formed of carbon fiber-based fabrics, or from one or more adsorbent materials coated on a substrate such as fabric or paper.

Figure 24:
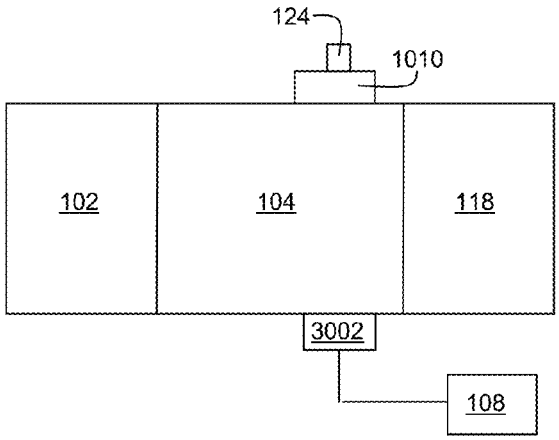
FIG. 24 is a schematic view of an embodiment of a mass spectrometry system that includes a sample port for accepting swabs.

In some embodiments, the systems and methods disclosed herein are configured to accept swabs with samples adsorbed thereto, and to desorb the adsorbed sample particles/molecules directly from the swab. FIG. 24 is a schematic diagram showing a system 100 that includes a sample port 3002 for introducing swab-adsorbed samples into ion trap 104 (or ion source 102, or detector 118, or more generally, gas path 128). Sample port 3002 is connected to controller 108 and receives control signals from the controller. In certain embodiments, only one of sample port 3002 and pre-concentrator 1010 functions at a single time. Thus, for example, when a swab is inserted into sample port 3002, controller 108 closes pre-concentrator 1010 so that no particles/molecules are collected by pre-concentrator 1010 while sample port 3002 is occupied by a swab. Alternatively, in some embodiments, both sample port 3002 and pre-concentrator 1010 operate at the same time, and samples can be simultaneously desorbed from a swab and collected in pre-concentrator 1010.

Figure 25:
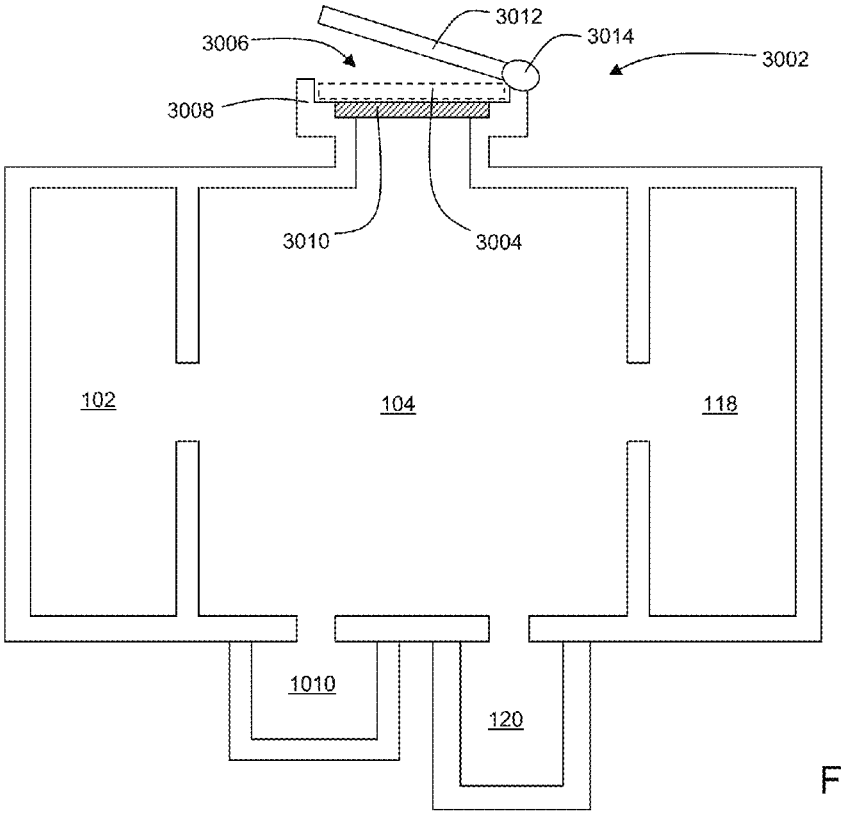
FIG. 25 is a cross-sectional view of an embodiment of a mass spectrometry system that includes a sample port for accepting swabs.

FIG. 25 is a schematic cross-sectional diagram of an embodiment of sample port 3002 in more detail. Sample port 3002 includes a support member 3008 with a recess 3006 for supporting a swab 3004, and an embedded heating element 3010 coupled to controller 108 (not shown). Sample port 3002 also includes a lid 3012 that opens and closes by virtue of hinge 3014. To analyze a sample supported on a swab 3004, the swab is inserted into recess 3006 so that it contacts heating element 3010. Then, lid 3012 is closed, and the lid clamps down firmly on swab 3004, pressing it tightly against heating element 3010. Controller 108 detects the closure of lid 3012, and applies an electrical current to heating element 3010 to increase the temperature of the element. In turn, element 3010 heats swab 3004, causing sample particles/molecules adsorbed on the swab to thermally desorb and enter ion trap, where they are ionized and analyzed.

In general, heating element 3010 can include a variety of different elements. For example, in some embodiments, heating element 3010 is implemented in the form of a metallic mesh or grid that is resistively heated when an electrical current passes through it.

Sample collection via swabs, and the subsequent desorption and analysis thereof, is particularly useful for samples in the form of solid particulates, aerosols, explosives, and other analytes that settle out on surfaces, and are therefore readily acquired through contact swiping with a swab. Conventional mass spectrometry systems typically cannot accept samples in such a format, however, because re-establishing the internal operating pressure after port 3002 is opened to introduce swab 3004 takes too long to make analysis practical. As explained above, however, due to their small internal volumes and high operating pressures, the mass spectrometry systems disclosed herein can accept swab-adsorbed samples directly, quickly re-establishing the internal gas pressure after the sample port 3002 has been opened.

As discussed above, sample particles desorbed from a swab are introduced into ion trap 104 (or ion source 102, or detector 118, or more generally gas path 128) where the particles are ionized, and electrical signals corresponding to the ions are measured to determine information about the sample particles. Due to relatively high operating pressures and relatively small internal volumes of the systems disclosed herein, the elapsed time between the onset of heating the sample particles adsorbed on the swab and measurement of the electrical signals corresponding to the ions can be relatively short. In some embodiments, for example, the elapsed time can be 3 minutes or less (e.g., 2 minutes or less, 60 seconds or less, 45 seconds or less, 30 seconds or less, 20 seconds or less, 15 seconds or less, 10 seconds or less, 5 seconds or less).

Although not shown in FIGS. 24 and 25, in some embodiments, a pre-concentrator of any of the types disclosed herein can be positioned between sample port 3002 and ion trap 104. The pre-concentrator can be used to concentrate sample molecules/particles as they are desorbed from the swab, before introduction into ion trap 104. The pre-concentrator can include all of the elements shown in the embodiments discussed herein, or certain elements (such as the inertial impactor) can be omitted.

The swabs used to collect sample particles/molecules can be tailored for specific applications. For example, in some embodiments the swabs can be physically or chemically modified to a) improve the collection efficiency for materials of interest, and/or b) selectively capture sample compounds of interest while not capturing nuisance chemicals that are not of interest. In certain embodiments the swabs can be electrostatically charged to assist with collection of fine particulates.

Hardware and Software Implementation

Any of the method steps, features, and/or attributes disclosed herein can be executed by controller 108 (e.g., electronic processor 110 of controller 108) and/or one or more additional electronic processors (such as computers or preprogrammed integrated circuits) executing programs based on standard programming techniques. Such programs are designed to execute on programmable computing apparatus or specifically designed integrated circuits, each comprising a processor, a data storage system (including memory and/or storage elements), at least one input device, and at least one output device, such as a display or printer. The program code is applied to input data to perform functions and generate output information which is applied to one or more output devices. Each such computer program can be implemented in a high-level procedural or object-oriented programming language, or an assembly or machine language. Furthermore, the language can be a compiled or interpreted language. Each such computer program can be stored on a computer readable storage medium (e.g., optical storage medium such as CD-ROM or DVD, magnetic storage medium, and/or persistent solid state storage medium) that, when read by a computer, processor, or electronic circuit, can cause the computer, processor, or electronic circuit to perform the analysis and control functions described herein.

OTHER EMBODIMENTS

A number of embodiments have been described. Nevertheless, it will be understood that various modifications may be made without departing from the spirit and scope of the disclosure. Accordingly, other embodiments are within the scope of the following claims.

What is claimed is:

1. A mass spectrometry system, comprising:

an ion source, an ion trap, and an ion detector connected along a gas path;

a sample pre-concentrator connected to the gas path, wherein the sample pre-concentrator comprises an adsorbent material disposed on a plurality of metallic wires; and a controller connected to the sample pre-concentrator, wherein during operation of the system:

the controller is configured to heat sample particles adsorbed on the adsorbent material by directing an electrical current to flow through the plurality of metallic wires, to desorb the particles from the adsorbent material and introduce the desorbed particles into the gas path.

2. The system of claim 1, wherein the pre-concentrator comprises a first layer of adsorbed material electrically connected to a first pair of the plurality of wires, and a second layer of adsorbent material electrically connected to a second pair of the plurality of wires.

3. The system of claim 2, wherein during operation of the system, the controller is selectively configured to heat sample particles adsorbed to the first layer of adsorbent material or the second layer of adsorbent material by directing the electrical current to flow through the first or second pair of wires, respectively.

4. The system of claim 2, wherein a composition of the first layer of adsorbent material is different from a composition of the second layer of adsorbent material.

5. The system of claim 1, wherein the controller is configured to heat the sample particles to a temperature of 400° C. or more during a desorption period of 30 s or less.

6. The system of claim 5, wherein the desorption period is 10 s or less.

7. The system of claim 1, further comprising a housing with a first recess and a second recess, and wherein:

the first recess is configured to receive a core module comprising the ion source, the ion trap, and the ion detector;

the second recess is configured to receive a pre-concentrator module comprising the adsorbent material; and the housing is configured so that the core module and the pre-concentrator module are independently insertable and removable from the housing.

8. The system of claim 1, wherein the gas path is configured so that desorbed sample particles are introduced into the gas path without passing the sample particles through a flow rate-limiting element at a junction between the pre-concentrator and the gas path.

9. The system of claim 1, wherein the sample pre-concentrator is a first sample pre-concentrator, the system further comprising a second sample pre-concentrator connected to the gas path, wherein the second sample pre-concentrator comprises an adsorbent material disposed on a plurality of metallic wires.

10. The system of claim 9, wherein the controller is configured to selectively adsorb sample particles within the first sample pre-concentrator or within the second sample pre-concentrator.

11. The system of claim 10, wherein the adsorbent material of the first sample pre-concentrator is different from the adsorbent material of the second sample pre-concentrator.

12. A mass spectrometry system, comprising:

an ion source, an ion trap, and an ion detector connected along a gas path;

a sample pre-concentrator connected to the gas path, wherein the sample pre-concentrator is configured to adsorb sample particles; and a controller connected to the sample pre-concentrator, wherein during operation of the system, the controller:

(a) heats adsorbed sample particles within the sample pre-concentrator to desorb the sample particles from the sample pre-concentrator;

(b) introduces the desorbed sample particles into the gas path;

(c) ionizes at least some of the introduced sample particles; and (d) measures the ionized sample particles to determine mass spectral information for the sample particles; and wherein steps (a)-(d) are performed within a total time period of 30 seconds or less.

13. The system of claim 12, wherein the total time period is 20 seconds or less.

14. The system of claim 12, wherein steps (a) and (b) are performed within a total time period of 10 seconds or less.

15. The system of claim 12, wherein steps (c) and (d) are performed within a total time period of 10 seconds or less.

16. The system of claim 12, wherein in step (b), the desorbed sample particles are introduced into the gas path without passing the sample particles through a flow rate-limiting element between the sample pre-concentrator and the gas path.

17. The system of claim 12, wherein during step (a), the sample particles are heated to a temperature of at least 400° C.

18. The system of claim 12, wherein at least 10 picograms of sample particles are heated and introduced into the gas path in steps (a) and (b).

19. The system of claim 12, wherein the sample pre-concentrator comprises an adsorbent material and one or more electrical conductors that extend through the adsorbent material, and wherein the one or more electrical conductors are in electrical communicator with the controller.

20. The system of claim 19, wherein the adsorbent material comprises activated carbon.

21. The system of claim 19, wherein the adsorbent material comprises beads formed of one or more metals.

22. The system of claim 19, wherein the controller is configured to heat the adsorbed sample particles by directing an electrical current to flow through the one or more electrical conductors.

23. The system of claim 19, wherein the sample pre-concentrator is a first sample pre-concentrator, the system further comprising:

a second sample pre-concentrator configured to adsorb sample particles, wherein the controller is configured to selectively direct sample particles into the first sample pre-concentrator or the second sample pre-concentrator.

24. A mass spectrometry system, comprising:

an ion source, an ion trap, and an ion detector connected along a gas path;

a sample port connected to the gas path; and a controller connected to the sample port, wherein the sample port comprises a recess configured to receive a swab comprising adsorbed sample particles, a heating element configured to contact the swab when the swab is positioned in the recess, and a member deployable by the controller to open and close an aperture of the sample port; and wherein during operation of the system, when the swab is positioned in the recess and the member is deployed to close the aperture of the sample port, the controller is configured to activate the heating element to liberate the sample particles from the swab and introduce the sample particles into the gas path.

25. The system of claim 24, further comprising a sample pre-concentrator connected to the controller and positioned between the sample port and the gas path, wherein during operation of the system, sample particles liberated from the swab are adsorbed onto an adsorbent material of the sample pre-concentrator.

26. The system of claim 25, wherein the sample pre-concentrator comprises the adsorbent material and one or more electrical conductors extending through the adsorbent material and connected electrically to the controller.

27. The system of claim 26, wherein during operation of the system, the controller is configured to desorb the sample particles adsorbed on the adsorbent material by directing an electrical current to flow along the one or more electrical conductors to heat the adsorbent material.

* * * * *